US010355346B2

(12) United States Patent
Puente Baliarda et al.

(10) Patent No.: US 10,355,346 B2
(45) **Date of Patent: *Jul. 16, 2019**

(54) SPACE-FILLING MINIATURE ANTENNAS

(71) Applicant: Fractus, S.A., Barcelona (ES)

(72) Inventors: Carles Puente Baliarda, Sant Cugat del Valles (ES); Edouard Jean Louis Rozan, Barcelona (ES); Jaume Anguera Pros, Vinaros (ES)

(73) Assignee: Fractus, S.A., Barcelona (ES)

( * ) Notice: Subject to any disclaimer, the term of this patent is extended or adjusted under 35 U.S.C. 154(b) by 376 days.

This patent is subject to a terminal disclaimer.

(21) Appl. No.: 15/084,140

(22) Filed: Mar. 29, 2016

(65) Prior Publication Data

US 2016/0285168 A1 Sep. 29, 2016

Related U.S. Application Data

(60) Continuation of application No. 14/045,241, filed on Oct. 3, 2013, now Pat. No. 9,331,382, which is a (Continued)

(51) Int. Cl.
*H01Q 1/38* (2006.01)
*H01Q 1/36* (2006.01)
(Continued)

(52) U.S. Cl.
CPC ..... *H01Q 1/36* (2013.01); *H01Q 1/38* (2013.01); *H01Q 5/25* (2015.01); *H01Q 5/357* (2015.01);
(Continued)

(58) Field of Classification Search
CPC ..... H01Q 1/36; H01Q 1/38; H01Q 13/206; H01Q 21/00
(Continued)

(56) References Cited

U.S. PATENT DOCUMENTS 3,079,602 A 2/1963 Du Hamel
3,521,284 A 7/1970 Shelton
(Continued)

FOREIGN PATENT DOCUMENTS

CN 2224466 4/1996
DE 3337941 5/1985
(Continued)

OTHER PUBLICATIONS

Chen , W. S.,Small circularly polarized microstrip antennas,Antennas and Propagation Society (APS), 1999. IEEE International Symposium,Jul. 11, 1999.
(Continued)

*Primary Examiner* — Dameon E Levi
*Assistant Examiner* — Collin Dawkins
(74) *Attorney, Agent, or Firm* — Edell, Shapiro $ Finnan, LLC

(57) ABSTRACT

A novel geometry, the geometry of Space-Filling Curves (SFC) is defined in the present invention and it is used to shape a part of an antenna. By means of this novel technique, the size of the antenna can be reduced with respect to prior art, or alternatively, given a fixed size the antenna can operate at a lower frequency with respect to a conventional antenna of the same size.

20 Claims, 25 Drawing Sheets

Related U.S. Application Data continuation of application No. 13/044,207, filed on Mar. 9, 2011, now Pat. No. 8,558,741, which is a continuation of application No. 12/498,090, filed on Jul. 6, 2009, now Pat. No. 8,207,893, which is a continuation of application No. 12/347,462, filed on Dec. 31, 2008, now Pat. No. 8,212,726, which is a continuation of application No. 11/686,804, filed on Mar. 15, 2007, now Pat. No. 7,554,490, which is a division of application No. 11/179,250, filed on Jul. 12, 2005, now Pat. No. 7,202,822, which is a continuation of application No. 11/110,052, filed on Apr. 20, 2005, now Pat. No. 7,148,850, which is a continuation of application No. 10/182,635, filed as application No. PCT/EP00/00411 on Jan. 19, 2001, now abandoned.

(51) Int. Cl.

| | |
|---|---|
| ***H01Q 9/04*** | (2006.01) |
| ***H01Q 9/40*** | (2006.01) |
| ***H01Q 9/42*** | (2006.01) |
| ***H01Q 13/10*** | (2006.01) |
| ***H01Q 5/25*** | (2015.01) |
| ***H01Q 5/357*** | (2015.01) |

(52) U.S. Cl.

CPC ..... *H01Q 9/0407* (2013.01); *H01Q 9/40* (2013.01); *H01Q 9/42* (2013.01); *H01Q 13/10* (2013.01)

(58) Field of Classification Search

USPC ..... 343/700 MS, 702, 725, 892

See application file for complete search history.

(56) References Cited

U.S. PATENT DOCUMENTS

| | | | |
|---|---|---|---|
| 3,599,214 | A | 8/1971 | Altmayer |
| 3,622,890 | A | 11/1971 | Fujimoto |
| 3,683,376 | A | 8/1972 | Pronovost |
| 3,683,379 | A | 8/1972 | Saddler |
| 3,689,929 | A | 9/1972 | Moody |
| 3,818,490 | A | 6/1974 | Leahy |
| 3,967,276 | A | 6/1976 | Goubau |
| 3,969,730 | A | 7/1976 | Fuchser |
| 4,021,810 | A | 5/1977 | Urpo |
| 4,024,542 | A | 5/1977 | Ikawa |
| 4,038,662 | A | 7/1977 | Turner |
| 4,072,951 | A | 2/1978 | Kaloi |
| 4,131,893 | A | 12/1978 | Munson |
| 4,141,016 | A | 2/1979 | Nelson |
| 4,318,109 | A | 3/1982 | Weathers |
| 4,356,492 | A | 10/1982 | Kaloi |
| 4,381,566 | A | 4/1983 | Kane |
| 4,471,358 | A | 9/1984 | Glasser |
| 4,471,493 | A | 9/1984 | Shober |
| 4,504,834 | A | 3/1985 | Garay |
| 4,536,725 | A | 8/1985 | Hubler |
| 4,543,581 | A | 9/1985 | Nemet |
| 4,571,595 | A | 2/1986 | Phillips |
| 4,584,709 | A | 4/1986 | Kneisel |
| 4,590,614 | A | 5/1986 | Erat |
| 4,608,572 | A | 8/1986 | Blakney |
| 4,623,894 | A | 11/1986 | Lee |
| 4,628,322 | A | 12/1986 | Marko |
| 4,673,948 | A | 6/1987 | Kuo |
| 4,723,305 | A | 2/1988 | Phillips |
| 4,730,195 | A | 3/1988 | Phillips |
| 4,752,968 | A | 6/1988 | Lindenmeier |
| 4,827,266 | A | 5/1989 | Sato |
| 4,827,271 | A | 5/1989 | Berneking |
| 4,839,660 | A | 6/1989 | Hadzoglou |
| 4,843,468 | A | 6/1989 | Drewery |
| 4,847,629 | A | 7/1989 | Shimazaki |
| 4,849,766 | A | 7/1989 | Inaba |
| 4,857,939 | A | 8/1989 | Shimazaki |
| 4,860,019 | A | 8/1989 | Jiang |
| 4,890,114 | A | 12/1989 | Egashira |
| 4,894,663 | A | 1/1990 | Urbish |
| 4,907,011 | A | 3/1990 | Kuo |
| 4,912,481 | A | 3/1990 | Mace |
| 4,975,711 | A | 12/1990 | Lee |
| 5,030,963 | A | 7/1991 | Tadama |
| 5,138,328 | A | 8/1992 | Zibrik |
| 5,168,472 | A | 12/1992 | Lockwood |
| 5,172,084 | A | 12/1992 | Fiedziuszko |
| 5,200,756 | A | 4/1993 | Feller |
| 5,214,434 | A | 5/1993 | Hsu |
| 5,218,370 | A | 6/1993 | Blaese |
| 5,227,804 | A | 7/1993 | Oda |
| 5,227,808 | A | 7/1993 | Davis |
| 5,245,350 | A | 9/1993 | Sroka |
| 5,248,988 | A | 9/1993 | Makino |
| 5,255,002 | A | 10/1993 | Day |
| 5,257,032 | A | 10/1993 | Diamond |
| 5,307,075 | A | 4/1994 | Huynh |
| 5,337,065 | A | 8/1994 | Bonnet |
| 5,347,291 | A | 9/1994 | Moore |
| 5,355,144 | A | 10/1994 | Walton |
| 5,355,318 | A | 10/1994 | Dionnet |
| 5,363,114 | A | 11/1994 | Shoemaker |
| 5,373,300 | A | 12/1994 | Jenness |
| 5,402,134 | A | 3/1995 | Miller |
| 5,410,322 | A | 4/1995 | Sonoda |
| 5,420,599 | A | 5/1995 | Erkocevic |
| 5,422,651 | A | 6/1995 | Chang |
| 5,451,965 | A | 9/1995 | Matsumoto |
| 5,451,968 | A | 9/1995 | Emery |
| 5,453,751 | A | 9/1995 | Tsukamoto |
| 5,453,752 | A | 9/1995 | Wang |
| 5,457,469 | A | 10/1995 | Diamond |
| 5,471,224 | A | 11/1995 | Barkeshli |
| 5,493,702 | A | 2/1996 | Crowley |
| 5,495,261 | A | 2/1996 | Baker |
| 5,508,709 | A | 4/1996 | Krenz |
| 5,534,877 | A | 7/1996 | Sorbello |
| 5,537,367 | A | 7/1996 | Lockwood |
| 5,557,293 | A | 9/1996 | McCoy |
| 5,569,879 | A | 10/1996 | Gloton |
| H1631 | H | 2/1997 | Montgomery |
| 5,608,417 | A | 3/1997 | De Vall |
| 5,619,205 | A | 4/1997 | Johnson |
| 5,684,672 | A | 11/1997 | Karidis |
| 5,712,640 | A | 1/1998 | Andou |
| 5,767,811 | A | 6/1998 | Mandai |
| 5,784,032 | A | 7/1998 | Johnston |
| 5,790,080 | A | 8/1998 | Apostolos |
| 5,798,688 | A | 8/1998 | Shofield |
| 5,809,433 | A | 9/1998 | Thompson |
| 5,821,907 | A | 10/1998 | Zhu |
| 5,838,285 | A | 11/1998 | Tay |
| 5,841,402 | A | 11/1998 | Dias |
| 5,841,403 | A | 11/1998 | West |
| 5,870,066 | A | 2/1999 | Asakura |
| 5,872,546 | A | 2/1999 | Ihara |
| 5,898,404 | A | 4/1999 | Jou |
| 5,903,240 | A | 5/1999 | Kawahata |
| 5,918,183 | A | 6/1999 | Janky |
| 5,926,139 | A | 7/1999 | Korisch |
| 5,926,141 | A | 7/1999 | Lindenmeier |
| 5,929,825 | A | 7/1999 | Niu |
| 5,936,583 | A | 8/1999 | Sekine |
| 5,936,587 | A | 8/1999 | Gudilev |
| 5,943,020 | A | 8/1999 | Liebendoerfer |
| 5,966,098 | A | 10/1999 | Qi |
| 5,973,651 | A | 10/1999 | Suesada |
| 5,986,609 | A | 11/1999 | Spall |
| 5,986,610 | A | 11/1999 | Miron |
| 5,986,615 | A | 11/1999 | Westfall |
| 5,990,838 | A | 11/1999 | Burns |
| 5,995,052 | A | 11/1999 | Sadler |
| 6,002,367 | A | 12/1999 | Engblom |

(56) References Cited

U.S. PATENT DOCUMENTS 6,005,524 A 12/1999 Hayes
6,011,518 A 1/2000 Yamagishi
6,011,699 A 1/2000 Murray
6,016,130 A 1/2000 Annamaa
6,028,567 A 2/2000 Lahti
6,028,568 A 2/2000 Asakura
6,031,499 A 2/2000 Dichter
6,031,505 A 2/2000 Qi
6,040,803 A 3/2000 Spall
6,058,211 A 5/2000 Bormans
6,069,592 A 5/2000 Wass
6,075,489 A 6/2000 Sullivan
6,075,500 A 6/2000 Kurz
6,078,294 A 6/2000 Mitarai
6,087,990 A 7/2000 Thill
6,091,365 A 7/2000 Derneryd
6,094,179 A 7/2000 Davidson
6,097,339 A 8/2000 Filipovic
6,097,345 A 8/2000 Walton
6,104,349 A 8/2000 Cohen
6,111,545 A 8/2000 Saari
6,122,533 A 9/2000 Zhang
6,127,977 A 10/2000 Cohen
6,130,651 A 10/2000 Yanagisawa
6,131,042 A 10/2000 Lee
6,140,966 A 10/2000 Pankinaho
6,140,969 A 10/2000 Lindenmeier
6,140,975 A 10/2000 Cohen
6,141,540 A 10/2000 Richards
6,147,649 A 11/2000 Ivrissimtzis
6,147,652 A 11/2000 Sekine
6,147,655 A 11/2000 Roesner
6,157,344 A 12/2000 Bateman
6,160,513 A 12/2000 Davidson
6,166,694 A 12/2000 Ying
6,172,618 B1 1/2001 Hakozaki
6,181,281 B1 1/2001 Desclos
6,181,284 B1 1/2001 Madsen
6,195,048 B1 2/2001 Chiba
6,198,442 B1 3/2001 Rutkowski
6,201,501 B1 3/2001 Arkko
6,204,826 B1 3/2001 Rutkowski
6,211,824 B1 4/2001 Holden
6,211,826 B1 4/2001 Aoki
6,211,889 B1 4/2001 Stoutamire
6,215,474 B1 4/2001 Shah
6,218,992 B1 4/2001 Sadler
6,236,366 B1 5/2001 Yamamoto
6,236,372 B1 5/2001 Lindenmeier
6,239,755 B1 * 5/2001 Klemens ..... H01Q 1/244 343/702
6,239,765 B1 5/2001 Johnson
6,243,592 B1 6/2001 Nakada
6,259,407 B1 7/2001 Tran
6,266,023 B1 7/2001 Nagy
6,266,538 B1 7/2001 Waldron
6,272,356 B1 8/2001 Dolman
6,281,846 B1 8/2001 Puente
6,281,848 B1 8/2001 Nagumo
6,285,342 B1 9/2001 Brady
6,288,680 B1 9/2001 Tsuru
6,292,154 B1 9/2001 Deguchi
6,300,910 B1 10/2001 Kim
6,300,914 B1 10/2001 Yang
6,301,489 B1 10/2001 Winstead
6,307,511 B1 10/2001 Ying
6,307,512 B1 10/2001 Geeraert
6,327,485 B1 12/2001 Waldron
6,329,951 B1 12/2001 Wen
6,329,954 B1 12/2001 Fuchs
6,329,962 B2 12/2001 Ying
6,333,716 B1 12/2001 Pontoppidan
6,333,719 B1 12/2001 Varadan
6,343,208 B1 1/2002 Ying
6,346,914 B1 2/2002 Annamaa
6,352,434 B1 3/2002 Emmert
6,353,443 B1 3/2002 Ying
6,360,105 B2 3/2002 Nakada
6,366,243 B1 4/2002 Isohatala
6,367,939 B1 4/2002 Carter
6,373,447 B1 4/2002 Rostoker
6,380,902 B2 4/2002 Duroux
6,384,790 B2 5/2002 Dishart
6,388,626 B1 5/2002 Gamalielsson
6,396,444 B1 5/2002 Goward
6,407,710 B2 6/2002 Keilen
6,408,190 B1 6/2002 Ying
6,417,810 B1 7/2002 Huels
6,417,816 B2 7/2002 Sadler
6,421,013 B1 7/2002 Chung
6,431,712 B1 8/2002 Turnbull
6,445,352 B1 9/2002 Cohen
6,452,549 B1 9/2002 Lo
6,452,553 B1 9/2002 Cohen
6,476,766 B1 11/2002 Cohen
6,483,462 B2 11/2002 Weinberger
6,496,154 B2 12/2002 Gyenes
6,525,691 B2 2/2003 Varadan
6,538,604 B1 3/2003 Isohatala
6,552,690 B2 4/2003 Veerasamy
6,603,434 B2 8/2003 Lindenmeier
6,664,932 B2 12/2003 Sabet
6,697,024 B2 2/2004 Fuerst
6,707,428 B2 3/2004 Gram
6,756,944 B2 6/2004 Tessier
6,784,844 B1 8/2004 Boakes
6,831,606 B2 12/2004 Sajadinia
6,839,040 B2 1/2005 Huber
6,928,413 B1 8/2005 Pulitzer
7,015,868 B2 3/2006 Puente
7,123,208 B2 10/2006 Puente
7,148,850 B2 12/2006 Puente
7,202,822 B2 4/2007 Puente
7,394,432 B2 7/2008 Puente
7,397,431 B2 7/2008 Puente
7,511,675 B2 3/2009 Puente
7,528,782 B2 5/2009 Puente
2001/0002823 A1 6/2001 Ying
2001/0050636 A1 12/2001 Weinberger
2002/0000940 A1 1/2002 Moren
2002/0000942 A1 1/2002 Duroux
2002/0036594 A1 3/2002 Gyenes
2002/0105468 A1 8/2002 Tessier
2002/0109633 A1 8/2002 Ow
2002/0126054 A1 9/2002 Fuerst
2002/0126055 A1 9/2002 Lindenmeier
2002/0140615 A1 10/2002 Puente
2002/0175866 A1 11/2002 Gram
2002/0175879 A1 11/2002 Sabet
2002/0190904 A1 12/2002 Cohen
2003/0090421 A1 5/2003 Sajadinia
2005/0195112 A1 9/2005 Puente

FOREIGN PATENT DOCUMENTS

DE 10142965 3/2003
EP 0096847 12/1983
EP 0253608 1/1988
EP 0297813 1/1989
EP 0358090 3/1990
EP 0396033 11/1990
EP 0543645 5/1993
EP 0590671 9/1993
EP 0571124 11/1993
EP 0620677 10/1994
EP 0688040 12/1995
EP 0765001 9/1996
EP 0736926 10/1996
EP 0814536 12/1997
EP 0823748 2/1998
EP 0825672 2/1998
EP 0871238 10/1998
EP 0892459 1/1999
EP 0902472 3/1999

(56) References Cited

FOREIGN PATENT DOCUMENTS

| | | |
|---|---|---|
| EP | 0929121 | 7/1999 |
| EP | 0932219 | 7/1999 |
| EP | 0938158 | 8/1999 |
| EP | 0942488 | 9/1999 |
| EP | 0969375 | 1/2000 |
| EP | 1024552 | 1/2000 |
| EP | 0986130 | 3/2000 |
| EP | 0997974 | 5/2000 |
| EP | 1011167 | 6/2000 |
| EP | 1018777 | 7/2000 |
| EP | 1018779 | 7/2000 |
| EP | 1026774 | 8/2000 |
| EP | 1071161 | 1/2001 |
| EP | 1079462 | 2/2001 |
| EP | 1083623 | 3/2001 |
| EP | 1083624 | 3/2001 |
| EP | 1091446 | 4/2001 |
| EP | 1094545 | 4/2001 |
| EP | 1096602 | 5/2001 |
| EP | 1126522 | 8/2001 |
| EP | 1148581 | 10/2001 |
| EP | 1198027 | 10/2001 |
| EP | 0749176 | 9/2002 |
| EP | 1237224 | 9/2002 |
| EP | 1258054 | 11/2002 |
| EP | 1267438 | 12/2002 |
| EP | 0924793 | 6/2003 |
| EP | 1326302 | 11/2003 |
| EP | 1016158 | 12/2003 |
| EP | 1317018 | 2/2004 |
| EP | 1396906 | 3/2004 |
| EP | 1414106 | 4/2004 |
| EP | 1453140 | 9/2004 |
| EP | 0843905 | 12/2004 |
| EP | 1223637 | 3/2005 |
| EP | 1515392 | 3/2005 |
| EP | 1592083 | 11/2005 |
| EP | 1592083 | 4/2013 |
| ES | 2112163 | 3/1998 |
| ES | 2142280 | 5/2000 |
| ES | 2174707 | 7/2004 |
| FI | 972897 | 1/1999 |
| FR | 2543744 | 10/1984 |
| FR | 2704359 | 11/1994 |
| FR | 2837339 | 9/2003 |
| GB | 1313020 | 4/1973 |
| GB | 2161026 | 1/1986 |
| GB | 2215136 | 9/1989 |
| GB | 2293275 | 3/1996 |
| GB | 2317994 | 4/1998 |
| GB | 2330951 | 5/1999 |
| GB | 2355116 | 4/2001 |
| JP | 55147806 | 11/1980 |
| JP | 5129816 | 10/1991 |
| JP | 05007109 | 1/1993 |
| JP | 5267916 | 10/1993 |
| JP | 05283928 | 10/1993 |
| JP | 05-308223 | 11/1993 |
| JP | 05347507 | 12/1993 |
| JP | 06-085530 | 3/1994 |
| JP | 6204908 | 7/1994 |
| JP | 6252629 | 9/1994 |
| JP | 7073310 | 3/1995 |
| JP | 08-052968 | 2/1996 |
| JP | 09-069718 | 3/1997 |
| JP | 09-199939 | 7/1997 |
| JP | 1997-246852 | 9/1997 |
| JP | 10-163748 | 6/1998 |
| JP | 10-209744 | 8/1998 |
| JP | 10-303637 | 11/1998 |
| JP | 11-004113 | 1/1999 |
| JP | 11-027042 | 1/1999 |
| JP | 11136015 | 5/1999 |
| JP | 11-220319 | 8/1999 |
| SE | 518988 | 12/2002 |
| WO | 8809065 | 11/1988 |
| WO | 9312559 | 6/1993 |
| WO | 9511530 | 4/1995 |
| WO | 9627219 | 9/1996 |
| WO | 9629755 | 9/1996 |
| WO | 9638881 | 12/1996 |
| WO | 9706578 | 2/1997 |
| WO | 9707557 | 2/1997 |
| WO | 9711507 | 3/1997 |
| WO | 9732355 | 9/1997 |
| WO | 9733338 | 11/1997 |
| WO | 9735360 | 11/1997 |
| WO | 9747054 | 12/1997 |
| WO | 9805088 | 2/1998 |
| WO | 9812771 | 3/1998 |
| WO | 9820578 | 5/1998 |
| WO | 9836469 | 8/1998 |
| WO | 9903166 | 1/1999 |
| WO | 9903167 | 1/1999 |
| WO | 9925042 | 5/1999 |
| WO | 9925044 | 5/1999 |
| WO | 9927608 | 6/1999 |
| WO | 9943039 | 8/1999 |
| WO | 9956345 | 11/1999 |
| WO | 9965102 | 12/1999 |
| WO | 0001028 | 1/2000 |
| WO | 0003167 | 1/2000 |
| WO | 0003453 | 1/2000 |
| WO | 0022695 | 4/2000 |
| WO | 0025266 | 5/2000 |
| WO | 0034916 | 6/2000 |
| WO | 0036700 | 6/2000 |
| WO | 0049680 | 8/2000 |
| WO | 0052784 | 9/2000 |
| WO | 0052787 | 9/2000 |
| WO | 0065686 | 11/2000 |
| WO | 0067342 | 11/2000 |
| WO | 0077728 | 12/2000 |
| WO | 0077884 | 12/2000 |
| WO | 0103238 | 1/2001 |
| WO | 0105048 | 1/2001 |
| WO | 0108093 | 2/2001 |
| WO | 0108254 | 2/2001 |
| WO | 0108257 | 2/2001 |
| WO | 0108260 | 2/2001 |
| WO | 0111721 | 2/2001 |
| WO | 0113464 | 2/2001 |
| WO | 0115271 | 3/2001 |
| WO | 0117063 | 3/2001 |
| WO | 0117064 | 3/2001 |
| WO | 0120714 | 3/2001 |
| WO | 0120927 | 3/2001 |
| WO | 0122528 | 3/2001 |
| WO | 0124314 | 4/2001 |
| WO | 0126182 | 4/2001 |
| WO | 0128035 | 4/2001 |
| WO | 0131739 | 5/2001 |
| WO | 0131747 | 5/2001 |
| WO | 0133663 | 5/2001 |
| WO | 0133664 | 5/2001 |
| WO | 0133665 | 5/2001 |
| WO | 0135491 | 5/2001 |
| WO | 0135492 | 5/2001 |
| WO | 0137369 | 5/2001 |
| WO | 0137370 | 5/2001 |
| WO | 0141252 | 6/2001 |
| WO | 0147056 | 6/2001 |
| WO | 0148860 | 7/2001 |
| WO | 0148861 | 7/2001 |
| WO | 0154225 | 7/2001 |
| WO | 0165636 | 9/2001 |
| WO | 0173890 | 10/2001 |
| WO | 0178192 | 10/2001 |
| WO | 0182410 | 11/2001 |
| WO | 0186753 | 11/2001 |
| WO | 0189031 | 11/2001 |
| WO | 0235646 | 5/2002 |
| WO | 0235652 | 5/2002 |
| WO | 02078121 | 10/2002 |

(56) References Cited

FOREIGN PATENT DOCUMENTS

| | | |
|---|---|---|
| WO | 02078123 | 10/2002 |
| WO | 02078124 | 10/2002 |
| WO | 02080306 | 10/2002 |
| WO | 02084790 | 10/2002 |
| WO | 02091518 | 11/2002 |
| WO | 02095874 | 11/2002 |
| WO | 02096166 | 11/2002 |
| WO | 03017421 | 2/2003 |
| WO | 03023900 | 3/2003 |
| WO | 2005076933 | 8/2005 |
| WO | 2005081358 | 9/2005 |

OTHER PUBLICATIONS

Chen , W. S.,Square-ring microstrip antenna with a cross strip for compact circular polarization operation,Antennas and Propagation, IEEE Transactions on,Oct. 1, 1999.
Chen , X. ; Ying , Z.,Small Antenna Design for Mobile Handsets (part I),Sony Ericsson,Mar. 25, 2009.
Chiba , N. et al,Dual frequency planar antenna for handsets,Electronics Letters,Dec. 10, 1998.
Chow , Y. W. et al.,An innovative monopole antenna for mobile phone handsets,Microwave and Optical Technology Letters,Apr. 20, 2000.
Chu , L. J.,Physical limitations of omni-directional antennas,Journal of Applied Physics,Dec. 1, 1948.
Cohen , N.,Fractal antennas—Part 1—Introduction and the fractal quad,Communications Quarterly,Jul. 1, 1995.
Cohen , N.,Fractal and shaped dipoles—Some simple fractal dipoles, their benefits and limitations,Communications Quarterly,Mar. 1, 1996.
Cohen , N.,Fractal antennas—Part 2—A discussion of relevant, but disparate, qualities,Communications Quarterly,Jul. 1, 1996.
Cohen , N.,Fractal antenna applications in wireless telecommunications,Electronics Industries Forum of New England, 1997. IEEE Professional Program Proceedings,May 6, 1997, pp. 43-49.
Cohen , N.,Fractal element antennas,Journal of Electronic Defense,Jul. 1, 1997.
Cohen , N.,NEC4 analysis of a fractalized monofiliar helix in an axial mode,Wireless Communications and Applied Computational Electromagnetics (ACES), 1998. IEEE International Conference on,Apr. 1, 1998, p. 1051.
Cohen , N. ; Hohlfeld , R. G.,Fractal loops and the small loop approximation—Exploring fractal resonances, Communications Quarterly,Dec. 1, 1996.
Cohn , S. B.,Flush airborne radar antennas,USAF Antenna Research and Development Program, 3th , 1953. Symposium on the,Oct. 18, 1953.
Collier , C. P.,Geometry for teachers,Waveland Press, Inc.,Jan. 1, 1984.
Collier , D. ; Shnitkin , H.,The monopole as a wideband array antenna element,Antenna Applications, 1993. Symposium,Sep. 22, 1993.
Counter , V. A.,Flush, re-entrant, impedance phased, circularly polarized cavity antenna for missiles,USAF Antenna Research and Development Program, 2th , 1952. Symposium on the,Oct. 19, 1952.
Counter , V. A. ; Margerum , D. L.,Flush dielectric disc antenna for radar,USAF Antenna Research and Development Program, 2th , 1952. Symposium on the,Oct. 19, 1952.
Cristal , E. G. et al,Hairpin-line and hybrid hairpin-line / Half-wave parallel-coupled-line filers,Microwave Theory and Techniques, IEEE Transactions on,Nov. 1, 1972.
Daniel , A. E. ; Kumar , G.,Rectangular microstrip antennas with stub along the non-radiating edge for dual band operation,Antennas and Propagation Society (APS), 1995. IEEE International Symposium,Jun. 18, 1995, vol. 4, pp. 2136-2139.
Davidson , B. et al.,Mid wide band helix antenna for PDC diversity,Molded Interconnect Devices (MID), 1998,Feb. 2, 1998.
Debicki , P. S. et al.,Calculating input impedance of electrically small insulated antennas for microwave hyperthermia, Microwave Theory and Techniques, IEEE Transactions on,Feb. 1, 1993.
Deng , S. M.,A t-strip loaded rectangular microstrip patch antenna for dual-frequency operation,Antennas and Propagation Society (APS), 1999. IEEE International Symposium,Jul. 1, 1999.
Deschamps , G.,Microstrip Microwave Antenna,USAF Antenna Research and Development Program, 3th , 1953. Symposium on the,Oct. 18, 1953.
Desclos , L. et al.,An interdigitated printed antenna for PC Card Applications,Antennas and Propagation, IEEE Transactions on,Sep. 1, 1998, vol. 46, No. 9.
Dickstein , H. D.,Antenna system for a ground passive electronic reconnaissance facility,USAF Antenna Research and Development Program, 8th , 1958. Symposium on the,Oct. 20, 1958.
Du Plessis , M. ; Cloete , J. H.,Tuning stubs for microstrip patch antennas,Antennas and Propagation Society (APS), 1993. IEEE International Symposium,Jun. 28, 1993,vol. 2, pp. 964-967.
Dubost , G.,Wideband flat dipole and short-circuit microstrip patch elements and arrays. In Handbook of microstrip antennas—Chapter 7,Peter Peregrinus Ltd. James , J. R. ; Hall , P. S. (ed.),Jan. 1, 1989, vol. 1, pp. 354-359.
DuHamel , R. H.,Broadband logarithmically periodic antenna structures,Convention Record, 1957. IRE International,Mar. 14, 1957, vol. 5, pp. 119-128.
DuHamel , R. H. ; Scherer , J. P.,Antenna engineering handbook—Chapter 14—Frequency-Independent Antennas, Johnson , R. McGraw-Hill (3rd. edition),Jan. 1, 1993, pp. 14-1-14-5.
Durgun , A. C. ; Reese , M. S. ; Balanis , C. A. et al,Flexible bow-tie antennas with reduced metallization,Radio and Wireless (RWS), 2011. IEEE Symposium,Jan. 16, 2011, pp. 50-53.
Dyson , J. D.,The non-planar equiangular spiral antenna,USAF Antenna Research and Development Program, 8th , 1958. Symposium on the,Oct. 20, 1958.
Dyson , J. D.,The equiangular spiral antenna,Antennas and Propagation, IRE Transactions on,Apr. 1, 1959.
Ellis , A. R.,Airborne UHF antenna pattern improvements,USAF Antenna Research and Development Program, 3th , 1953. Symposium on the,Oct. 18, 1953.
Erátuuli , P. et al,Dual frequency wire antennas,Electronics Letters,Jun. 6, 1996.
Esteban , J. ; Rebollar , J. M.,Design and optimization of a compact Ka-Band antenna diplexer,Antennas and Propagation Society (APS), 1995. IEEE International Symposium,Jun. 18, 1995.
Falconer , K.,Fractal Geometry: Mathematical Foundations and Applications,John Wiley & Sons,Jan. 1, 1990, pp. 38-44.
Falconer , K.,Fractal geometry. Mathematical foundations and applications,John Wiley and Sons,Jan. 1, 1990, pp. 38-41.
Falconer , K.,Fractal Geometry: Mathematical Foundations and Applications,John Wiley & Sons,Jan. 1, 1990, pp. 38-45.
Falconer , K.,Fractal geometry _Full,John Wiley Sons—2nd ed.,Jan. 1, 2003.
Fang , A,A dual frequency equilateral-triangular microstrip antenna with a pair of narrow slots, Microwave and Optical Technology Letters,Oct. 20, 1999.
Feder, J.,Fractals,Plenum Press,Jan. 1, 1988, pp. 10-11, 15-17, and 25.
Feng , J.,Fractional box-counting approach to fractal dimension estimation,Pattern Recognition, 13th , 1996. International Conference on,Jan. 1, 1996.
Fenwick , R. C.,A new class of electrically small antennas,Antennas and Propagation, IEEE Transactions on,May 1, 1965.
Ferris , J. E.,A status report of an Azimuth and elevation direction finder,USAF Antenna Research and Development Program, 18th , 1968. Symposium on the,Oct. 15, 1968.
Fleishmann , M. ; Tildesley , D. J. ; Balls , R. C.,Fractals in the natural sciences,Royal Society of London,Jan. 1, 1999.
Force , R. et al.,Synthesis of multilayer walls for radomes of aerospace vehicles,USAF Antenna Research and Development Program, 17th , 1967. Symposium on the,Nov. 14, 1967.

(56) References Cited

OTHER PUBLICATIONS

Foroutan-Pour , K. ; Dutilleul , P. ; Smith , D.L.,Advances in the implementation of the box-counting method of fractal dimension estimation,Applied Mathematics and Computation,May 1, 1999, vol. 105, pp. 195-210.
Fujimoto , K. et al,Small Antennas,Research Studies Press Ltd,Jan. 1, 1987, Preface & ToC.
Gagnepain , J. J.,Fractal approach to two-dimensional and three-dimensional surface roughness,Wear,May 1, 1986, vol. 109.
Garg , R. et al,Microstrip antenna design handbook—Chapter 1—Microstrip Radiators,Artech House,Jan. 1, 2001.
Garg , R. et al.,Characteristics of coupled microstriplines,Microwave Theory and Techniques, IEEE Transactions on,Jul. 1, 1979.
Garg , R. et al.,Microstrip antenna design handbook,Artech House,Jan. 1, 2001, p. 845.
George , J. ; Aanandan , C. K. ; Mohanan , P. et al,Analysis of a new compact microstrip antenna,Antennas and Propagation, IEEE Transactions on,Nov. 1, 1998.
Gianvittorio , J. P.,Fractal element antennas—a compilation of configurations with novel characteristics,Antennas and Propagation Society (APS), 2000. IEEE International Symposium,Jul. 16, 2000.
Gilbert , R. ; Pirrung , A. ; Kopf , D. et al.,Structurally-integrated optically-reconfigurable antenna array,Antenna Applications, 1995. Symposium,Sep. 20, 1995.
Gillespie , E. S.,Glide slope antenna in the nose radome of the F-104 A and B,USAF Antenna Research and Development Program, 7th , 1957. Symposium on the,Oct. 21, 1957.
Gobien , A. T.,Investigation of low profile antenna designs for use in hand-held radios—Master of Science,Virginia Polytechnic Institute and State University,Aug. 1, 2007.
Gough , C. E. ; Porch , A. ; Lancaster , M. J. et al,High Tc coplanar resonators for microwave applications and scientific studies,Physica C,Aug. 1, 1997, vol. 282-287, No. 2001, pp. 395-398.
Graf, R,Modern dictionary of electronics,Butterworth-Heinemann (6th Ed.),Jan. 1, 1984, pp. 209, 644.
Gray , D. ; Lu , J. W. ; Thiel , D. V.,Electronically steerable Yagi-Uda microstrip patch antenna array,Antennas and Propagation, IEEE Transactions on,May 1, 1998, vol. 46.
Greiser , J. W. and Brown , G. S.,A 500:1 scale model of warla : A wide aperture radio location array,USAF Antenna Research and Development Program, 13th , 1963. Symposium on the,Oct. 14, 1963.
Guo , Y. X. ; Luk , K. F. Lee ; Chow , Y. L.,Double U-slot rectangular patch antenna,Electronics Letters,Sep. 17, 1998.
Gupta , K. C.,Broadbanding techniques for microstrip patch antennas—a review,Antenna Applications, 1988. Sysmposium,Sep. 21, 1988.
Gupta , K. C. ; Benalla , A.,Microstrip antenna design,Artech House,Jan. 1, 1988.
Hagström , P.,Novel ceramic antenna filters for GSM / DECT and GSM / PCN network terminals,Personal Indoor and Mobile Radio Communications (PIMRC), 8th , 1997. Waves of the year 2000. International Symposium on,Sep. 1, 1997.
Halloran , T. W.,A dual channel VHF telemetry antenna system for re-entry vehicle applications,USAF Antenna Research and Development Program, 11th , 1961. Symposium on the,Oct. 16, 1961.
Hansen , R. C.,Fundamental limitations in antennas,Proceedings of the IEEE,Feb. 1, 1981, vol. 69, No. 2, pp. 170-182.
Hara Prasad , R. V.,Microstrip fractal patch antenna for multiband communication,Electromagnetic Letters, IEEE,Jul. 6, 2000, vol. 36, No. 14, pp. 1179-1180.
Harrington , R. F.,Effect of antenna size on gain, bandwidth, and efficiency,Journal of Research of the National Bureau of Standards—D. Radio Propagation,Jan. 1, 1960, vol. 64D, No. 1.
Hart , N. ; Chalmers , A.,Fractal element antennas,Digital Image Computer Techniques and Applications (DICTA) , Auckland, 1997., Jun. 2, 1997.
Heberling , D. ; Geisser , M.,Trends on handset antennas,Microwave Conference (EuMC), 29th , 1999. European,Mar. 3, 1999, vol. 1.
Henderson West , B,The Prentice-Hall encyclopedia of mathematics,Prentice-Hall,Jan. 1, 1982, pp. 404-425.
Hikita , M. ; Shibagaki , N. ; Asal , K. et al,New miniature saw antenna duplexer used in GHz-band digital mobile cellular radios,Ultrasonics Symposium, IEEE,Nov. 7, 1995.
Hikita , M. et al,Miniature SAW antenna duplexer for 800-Mhz portable telephone used in cellular radio systems, Microwave Theory and Techniques, IEEE Transactions on,Jun. 1, 1988.
Hill , J. E. ; Bass , J. F.,An integrated strip-transmission-line antenna system for J-band,USAF Antenna Research and Development Program, 23th , 1973. Symposium on the,Oct. 10, 1973.
Hofer , D. A. ; Kesler , Dr. O. B. ; Loyet , L. L.,A compact multi-polarized broadband antenna,Antenna Applications, 1989. Symposium,Sep. 20, 1989.
Hoffmeister , M.,The dual-frequency-inverted-F monopole antenna for mobile communications,N/A,Jan. 6, 1999.
Hohlfeld , R. G. ; Cohen N.,Self-similarity and the geometric requirements for frequency independence in antennae, Fractals,Jan. 17, 1999, vol. 7, No. 1, pp. 79-84.
Holtum , A. G.,A dual frequency dual polarized microwave antenna,USAF Antenna Research and Development Program, 16th , 1966. Symposium on the,Oct. 11, 1966.
Holzschuh , D. L.,Hardened antennas for atlas and titan missile site communications,USAF Antenna Research and Development Program, 13th , 1963. Symposium on the,Oct. 14, 1963.
Hong , J. S. ; Lancaster , M. J.,Compact microwave elliptic function filter using novel microstrip meander open-loop resonators,Electronics Letters,Mar. 14, 1996, vol. 32, pp. 563-564.
Hong , J. S. ; Lancaster , M. J.,Recent advances in microstrip filters for communications and other applications, Advances in Passive Microwave Components, 1997. IEE Colloquium on,May 22, 1997.
Huang , C. ; Wu , J. Y. ; Wong , K. L.,Cross slot coupled microstrip antenna and dielectric resonator antenna for circular polarization,Antennas and Propagation, IEEE Transactions on,Apr. 1, 1999.
Huang , Q. ; Lorch , J. R. ; Dubes , R.,Can the fractal dimension of images be measured?,Pattern Recognition,Feb. 1, 1994, vol. 27.
Huynh , T. ; Lee , K. F.,Single-layer single-patch wideband microstrip antenna,Electronics Letters,Aug. 3, 1995, vol. 31.
Hyneman , R. F. ; Mayes , P. E. ; Becker , R. C.,Homing antennas for aircraft ( 450-2500 MC ),USAF Antenna Research and Development Program, 5th , 1955. Symposium on the,Oct. 16, 1955.
Ikata , O. ; Satoh , Y. ; Uchishiba , H. et al,Development of small antenna duplexer using saw filters for handheld phones,Ultrasonics Symposium, IEEE,Oct. 31, 1993.
Ingerson , P. G. ; Mayes , P. E.,Asymmetrical feeders for log-periodic antennas,USAF Antenna Research and Development Program, 17th , 1967. Symposium on the,Nov. 14, 1967.
Isbell , D. E.,Non-planar logarithmically periodic antenna structures,USAF Antenna Research and Development Program, 7th , 1957. Symposium on the,Oct. 21, 1957.
Isbell , D. E.,Multiple terminal log-periodic antennas,USAF Antenna Research and Development Program, 8th , 1958. Symposium on the,Oct. 20, 1958.
Ishikawa , Y. ; Hattori , J. ; Andoh , M. et al.,800 MHz High Power Bandpass Filter Using TM Dual Mode Dielectric Resonators,Microwave Conference (EuMC), 21st , 1991. European,Oct. 9, 1991, vol. 2.
Iwasaki , H.,A circularly polarized small size microstrip antenna with a cross slot,Antennas and Propagation, IEEE Transactions on,Oct. 1, 1996.
Jaggard , D. L.,Diffraction by Bandlimited Fractal Screens,Journal of the Optical Society of America,Jun. 1, 1987, vol. 4, No. 6.
Jaggard , D. L,Fractal electrodynamics and modeling,Directions in electromagnetic wave modeling,Jan. 1, 1991, pp. 435-446.
Johnson , R. C.,Antenna engineering handbook—ToC,McGraw-Hill,Jan. 1, 1993.
Jones , H. S.,Conformal and Small antenna designs,Proceedings of the Antennas Applications Symposium,Aug. 1, 1981.
Katsibas , K. D. ; Balanis , C. A. ; Panayiotis , A. T. ; Birtcher , C. R.,Folded loop antenna for mobile hand-held units, and Propagation, IEEE Transactions on,Feb. 1, 1998,vol. 46,No. 2.
Kobayashi K. Estimation of 3D fractal dimension of real electrical tree patterns,Properties and Applications of Dielectric Materials, 4th , 1994. International Conference on,Jul. 1, 1994.

(56) References Cited

OTHER PUBLICATIONS

Kokotoff , D. M. ; Aberle , J. T. ; Waterhouse , R. B.,Rigorous analysis of probe fed printed annular ring antennas, Antennas and Propagation, IEEE Transactions on,Feb. 1, 1999.
Kraus , J. D.,Antennas,McGraw-Hill Book Company,Jan. 1, 1988,ToC.
Kraus , J. D.,Antennas—Chapter 8,McGraw-Hi11,Jan. 1, 1988,Chapter 8, pp. 340-359.
Kritikos , H.N. ; Jaggard , D. L.,Recent advances in electromagnetic theory—Chapter 6 on fractal electrodynamics, Springer,Oct. 1, 1990, Chapter 6.
Kuhlman , E. A.,A directional flush mounted UHF communications antenna for high performance jet aircraft for the 225-400 MC frequency range,USAF Antenna Research and Development Program, 5th , 1955. Symposium on the,Oct. 1, 1955.
Kumar , G. ; Gupta , K.,Nonradiating edges and four edges gap-coupled multiple resonator broadband microstrip antennas,Antennas and Propagation, IEEE Transactions on,Feb. 1, 1985.
Kumar , G. ; Gupta , K.,Directly coupled multiple resonator wide-band microstrip antennas,Antennas and Propagation, IEEE Transactions on,Jun. 6, 1985,AP-33.
Kuo , S.,Frequency-independent log-periodic antenna arrays with increased directivity and gain,USAF Antenna Research and Development Program, 21th , 1971. Symposium on the,Oct. 12, 1971.
Kurpis , G. P.,The New IEEE standard dictionary of electrical and electronics terms,IEEE Standards,Jan. 1, 1993, pp. 90, 352, 393.
Kutter , R. E.,Fractal antenna design,University of Dayton,Jan. 1, 1996.
Kyriacos , S. ; Buczkowski , S. et al.,A modified box-counting method,Fractals,Jan. 1, 1994, vol. 2, No. 2, pp. 321-324.
Lam , K. W. ; Yung , E. K. N.,A novel leaky wave antenna for the base station in an innovative indoors cellular mobile communication system,Antennas and Propagation Society (APS), 1999. IEEE International Symposium,Jul. 11, 1999.
Lancaster , M. J. et al,Superconducting filters using slow-wave transmission lines,Advances in Superconductivity, 8th , New Delhi, 1996. International Symposium on,Jan. 1, 1996.
Lancaster , M. J. et al.,Miniature superconducting filters,Microwave Theory and Techniques, IEEE Transactions on,Jul. 1, 1996.
Larson , J.,A BAW Antenna Duplexer for the 1900 MHz PCS Band,Ultrasonics Symposium, IEEE,Oct. 17, 1999.
Lauwerier , H.,Fractals. Endlessly repeated geometrical figures,Princeton University Press,Jan. 1, 1991,Chapters 1, 3 and 5.
Lee , C. S.,Planar circularly polarized microstrip antenna with a single feed,Antennas and Propagation, IEEE Transactions on,Jun. 1, 1999.
Lee , C. S. ; Chen , P. W.,Electrically small microstrip antennas,Antennas and Propagation Society (APS), 2000. IEEE International Symposium,Jul. 7, 2000.
Lee , J. C.,Analysis of differential line length diplexers and long-stub filters,USAF Antenna Research and Development Program, 21th , 1971. Symposium on the,Oct. 12, 1971.
Leisten , O. et al.,Miniature dielectric-loaded personal telephone antennas with low user exposure,Electronics Letters,Aug. 20, 1998, vol. 34, No. 17.
Liu , D.,A multi-branch monopole antenna for dual-band cellular applications,Antennas and Propagation Society (APS), 1999. IEEE International Symposium,Sep. 3, 1999, vol. 3.
Liu , Z. D. ; Hall , P. S. ; Wake , D.,Dual-frequency planar inverted-f antenna,Antennas and Propagation, IEEE Transactions on,Oct. 1, 1997.
Lo , T. K. ; Hwang , Y.,Bandwidth enhancement of PIFA loaded with a very high permittivity material using FDTD, Antennas and Propagation Society (APS), 1998. IEEE International Symposium,Jun. 21, 1998.
Lo , Y. T. ; Solomon , D. ; Richards , W. F.,Theory and experiment on microstrip antennas,Antenna Applications, 1978. Symposium,Sep. 20, 1978.
Locus , S. S.,Antenna design for high performance missile environment,USAF Antenna Research and Development Program, 5th , 1955. Symposium on the,Oct. 16, 1955.
Lu , J. H.,Slot-coupled small triangular microstrip antenna,Microwave and Optical Technology Letters,Dec. 20, 1997.
Lu , J. H. ; Tang , C. L. ; Wong , K. L.,Single-feed slotted equilateral triangular microstrip antenna for circular polarization,Antennas and Propagation, IEEE Transactions on,Jul. 1, 1999.
Lu , J. H. ; Tang , C. L. ; Wong , K. L.,Novel dual-frequency and broad-band designs of slot-loaded equilateral triangular microstrip antennas,Antennas and Propagation, IEEE Transactions on,Jul. 1, 2000, vol. 48.
Lu , J. H. ; Wong , K. L.,Single-feed dual-frequency equilateral-triangular microstrip antenna with pair of spur lines, Electronics Letters,Jun. 11, 1998, vol. 34.
Lu , J. H. ; Wong , K. L.,Dual-frequency rectangular microstrip antenna with embedded spur lines and integrated reactive loading,Microwave and Optical Technology Letters,May 20, 1999, vol. 21.
Lu , J. H. ; Yang , K. P,Slot coupled compact triangular microstrip antenna with lumped load,Antennas and Propagation Society (APS), 1998. IEEE International Symposium,Jun. 21, 1998.
Lu , J. H. et al.,Slot-loaded, Meandered Rectangular Microstrip Antenna With Compact Dualfrequency Operation, Electronics Letters,May 28, 1998, vol. 34, No. 11.
Lyon , J. ; Rassweiler , G. ; Chen , C.,Ferrite-loading effects on helical and spiral antennas,USAF Antenna Research and Development Program, 15th , 1965. Symposium on the,Oct. 12, 1965.
Maci , S. et al.,Dual-band Slot-loaded patch antenna,Microwaves, Antennas and Propagation, IEE Proceedings H,Jun. 1, 1995, vol. 142, pp. 225-232.
Maci , S. et al.,Dual-frequency patch antennas,Antennas and Propagation Magazine, IEEE,Dec. 1, 1997.
Mandelbrot , B. B.,Opinions (Benoit B. Mandelbrot),World Scientific Publishing Company,Jan. 1, 1993.
Mandelbrot, B. B.,The fractal geometry of nature,Freeman and Company,Jan. 1, 1982, pp. 32-35.
Martin , R. W. ; Stangel , J. J.,An unfurlable, high-gain log-periodic antenna for space use,USAF Antenna Research and Development Program, 17th , 1967. Symposium on the,Nov. 14, 1967.
Martin, W. R.,Flush vor antenna for c-121 aircraft,USAF Antenna Research and Development Program, 2th , 1952. Symposium on the,Oct. 19, 1952.
Matsushima et al,Electromagnetically coupled dielectric chip antenna,Antennas and Propagation, IEEE Transactions on,Jun. 1, 1998.
Matthaei , G. L.,Microwave filters impedance-matching networks and coupling structures,Artech House,Jan. 1, 1980, p. 1096.
Matthaei , G. L. et al.,Hairpin-comb filters for HTS and other narrow-band applications,Microwave Theory and Techniques, IEEE Transactions on,Aug. 1, 1997, vol. 45, No. 3.
May , M.,Aerial magic,New Scientist,Jan. 31, 1998.
Mayes , P.,Some broadband , low-profile antennas,Antenna Applications, 1985. Symposium,Sep. 18, 1985.
Mayes , P. E.,High gain log-periodic antennas,USAF Antenna Research and Development Program, 10th , 1960. Symposium on the,Oct. 3, 1960.
Mayes , P. E.,Multi-arm logarithmic spiral antennas,USAF Antenna Research and Development Program, 10th , 1960. Symposium on the,Oct. 3, 1960.
McCormick , J.,A Low-profile electrically small VHF antenna,USAF Antenna Research and Development Program, 15th , 1965. Symposium on the,Oct. 12, 1965.
McDowell , E. P.,High speed aircraft antenna problems and some specific solutions for MX-1554,USAF Antenna Research and Development Program, 2th , 1952. Symposium on the,Oct. 19, 1952.
McDowell , E. P.,Flush mounted X-band beacon antennas for aircraft,USAF Antenna Research and Development Program, 3th , 1953. Symposium on the,Oct. 18, 1953.
McLean , J. S.,A re-examination of the fundamental limits on the radiation q of electrically small antennas,Antennas and Propagation, IEEE Transactions on,May 1, 1996.
McSpadden , J. O.,Design and experiments of a high-conversion-efficiency 5.8-GHz rectenna,Microwave Theory and Techniques, IEEE Transactions on,Dec. 1, 1998, vol. 46.

(56) References Cited

OTHER PUBLICATIONS

Nokia 8860—External photos—OET Exhibits list for FCC ID: LJPNSW-6NX,Federal Communications Commission (FCC),Jul. 8, 1999.
FFC—United States table of frequency allocations,Federal Communications Commission (FCC),Oct. 1, 1999, pp. 377-538.
American Heritage Dictionary of the English Language,Houghton Mifflin Company,Jan. 1, 2000, pp. 1306-1361.
European Patent Convention—Article 123—Declaration of Jeffery D. Baxter—Exhibit JJJ,European Patent Office,Jan. 1, 2000, pp. 132-133.
Nokia 8260,Nokia,Sep. 8, 2000.
RIM 857 pager,RIM,Oct. 1, 2000.
RIM 957 page maker,RIM,Nov. 15, 2000.
Nokia 3360,Nokia,May 3, 2001.
Rockwell B-1B Lancer,<http://home.att.net/~jbaugher2/newb1_2.html>,Oct. 12, 2001.
Nokia 8265,Nokia,Mar. 4, 2002.
Software—Box counting dimension [electronic],Sewanee—http://www.sewanee.edu/Physics/PHYSICS123/Box%20COUNTING%20DIMENSION.html,Apr. 1, 2002.
IE3D User's Manual,Mentor Graphics,Jan. 1, 2010, v.15.0.
Applications of IE3D in designing planar and 3D antennas—Release 15.0,Mentor Graphics,Jan. 1, 2010.
Fractus web—www.fractus.com/main/fractus/corporate/,Fractus SA,Oct. 7, 2010.
Fractal Antenna—Frequently asked questions,Fractal Antenna Systems,Jan. 1, 2011.
Nadan , T. ; T Coupez , J. P,Integration of an antenna filter device, using a multi-layer, multi-technology process, Microwave Conference (EuMC), 28th , 1988. European,Oct. 1, 1988, vol. 1.
Nagai , K. ; Mikuni , Y. ; Iwasaki , H.,A mobile radio antenna system having a self-diplexing function,Vehicular Technology (VTC), 29th , 1979. IEEE Conference,Nov. 1, 1979, vol. 28.
Nagy , L. L,Antenna engineering handbook—Chapter 39—Automobile antennas,Volakis , J.—McGraw-Hill; 4th edition,Jan. 1, 2007.
Naik , A. ; Bathnagar , P. S.,Experimental study on stacked ring coupled triangular microstrip antenna,Antenna Applications, 1994. Symposium,Sep. 21, 1994.
Nakano , H. ; Vichien , K.,Dual-frequency square patch antenna with rectangular notch,Electronics Letters,Aug. 3, 1989, vol. 25.
Navarro , M.,Original and translation in English of Final Degree Project—Diverse modifications applied to the Sierpinski antenna, a multi-band fractal antenna,Universitat Politecnica de Catalunya (UPC),Oct. 1, 1997.
Neary , D.,Fractal methods in image analysis and coding,Dublin City University—www.redbrick.dcu.ie/*bolsh/thesis/node16.html and *node22.html,Jan. 22, 2001.
Nelson , T. R. ; Jaggard , D. L.,Fractals in the Imaging Sciences,Journal of the Optical Society of America,Jan. 1, 1999.
Ng , V.,Diagnosis of melanoma with fractal dimesions,TENCON, 1993. IEEE Conference,Jan. 1, 1993.
Nishikawa , T., Ishikawa , Y., Hattori , J. and Wakino , K.,Dielectric receiving filter with Sharp stopband using an active feedback resonator method for cellular base stations,Microwave Theory and Techniques, IEEE Transactions on,Dec. 1, 1989, vol. 37.
Offutt , W. ; DeSize , L. K.,Antenna Egineering Handbook—Chapter 23—Methods of Polarization Synthesis,Johnson R. C.—McGraw Hill,Jan. 1, 1993,3rd Ed.
Ohmine , H. et al.,A TM mode annular-ring microstrip antenna for personal satellite communication use,IEICE Society, 1996. Conference of,Sep. 1, 1996, vol. E79, No. 9.
Omar, A. A. ; Antar , Y. M. M.,A new broad band dual frequency coplanar waveguide fed slot antenna,Antennas and Propagation Society (APS), 1999. IEEE International Symposium,Jul. 11, 1999.
Ou , J. D.,An analysis of annular, annular sector, and circular sector microstrip antennas,Antenna Applications, 1981. Symposium,Sep. 23, 1981.
Palit , S. K. ; Hamadi , A. ; Tan , D.,Design of a wideband dual-frequency notched microstrip antenna,Antennas and Propagation Society (APS), 1998. IEEE International Symposium,Jun. 1, 1998.
Pan, S. et al.,Single-feed dual-frequency microstrip antenna with two patches,Antennas and Propagation Society (APS), 1999. IEEE International Symposium,Aug. 1, 1999.
Parker , E. A. ; El Sheikh , A. N. A.,Convoluted array elements and reduced size unit cells for frequency selective surfaces,Microwaves, Antennas and Propagation, IEE Proceedings H,Feb. 1, 1991, pp. 19-22.
Parker , S.,McGraw-Hill Dictionary of Scientific and Technical Terms (5th ed. 1994),McGraw-Hill ,Jan. 1, 1994, p. 1542.
Parker, E. A. ; El Sheikh , A. N. A.,Convoluted dipole array elements,Electronics Letters,Feb. 14, 1991.
Paschen , D. A.,Structural stopband elimination with the monopole-slot antenna,Antenna Applications, 1982. Symposium,Sep. 22, 1982.
Paschen , D. A.,Broadband microstrip matching techniques,Antenna Applications, 1983. Symposium,Sep. 21, 1983.
Paschen , D. A. ; Olson , S.,A crossed-slot antenna with an infinite balun feed,Antenna Applications, 1995. Symposium,Sep. 20, 1995.
Peitgen , H.,Chaos and fractals : New frontiers of science,Springer,Jan. 1, 1992, pp. 231-233 and 386-391.
Peitgen , H. ; Saupe , D.,The science of fractal images,Springer,Jan. 1, 1988, pp. 60-63.
Peitgen , H. O. ; Jürgens , H. ; Saupe , D.,Chaos and fractals. New frontiers of science,Springer,Feb. 12, 1993, pp. 212-216 ; 387-388.
Peitgen , H. O. ; Saupe , H.,The science of fractal images,Springer,Jan. 1, 1988, pp. 1-3, 24-27, 58-61.
Peitgen , H. O. et al,Chaos and fractals : new frontiers of science,Springer,Jan. 1, 1992, pp. 22-26, 62-66, 94-105, 212-219, 229-243.
Peitgen , H. O. et al,Chaos and fractals,Springer,Jan. 1, 1992, pp. 23-28, 94-95, 202-206, 225, 231-243, 283-292, 392-396, 441, 225, 372-373, 386-389, 390-391.
Peitgen , H. O. et al,Chaos and fractals,Springer,Jan. 1, 1992, pp. 880-895.
Penn , A.,Fractal dimension of low-resolution medical images,Engineering in Medicine and Biology Society (EMBS), 18th , 1996. IEEE Annual International Conference of the,Jan. 1, 1996.
Phelan , R.,A wide-band parallel-connected balun,Microwave Theory and Techniques, IEEE Transactions on,May 1, 1970.
Poilasne , G.,Active metallic photonic band-gap materials (MPBG): experimental resultors on beam shaper,Antennas and Propagation, IEEE Transactions on,Jan. 1, 2000, vol. 48, No. 1.
Pozar , D. M.,Comparison of three methods for the measurement of printed antenna efficiency,Antennas and Propagation, IEEE Transactions on,Jan. 1, 1988.
Pozar , D. M.,Microwave Engineering—Chapter 12: Introduction to Microwave Systems,Addison-Wesley,Jan. 1, 1990, pp. 663-666 , 675-676.
Pozar , D. M.,Microstrip antennas,Proceedings of the IEEE,Jan. 1, 1992.
Mehaute, A.,Fractal Geometrics,CRC Press ,Jan. 1, 1990, pp. 3-35.
Meier , K. ; Burkhard , M. ; Schmid , T. et al,Broadband calibration of E-field probes in Lossy Media,Microwave Theory and Techniques, IEEE Transactions on,Oct. 1, 1996, vol. 44, No. 10.
Meinke , H. ; Gundlah , F. V.,Radio engineering reference book—vol. 1—Radio components. Circuits with lumped parameters . . . ,State energy publishing house,Jan. 1, 1961.
Misra , S.,Experimental investigations on the impedance and radiation properties of a three-element concentric microstrip square-ring antenna,Microwave and Optical Technology Letters,Feb. 5, 1996,vol. 11,No. 2.
Misra , S. ; Chowdhury , S. K.,Study of impedance and radiation properties of a concentric microstrip triangular-ring antenna and Its modeling techniques using FDTD method,Antennas and Propagation, IEEE Transactions on,Apr. 1, 1998,vol. 46,No. 4.
Model , A. M.,Microwave filters in radiorelay systems,Svyaz, Moscow,Jan. 1, 1967.
Moheb , H.,Design and development of co-polarized ku-band ground terminal system for very small aperture terminal (VSAT)

(56) References Cited

OTHER PUBLICATIONS application,Antennas and Propagation Society (APS), 1999. IEEE International Symposium,Jul. 11, 1999.
Munson , R.,Microstrip phased array antennas,USAF Antenna Research and Development Program, 22th , 1972. Symposium on the,Oct. 11, 1972.
Munson , R.,Conformal microstrip array for a parabolic dish,USAF Antenna Research and Development Program, 23th , 1973. Symposium on the,Oct. 1, 1973.
Munson , R.,Antenna engineering Handbook—Chapter 7—Microstrip Antennas,Johnson , R. C.—McGraw-Hill—Third Edition,Jan. 1, 1993.
Munson , R. E.,Conformal microstrip communication antenna,USAF Antenna Research and Development Program, 23th , 1973. Symposium on the,Oct. 10, 1973.
Muramoto , M. et al,Characteristics of a small planar loop antenna,Antennas and Propagation, IEEE Transactions on,Dec. 1, 1997.
Mushiake, Y.,Self-Complementary Antennas : Principle of Self Complementarity for Constant Impedance, Springer,Jan. 1, 1996, pp. 81-86.
Musser , G.,Practical fractals,Scientific American Magazine,Jul. 1, 1999, vol. 281, No. 1.
FractalComs web—www.tsc.upc.es/fractalcoms/,Universitat Politecnica de Catalunya (UPC).
Collins Dictionary,Collins,Jan. 1, 1979, p. 608.
Webster's New Collegiate Dictionary,G & C Merriam Co.,Jan. 1, 1981, pp. 60, 237, 746.
The American Heritage Dictionary,New College ed. (2nd ed. ),Jan. 1, 1982, pp. 311, 1208.
The American Heritage Dictionary,Morris—William—(Second College edition) ,Jan. 1, 1982, pp. 817 , 961.
IEEE Standard definitions of terms for antennas, IEEE Std. 145-1983,The Institute of Electrical and Electronic Engineers (IEEE),Jun. 22, 1983.
The Random House Dictionary,Random House,Jan. 1, 1984, pp. 1029, 1034.
The handbook of antenna design—Index,Rudge, A. W. et al.—Peter Peregrinus—Institution of Electrical Engineers,Jan. 1, 1986, vols. 1-2.
Merriam-Webster's Collegiate Dictionary (1993)—Declaration of J. Baxter—Exhibit CC,Merriam-Webster's ,Jan. 1, 1993, p. 863.
The American Century Dictionary,Oxford University Press,Jan. 1, 1995, pp. 376, 448.
Motorola Bravo Plus pager,Motorola,Mar. 3, 1995.
IEEE Standard Dictionary of Electrical and Electronics Terms,IEEE Press (6th ed.),Jan. 1, 1996, pp. 359, 688, and 878.
IEEE Standard dictionary of electrical and electronics terms,IEEE Standard (6th ed.),Jan. 1, 1996, pp. 229, 431, 595, 857.
Hagenuk mobile phone—Antenna photo—Technical specs—User manual,Hagenuk Telecom GmbH,Jan. 1, 1996.
United States Table of Frequency allocations—The Radio Spectrum,United States Department of Commerce,Mar. 1, 1996.
Digital cellular telecommunications system (Phase2) : Abbreviations and acronyms (GSM01.04) GSM Technical Specification vs. 5.0.0,European Telecommunications Standard Institute (ETSI),Mar. 1, 1996.
GSM Technical specification and related materials,European Telecommunications Standard Institute (ETSI),Mar. 1, 1996.
Digital cellular telecommunications system (Phase2). Mobile Station MS Conformance specifiaction Part 1 Conformance Specification GSM11.10-1),European Telecommunications Standard Institute (ETSI),Mar. 1, 1996.
Digital cellular telecommunications system (Phase 2) : Types of Mobile Stations (MX) (GSM 02.06),European Telecommunications Standard Institute (ETSI),May 9, 1996.
Digital cellular telecommunications system (Phase 2+) ; Radio transmission and reception (GSM 05.05),European Telecommunications Standard Institute (ETSI),Jul. 1, 1996.
Motorola Advisor Gold FLX pager,Motorola,Aug. 1, 1996.
American Heritage College Dictionary (1997). pp. 340 and 1016,Mifflin Comp., Jan. 1, 1997, pp. 340 , 1016.
The American Heritage College Dictionary,Houghton Mifflin Comp.—3d ed.—,Jan. 1, 1997, pp. 684 and 1060.
Motorola Advisor Elite mobile phone—Antenna photos—User manual,Motorola,Jan. 1, 1997.
Motorola 2000x pager,Motorola,Jun. 13, 1997.
Motorola P935,Motorola,Aug. 13, 1997.
Nokia 8810,Nokia,Jan. 1, 1998.
Int'l Electro-Technical Commission IEV No. 712-01-04—Electropedia : the world's online electrotechnical vocabulary, Electropedia—http://www.electropedia.org,Apr. 1, 1998.
RIM 950 product—Photos of,RIM,Jun. 30, 1998.
Digital cellular telecommunications system (Phase2); Mobile Station (MS) conformance specification; Part 1: Conformance specification (GSM 11.10-1 version 4.21.1),European Telecommunications Standard Institute (ETSI),Aug. 1, 1998.
Nokia 8850,Nokia,Jan. 1, 1999.
Nokia 8210,Nokia,Jan. 1, 1999.
Nokia 3210,Nokia,Jan. 1, 1999.
Nokia 8260—FCC ID GMLNSW-4DX,Nokia,Apr. 1, 1999.
Letter to FCC—Application form 731 and Engineering Test Report by Nokia Mobile Phones for FCC ID: LJPNSW-6NX, M. Flom Associates (MFA),Apr. 1, 1999.
Nokia 8860—Internal photos—FCC ID: LJPNSW-6NX,Nokia and Federal Communications Commission ( FCC ),Jun. 24, 1999.
Pozar , D. M. ; Newman , E. H.,Analysis of a Monopole Mounted near or at the Edge of a Half-Plane,Antennas and Propagation, IEEE Transactions on,May 1, 1981,AP-29, No. 3.
Pozar , D. M. ; Schaubert , D. H.,Microstrip antennas. The analysis and design of microstrip antennas and arrays,IEEE Press; Pozar, Schaubert,Jan. 1, 1995, p. 431.
Pressley, A,Elementary Differential Geometry,Springer,Jan. 1, 2000, pp. 252-257.
Pribetich , P. ; Combet , Y. et al,Quasifractal planar microstrip resonators for microwave circuits,Microwave and Optical Technology Letters,Jun. 20, 1999, vol. 21, No. 6, pp. 433-436.
Prokhorov , A. M.,Bolshaya Sovetskaya Entsiklopediya,Sovetskaya Entsiklopediya,Jan. 1, 1976, vol. 24,Book 1, p. 67.
Puente , C,Fractal antennas,Universitat Politecnica de Catalunya (UPC),May 1, 1997, pp. ix-xiv, 234-237.
Puente , C.,Fractal antennas,Universitat Politecnica de Catalunya (UPC),May 1, 1997.
Puente , C. ; Claret , J. ; Sagues , F. et al,Multiband properties of a fractal tree antenna generated by electrochemical deposition,Electronics Letters,Dec. 5, 1996, vol. 32, No. 25, pp. 2298-2299.
Puente , C. ; Pous , R.,Diseño fractal de agrupaciones de antenas—Fractal design of antenna arrays,Unión Cientffica Internacional de la Radio (URSI), 9th , La Palma, 1994. Simposium Nacional de la,Sep. 1, 1994.
Puente , C. ; Pous , R.,Fractal design of multiband and low side-lobe arrays,Antennas and Propagation, IEEE Transactions on,May 1, 1996, vol. 44, No. 5.
Puente , C. ; Romeu , J. ; Bartolome , R. ; Pous , R.,Perturbation of the Sierpinski antenna to allocate operating bands, Electronics Letters,Nov. 21, 1996, vol. 32, No. 24.
Puente , C. ; Romeu , J. ; Cardama , A.,La antena de Koch—un monopolo largo pero pequeño,Unión Cientifica Internacional de la Radio (URSI), 12th , Bilbao, 1997. Simposium Nacional de la,Sep. 1, 1998.
Puente , C. ; Romeu , J. ; Cardama , A.,Fractal-shaped antennas,Frontiers in electromagnetics—IEEE Press,Jan. 1, 2000,Chapter 2, pp. 48-50.
Puente , C. ; Romeu , J. ; Cardama , A. ; Pous , R.,Multiband fractal antennas and arrays,Fractals engineering—from theory to industrial applications,Jan. 1, 1997.
Puente , C. ; Romeu , J. ; Cardama , A. ; Pous , R.,On the behavior of the Sierpinski multiband fractal antenna, Antennas and Propagation, IEEE Transactions on,Apr. 1, 1998, vol. 46, No. 4.
Puente , C. ; Romeu , J. ; Cardama, A.,The Koch monopole—a small fractal antenna,Antennas and Propagation, IEEE Transactions on,Nov. 1, 2000, vol. 48, No. 11.

(56) References Cited

OTHER PUBLICATIONS

Puente , C. et al,Small but long Koch fractal monopole,Electronics Letters,Jan. 8, 1998, vol. 34, No. 1, pp. 9-10.
Qiu , J. et al.,A planar monopole antenna design with band-notched characteristic,Antennas and Propagation, IEEE Transactions on,Jan. 1, 2006, vol. 54, No. 1, pp. 288-292.
Rademacher , H. ; Toeplitz , O.,The Enjoyment of Math,Princeton Science Library,Jan. 1, 1957, pp. 164-169.
Rensh , Y. A.,Broadband microstrip antenna,Antenna Theory and Techniques, 1998. International Conference on,Sep. 22, 1998, vol. 28, pp. 420-423.
Rich , B.,Review of Elementary Mathematics 2d ed.1997,McGraw—Hill—Jan. 1, 1997, pp. 245-247.
Romeu , J. ; Blanch , S.,A three dimensional hilbert antenna,Antennas and Propagation Society (APS), 2002. IEEE International Symposium,Jun. 16, 2002.
Romeu , J. ; Puente , C. ; Cardama , J.,Small fractal antennas,Fractals in Engineering, 1999. India Conference,Jun. 1, 1999, pp. 35-36.
Rosa , J. ; Case E. W.,A wide angle circularly polarized omnidirectional array antenna,USAF Antenna Research and Development Program, 18th , 1968. Symposium on the,Oct. 15, 1968.
Rotman , W.,Problems encountered in the design of flush-mounted antennas for high speed aircraft,USAF Antenna Research and Development Program, 2th , 1952. Symposium on the,Oct. 19, 1952, vol. 46.
Rouvier , R. et al.,Fractal analysis of bidimensional profiles and application to electromagnetic scattering from soils, IEEE,Jan. 1, 1996.
Rowell , C. R. ; Murch , R. D.,A compact PIFA suitable for dual-frequency 900-1800-MHz operation,Antennas and Propagation, IEEE Transactions on,Apr. 1, 1998.
Rowell , C. R. ; Murch , R.D.,A capacitively loaded PIFA for compact mobile telephone handsets,Antennas and Propagation, IEEE Transactions on,May 1, 1997.
Rumsey , V.,Frequency independent antennas—Full,Academic Press,Jan. 1, 1966.
Rumsey , V.,Frequency independent antennas,Academic Press,Jan. 1, 1996, pp. 2-3.
Russell , D. A. et al.,Dimension of strange attractors,Physical Review,Oct. 6, 1980, vol. 45, No. 14.
Samavati , H. ; Hajimiri , A. et al,Fractal capacitors,Solid State Circuits, IEEE Journal of,Dec. 1, 1998, vol. 33, No. 12, pp. 2035-2041.
Sanad , M.,A compact dual broadband microstrip antenna having both stacked and planar parasitic elements,Antennas and Propagation Society (APS), 1996. IEEE International Symposium,Jul. 21, 1996, pp. 6-9.
Sanchez Hernandez , D. et al,Analysis and design of a dual-band circularly polarized microstrip patch antenna, Antennas and Propagation, IEEE Transactions on,Feb. 1, 1995.
Sandlin , B. ; Terzouli , A. J.,A genetic antenna desig for improved radiation over earth,Antenna Applications, 1997. Symposium,Sep. 17, 1997.
Sarkar , N.,An efficient differential box-counting approach to compute fractal dimension of image,Systems, Man and Cybernetics, 1994. IEEE International Conference on,Jan. 3, 1994, vol. 24, No. 1.
Saunders , S. R.,Antennas and Propagation for Wireless Communication Systems—Chapter 4,John Wiley & Sons,Jan. 1, 1999.
Sawaya , K. ; Ishizone , T. ; Mushiake , Y.,A simplified Expression of Dyadic Green's Function for a Conduction Half Sheet vol. AP-29, No. 5 (Sep. 1981),Antennas and Propagation, IEEE Transactions on,Sep. 1, 1981.
Scharfman , W.,Telemetry antennas for high altitude missiles,USAF Antenna Research and Development Program, 8th , 1958. Symposium on the,Oct. 20, 1958.
Schaubert , D. H. ; Chang , W. C. ; Wunsch , G. J.,Measurement of phased array performance at arbitrary scan angles,Antenna Applications, 1994. Symposium,Sep. 21, 1994.
Sclater , N. ; Markus , J.,McGraw-Hill Electronics Dictionary,McGraw Hill,Jan. 1, 1997, pp. 21, 35, 183, 263, 298, 300.
Seavey , J.,C-band paste-on and floating ring reflector antennas, USAF Antenna Research and Development Program, 23th , 1973. Symposium on the,Oct. 10, 1973.
Shenoy , A. et al.,Notebook satcom terminal technology development,Digital Satellite Communications, 10th , 1995. International Conference on,May 15, 1995.
Shibagaki , N.,Saw antenna duplexer module using saw-resonator-coupled filter for PCN system,Ultrasonics Symposium, IEEE,Oct. 5, 1998, vol. 1.
Shibagaki , N. ; Sakiyama , K. ; Hikita , M.,Miniature saw antenna duplexer module for 1.9GHz PCN systems using saw-resonator-coupled filters,Ultrasonics Symposium, IEEE,Oct. 5, 1998, vol. 1.
Shimoda , R. Y.,A variable impedance ratio printed circuit balun,Antenna Applications, 1979. Symposium,Sep. 26, 1979.
Shnitkin , H.,Analysis of log-periodic folded dipole array,Antenna Applications, 1992. Symposium,Sep. 10, 1992.
Simpson , T. L. et al,Equivalent circuits for electrically small antennas using LS-decomposition with the method of moments,Antennas and Propagation, IEEE Transactions on,Dec. 1, 1989.
Sinclair, G.,Theory of models of electromagnetic systems,Proceedings of the IRE,Nov. 1, 1948.
Smith , G. S.,Efficiency of electrically small antennas combined with matching networks,Antennas and Propagation, IEEE Transactions on,May 1, 1977.
Snow , W. L.,UHF crossed-slot antenna and applications,USAF Antenna Research and Development Program, 13th , 1963. Symposium on the,Sep. 1, 1963.
Snow , W. L.,Ku-band planar spiral antenna,USAF Antenna Research and Development Program, 19th , 1969. Symposium on the,Oct. 14, 1969.
So , P. et al,Box-counting dimension without boxes—Computing D0 from average expansion rates,Physical Review,Jul. 1, 1999,vol. 60, No. 1.
Song , C. T. P. et al,Multi-circular loop monopole antenna,Electronics Letters,Mar. 2, 2000.
Song, C. T. P.,Fractal stacked monopole with very wide bandwidth,Electronics Letters,Jun. 1, 1999, vol. 35, pp. 945-946.
Stang , P. F.,Balanced flush mounted log-periodic antenna for aerospace vehicles—in Abstracts of the Twelfth Annual Symposium USAF antenna research,USAF Antenna Research and Development Program, 12th , 1962. Symposium on the,Oct. 16, 1962, vol. 1.
Strugatsky , A. et al,Multimode multiband antenna,Tactical Communications: Technology in Transition, 1992. Conference of,Apr. 28, 1992.
Stutzman , W. L. ; Thiele , G.,Antenna theory and design,John Wiley and Sons,Jan. 1, 1981, pp. 18, 36.
Stutzman , W. L. ; Thiele , G. A.,Antenna theory and design,John Wiley and Sons,Jan. 1, 1998, pp. 8-9 , 43-48 , 210-219.
Stutzman , W. L. ; Thiele , G. A.,Antenna theory and design—Chapter 5—Resonant Antennas: Wires and Patches, Wiley,Jan. 1, 1998,Chapter 5, p. 210.
Taga , T.,Performance analysis of a built-in planar inverted F antenna for 800 MHz band portable radio units,Journal on Selected Areas in Communications , IEEE,Jan. 1, 1987,vol. 5, No. 5.
Tai , C. T ; Long , S.,Antenna engineering handbook—Chapter 4—Dipoles and Monopoles,Johnson , R. Mc Graw Hill—(3rd Ed.),Jan. 1, 1993, pp. 4-26-4-33.
Tang , C. et al,Small circular microstrip antenna with dual-frequency operation,Electronics Letters,Jun. 19, 1997.
Tang , Y.,The application of fractal analysis to feature extraction,IEEE,Jan. 1, 1999.
Tanner , R. L. ; O'Reilly , G. A.,Electronic counter measure antennas for a modern electronic reconnaissance aircraft, USAF Antenna Research and Development Program, 4th , 1954. Symposium on the,Oct. 17, 1954.
Teeter , W. L. ; Bushore , K. R.,A variable-ratio microwave power divider and multiplexer,Microwave Theory and Techniques, IEEE Transactions on,Oct. 1, 1957.
Terman , F. E.,Radio engineering,McGraw-Hill Book Company, Inc.,Jan. 1, 1947, pp. 73-74, 690-691, 730.

(56) References Cited

OTHER PUBLICATIONS

The Glenn L. Martin Company,Antennas for USAF B-57 series bombers,USAF Antenna Research and Development Program, 2th , 1952. Symposium on the,Oct. 19, 1952.
Theiler , J.,Estimating fractal dimension,Journal of the Optical Society of America (JOSA),Jun. 1, 1990, vol. 7, No. 6, pp. 1055-1073.
Turner , E. M.,Broadband passive electrically small antennas for TV application,Antenna Applications, 1977. Symposium,Apr. 27, 1977.
Turner , E. M. ; Richard , D. J.,Development of an electrically small broadband antenna,USAF Antenna Research and Development Program, 18th , 1968. Symposium on the,Oct. 15, 1968.
Verdura, O.,Miniature fractal antenna : Antena fractal miniatura,Universitat Politecnica de Catalunya (UPC),Sep. 1, 1997.
Virga , K. L.,Low-profile enhanced-bandwidth PIFA antennas for wireless communications packaging,Microwave Theory and Techniques, IEEE Transactions on,Oct. 10, 1997, vol. 45.
Volgov , V. A.,Parts and units of radio electronic equipment,Energiya,Jan. 1, 1967.
Walker , G. J. et al,Fractal volume antennas,Electronics Letters,Aug. 6, 1998.
Wall , H. ; Davies , H. W.,Communications antennas for mercury space capsule,USAF Antenna Research and Development Program, 11th , 1961. Symposium on the,Oct. 16, 1961.
Walsh , J.J. ; Watterson , J.,Fractal analysis of fracture patterns using the standard box-counting technique: valid and invalid methodologies,Journal of Structure Geology,Mar. 10, 1993, vol. 15.
Wang , C. J. et al,Compact microstrip meander antenna,Microwave and Optical Technology Letters,Sep. 20, 1990.
Wang , H. Y. ; Lancaster , M. J.,Aperture-coupled thin-film superconducting meander antennas,Antennas and Propagation, IEEE Transactions on,May 1, 1999.
Watanabe , T. ; Furutani , K. ; Nakajima , N. et al,Antenna switch duplexer for dualband phone (GSM / DCS) using LTCC multilayer technology,Microwave Symposium Digest (MTT-S), 1999. IEEE International,Jun. 19, 1999.
Waterhouse , R. B.,Small microstrip patch antenna,Electronics Letters,Apr. 13, 1995, pp. 604-605.
Waterhouse , R. B.,Small printed antennas with low cross-polarised fields,Electronics Letters,Jul. 17, 1997.
Waterhouse , R. B.,Small printed antenna easily integrated into a mobile handset terminal,Electronics Letters,Aug. 20, 1998.
Waterhouse , R. B. ; Kokotoff , D. M. ; Zavosh , F.,Investigation of small printed antennas suitable for mobile communication handsets,Antennas and Propagation Society (APS), 1998. IEEE International Symposium,Jun. 21, 1998.
Waterhouse , R. B. ; Targonski , S. D. ; Kokotoff , D. M.,Design and performance of small printed antennas,Antennas and Propagation, IEEE Transactions on,Nov. 1, 1998.
Watson , T. ; Friesser , J.,A phase shift direction finding technique,USAF Antenna Research and Development Program, 7th , 1957. Symposium on the,Oct. 21, 1957.
Weeks , W. L.,Eletromagnetic theory for engineering applications,John Wiley & Sons,Jan. 1, 1964, pp. 46-50.
Weeks , W. L.,Antenna engineering,McGraw-Hill Book Company,Jan. 1, 1968, pp. 167-180.
Wegner , D. E.,B-70 antenna system,USAF Antenna Research and Development Program, 13th , 1963. Symposium on the,Oct. 14, 1963.
Werner , D. H and Mittra , R.,Frontiers in electromagnetics,IEEE Press,Jan. 1, 2000, pp. 5-7.
Werner , D. H.,Frequency independent features of self-similar fractal antennas,Radio Science,Nov. 1, 1996.
Werner , D. H.,Radiation characteristics of thin-wire ternary fractal trees,Electronics Letters,Apr. 15, 1999.
West , B.H. et al.,The Prentice-Hall Encyclopedia of Mathematics (1982),Prentice-Hall,Jan. 1, 1982, pp. 404-405.
Wheeler , H. A.,Fundamental limitations of small antennas,Proceedings of the IRE,Jan. 1, 1947.
Wheeler , H. A.,The radiansphere around a small antenna,Proceedings of the IRE,Aug. 1, 1959.
Wheeler , H. A.,Small antennas,USAF Antenna Research and Development Program, 23th , 1973. Symposium on the,Oct. 10, 1973.
Wheeler , H. A.,Small antennas,Antennas and Propagation, IEEE Transactions on,Jul. 1, 1975, vol. 23.
Wheeler , H. A.,Antenna engineering handbook—Chapter 6—Small antennas,Johnson , R. C.—McGraw-Hill,Jan. 1, 1993.
Wikka , K.,Letter to FCC that will authorize the appointment of Morton Flom Eng and/or Flomassociates Inc to act as their Agent in all FCC matters,Nokia Mobile Phones,Aug. 5, 1999.
Williams , T. et al,Dual band meander antenna for wireless telephones,Microwave and Optical Technology Letters,Jan. 20, 2000.
Wong , K. L.,Modified planar inverted F antenna,Electronics Letters,Jan. 8, 1998.
Wong , K. L. ; Kuo , J. S. ; Fang , S. T. et al,Broadband microstrip antennas with integrated reactive loading,Microwave Conference (APMC), 1999. Asia Pacific,Dec. 3, 1999.
Wong , K. L. ; Sze , J. Y.,Dual-frequency slotted rectangular microstrip antenna,Electronics Letters,Jul. 9, 1998.
Wong , S.,An improved microstrip Sierpinski carpet antenna,Microwave Conference (APMC), 2001. Asia-Pacific,Jan. 1, 2001.
Yew-Siow , R.,Dipole configurations with strongly improved radiation efficiency for hand-held transceivers,Antennas and Propagation, IEEE Transactions on,Jul. 1, 1998,vol. 46, No. 6.
Zhang , D. ; Liang , G. C. ; Shih , C. F.,Narrowband lumped element microstrip filters using capacitively loaded inductors,Microwave Symposium Digest (MTT-S), 1995. IEEE International,May 16, 1995, pp. 379-382.
Claim construction and motion for summary judgement—Markman Hearing—[Defendants],Sep. 2, 2010.
Defendant's Invalidity Contentions including apendix B and exhibits 6, 7, 10, 11 referenced in Space Filling Antenna,Feb. 24, 2010.
Demonstratives presented by Dr. Steven Best during trial,May 19, 2011.
Demonstratives presented by Dr. Stuart Long during trial,May 18, 2011.
Detailed rejection of U.S. Appl. No. 12/347,462, filed Jul. 1, 2010.
Document 0001—Complaint for patent infringement,May 5, 2009.
Document 0014—Amended complaint for patent infringement,May 6, 2009.
Document 0032—Defendants LG Electronics Mobilecomm USA., Inc.'s answer and counterclaim to complaint,Oct. 1, 2009.
Document 0064—Defendant Pantech Wireless, Inc.'s answer, affirmative defenses and counterclaims to Fractus SA's Amended complaint,Jun. 4, 2009.
Document 0066—Defendant UTStarcom, Inc's answer affirmative defenses and counterclaims to plaintiff's amended complaint,Jun. 8, 2009.
Document 0073—Plaintiff Fractus SA' s answer to defendant Pantech Wireless, Inc' s counterclaims,Jun. 24, 2009.
Document 0079—Plaintiff Fractus SA' s answer to defendant UTStarcom, Inc' s counterclaims,Jun. 29, 2009.
Document 0091—Answer, affirmative defenses and counterclaims to the amended complaint for patent infringement on behalf of Defendant Personal Communications Devices Holdings, LLC,Jul. 20, 2009.
Document 0099—Defendant Sanyo North America Corporation's partial answer to amended complaint for patent infringement,Jul. 20, 2009.
Document 0106—Kyocera Communications Inc's answer, affirmative defenses and counterclaims to plaintiff's amended complaint,Jul. 21, 2009.
Document 0107—Kyocera Wireless Corp's answer, affirmative defenses and counterclaims to plaintiff's amended complaint,Jul. 21, 2009.
Document 0108—Palm Inc.'s answer, affirmative defenses and counterclaims to plaintiff's amended complaint,Jul. 21, 2009.
Document 0111—Civil cover sheet,May 5, 2009.

(56) References Cited

OTHER PUBLICATIONS

Document 0175—Defendant HTC Corporation's amended answer and counterclaim to plaintiff's second amended complaint,Sep. 25, 2009.
Document 0176—Defendant HTC America Inc's answer and counterclaim to plaintiff's amended complaint,Sep. 25, 2009.
Document 0180—Defendants Samsung Electronics Co., Ltd.'s; Samsung Electronics Research Institute's and Samsung Semiconductor Europe GMBH' s answer; and Samsung Telecommunications America LLC' s answer and counterclaim,Oct. 1, 2009.
Document 0185—Defendants Research in Motion Ltd, and Research in Motion Corporation's answers, defenses and counterclaims to plaintiff's amended complaint,Oct. 1, 2009.
Document 0187—Defendants LG Electronics Inc., LG Electronics USA, Inc., and LG Electronics Mobilecomm USA Inc. answer and counterclaim to amended complaint,Oct. 1, 2009.
Document 0190—Defendant HTC Corporation's First amended answer and counterclaim to plaintiff's amended complaint,Oct. 2, 2009.
Document 0191—Defendant HTC America, Inc's first amended answer and counterclaims to plaintiff's amended complaint,Oct. 2, 2009.
Document 0217—Defendants Research in Motion Ltd, and Research in Motion Corporation's amended answer, defenses and counterclaims to plaintiff's amended complaint,Nov. 24, 2009.
Document 0222—Second amended complaint for patent infringement,Dec. 2, 2009.
Document 0227—Second amended complaint for patent infringement ,Dec. 8, 2009.
Document 0235—Answer, affirmative defenses and counterclaims to the second amended complaint for patent infringement on behalf of Defendant Personal Communications Devices Holdings, LLC,Dec. 17, 2009.
Document 0238—Defendant HTC America, Inc's answer and counterclaims to plaintiff's second amended complaint,Dec. 21, 2009.
Document 0239—Defendant HTC Corporation's answer and counterclaims to plaintiff's second amended complaint,Dec. 21, 2009.
Document 0241—Defendant Research in Motion Ltd and Research in Motion Corporation's second answer, defenses and counterclaims to plaintiff's second amended complaint,Dec. 21, 2009.
Document 0242—Defendant Pantech Wireless, Inc's answer, affirmative defenses and counterclaims to Fractus SA's second amended complaint,Dec. 21, 2009.
Document 0243—Defendant Sanyo Electric Co. Ltd's answer to second amended complaint for patent infringement,Dec. 22, 2009.
Document 0244—Defendant Sanyo North America Corporation's answer to second amended complaint for patent infringement,Dec. 22, 2009.
Document 0246—Defendant UTStarcom, Inc's answer, affirmative defenses and counterclaims to Fractus SA's second amended complaint,Dec. 22, 2009.
Document 0247—Palm, Inc's answer, affirmative defenses and counterclaims to plaintiff's second amended complaint,Dec. 22, 2009.
Document 0248—Kyocera Communications, Inc's answer, affirmative defenses and counterclaims to plaintiff's second amended complaint,Dec. 22, 2009.
Document 0249—Kyocera Wireless Corp's answer, affirmative defenses and counterclaims to plaintiff's second amended cornplaint,Dec. 22, 2009.
Document 0250—Defendants Samsung Electronics Co., Ltd.'s; Samsung Electronics answer and counterclaim to the second amended complaint of plaintiff Fractus,Dec. 23, 2009.
Document 0251—Defendants LG Electronics Inc., LG Electronics USA, Inc., and LG Electronics Mobilecomm USA Inc. answer and counterclaim to second amended complaint,Dec. 28, 2009.
Document 0252—Answer of the Sharp Defendants to plaintiff's second amended complaint,Dec. 29, 2009.
Document 0255—Plaintiff Fractus, S. A.'s answer to defendant Personal Communications Devices Holdings, LLC's counterclaims to the Second Amended Complaint,Jan. 4, 2010.
Document 0256—Plaintiff Fractus, S. A.'s answer to the counterclaims of defendants Research in Motion Ltd. and Research in Motion Corporation to the Second Amended Complaint,Jan. 4, 2010.
Document 0257—Plaintiff Fractus, S. A.'s answer to counterclaims of defendant Pantech Wireless, Inc. to the Second Amended Complaint,Jan. 4, 2010.
Document 0258—Plaintiff Fractus, S. A.'s answer to defendant Kyocera Communications, Inc's Counterclaims to the Second Amended Complaint,Jan. 4, 2010.
Document 0259—Plaintiff Fractus, S. A.'s answer to defendant Kyocera Wireless Corp's Counterclaims to the Second Amended Complaint,Jan. 4, 2010.
Document 0260—Plaintiff Fractus, S. A.'s answer to defendant Palm, Inc's Counterclaims to the Second Amended Complaint,Jan. 4, 2010.
Document 0261—Plaintiff Fractus, S. A.'s answer to defendant UTStarcom, Inc's Counterclaims to the Second Amended Complaint,Jan. 4, 2010.
Document 0262—Plaintiff Fractus, S. A.'s answer to counterclaims of defendant Samsung Telecommunications America LLC to the Second Amended Complaint,Jan. 4, 2010.
Document 0263—Plaintiff Fractus, S. A.'s answer to counterclaims of defendants LG Electronics Inc., Electronics USA, Inc., and LG Electronics Mobilecomm USA, Inc. to the Second Amended Complaint,Jan. 4, 2010.
Document 0273—Plaintiff Fractus, S. A.'s answer to counterclaims of defendants HTC America, Inc to the Second Amended Complaint,Nov. 14, 2010.
Document 0286—Amended answer of the Sharp defendants to plaintiff's second amended complaint,Feb. 24, 2010.
Document 0287—Defendants Samsung Electronics Co., Ltd.'s; Samsung Electronics Research Institute's and Samsung Semiconductor Europe GMBH' s first amended answer; and Samsung Telecommunications America LLC' s first amended answer,Feb. 24, 2010.
Document 0288—Defendants LG Electronics Inc., LG Electronics USA, Inc., and LG Electronics Mobilecomm USA Inc. First amended answer and counterclaim to second amended complaint,Feb. 24, 2010.
Document 0290—Defendant HTC America, Inc.'s amended answer and counterclaim to plaintiff's second amended complaint,Feb. 24, 2010.
Document 0291—Defendant HTC Corporation's amended answer and counterclaim to plaintiff's second amended complaint,Feb. 24, 2010.
Document 0297—Defendant HTC Corporation's amended answer and counterclaim to plaintiff's second amended complaint,Feb. 25, 2010.
Document 0298—Defendant HTC America, Inc.'s amended answer and counterclaim to plaintiff's second amended complaint,Feb. 25, 2010.
Document 0351—Plaintiff Fractus, S. A.'s answer to amended counterclaims of defendant Samsung Telecommunications America LLC's to Fractus's Second Amended Complaint,Apr. 1, 2010.
Document 0352—Plaintiff Fractus, S. A.'s answer to amended counterclaims of defendant HTC Corporation to Fractus's Second Amended Complaint,Apr. 1, 2010.
Document 0353—Plaintiff Fractus, S. A.'s answer to amended counterclaims of defendant HTC America, Inc. to Fractus's Second Amended Complaint,Apr. 1, 2010.
Document 0354—Plaintiff Fractus, S. A.'s answer to amended counterclaims of defendant LG Electronics Inc., LG Electronics USA, Inc., and LG Electronics Mobilecomm USA Inc's to Fractus's Second Amended Complaint,Apr. 1, 2010.
Document 0415—P.R. 4-3 joint claim construction statement,Jun. 14, 2010.
Document 0423—Fractus SA's Opening Claim Construction Brief with Parties' Proposed and Agreed Constructions in the case of *Fractus SA* v. *Samsung Electornics Co. Ltd.* et al.,Jul. 16, 2010.

(56) References Cited

OTHER PUBLICATIONS

Document 0428—Response of defendants Kyocera Communications, Inc; Palm Inc. and UTStarcom, Inc. to plaintiff Fractus SA's opening claim construction brief ,Jul. 30, 2010.
Document 0429—Declaration of Jeffery D. Baxter—Including Exhibits: J, K, L, M ,N ,O, P, Q, R, S, T, U, Z, AA, KK, LL,Jul. 30, 2010.
Document 0430—Defendants RIM, Samsung, HTC, LG and Pantech's response to plaintiff Fractus SA's opening claim construction brief,Jul. 30, 2010.
Document 0430—aonstruction brief Defendants RIM, Samsung, HTC, LG and Pantech's response to plaintiff Fractus SA's opening claim—Exhibit 1—Chart of Agreed Terms and Disputed Terms,Jul. 30, 2010.
Document 0430—Defendants RIM, Samsung, HTC, LG and Pantech's response to plaintiff Fractus SA's opening claim construction brief—Exhibit 2—Family Tree of Asserted Patents,Jul. 30, 2010.
Document 0430—Defendants RIM, Samsung, HTC, LG and Pantech's response to plaintiff Fractus SA's opening claim construction brief—Exhibit 33—Excerpt from Plaintiff's '868 pat. inf.cont.For Samsung SPH M540,Jul. 30, 2010.
Document 0430—Defendants RIM, Samsung, HTC, LG and Pantech's response Fractus SA's opening claim construction brief—Exhibit 34—Excerpts from Plaintiff's '431 patent Infringement Contentions of HTC Diamond,Jul. 30, 2010.
Document 0430—Defendants RIM, Samsung, HTC, LG and Pantech's response to plaintiff Fractus SA's opening claim construction brief—Exhibit 41—Demonstrative re: counting segments,Jul. 30, 2010.
Document 0430—Defendants RIM, Samsung, HTC, LG and Pantech's response to plaintiff Fractus SA's opening claim construction brief—Exhibit 42—Demonstrative showing how straight segments can be fitted over a curved surface,Jul. 30, 2010.
Document 0430—Defendants RIM, Samsung, HTC, LG and Pantech's response to plaintiff Fractus SA's opening claim construction brief—Exhibit 57—Excerpts from Plaintiff's '868 and '762 Pat. Infr. cont. for RIM 8310,Jul. 30, 2010.
Document 0440—Fractus's opposition to defendants' motion for summary judgement of invalidity based on indefiniteness and lack of written description for certain terms,Aug. 16, 2010.
Document 0440-1—Expert declaration by Dr. D. Jaggard including exhibits (curriculum and datasheets from Cushcraft, Antenova, Ethertronics and Taoglas),Aug. 16, 2010.
Document 0440-2—Declaration of Micah Howe in support of Fractus SA opposition to defendants' motion for summary judgement of invalidity based on indefiniteness and lack of written description for certain terms,Aug. 16, 2010.
Document 0452—Defendant's reply in support of their motion for summary judgment of invalidity based on indefiniteness and lack of written description for certain terms with exhibits WW, BBB, EEE, GGG, HHH, III, KKK, MMM, NNN, OOO, PPP, Q,Aug. 30, 2010.
Document 0475—Order Provisional claim construction and motion for summary judgement. Provisional markman order,Nov. 9, 2010.
Document 0526—Memorandum order and opinion,Dec. 17, 2010.
Document 0575—Fractus 's Objections to claim construction memorandum and order,Jan. 14, 2011.
Document 0582—Memorandum opinion and order,Jan. 20, 2011.
Document 0583—Defendant's notice of compliance regarding second amended invalidity contentions,Jan. 21, 2011.
Document 0607—Declaration of Thomas E. Nelson—Exhibit A—Antenna photos,Feb. 3, 2011.
Document 0609—Fractus' reply to defendant's motion for reconsideration of, and objections to, magistrate Judge Love's markman order,Feb. 4, 2011.
Document 0611—Report and recommendation of United States magistrate judge,Feb. 8, 2011.
Document 0622—Order adopting report and recommendation of magistrate judge,Feb. 11, 2011.
Document 0624—Notice of compliance with motion practice orders,Feb. 14, 2011.
Document 0641—Defendant HTC America, Inc's second amended answer and counterclaim to plaintiff's second amended complaint,Feb. 25, 2011.
Document 0642—Defendant HTC Corporation's second amended answer and counterclaim to plaintiff's second amended complaint,Feb. 25, 2011.
Document 0645—Reply brief in support of Defendant's motion for reconsideration of the court's ruling on the term "at least a portion" in the court's Dec. 17, 2010 claim construction order based on newly-available evidence,Feb. 25, 2011.
Document 0647—Defendants Samsung Electronics Co Ltd (et al) second amended answer and counterclaims to the second amended complaint of plaintiff Fractus SA,Feb. 28, 2011.
Document 0649—Defendants LG Electronics Inc, LG Electronics USA, and LG Electronics Mobilecomm USA Inc's second amended answer and counterclaim to second amended complaint,Feb. 28, 2011.
Document 0657—Defendant Pantech Wireless Inc amended answer, affirmative defenses, and counterclaims to Fractus' second amended complaint,Feb. 28, 2011.
Document 0666—Fractus's sur-reply to defendants' motion for reconsideration of the court's Dec. 17, 2010 claim construction order based on newly-available evidence,Mar. 8, 2011.
Document 0670—Order,Mar. 9, 2011.
Document 0678—Plaintiff Fractus SA's answer to second amended counterclaims of defendant HTC Corporation to Fractus's second amended complaint,Mar. 14, 2011.
Document 0680—Plaintiff Fractus SA's answer to second amended counterclaims of defendant HTC to Fractus's second amended complaint,Mar. 14, 2011.
Document 0694—Plaintiff Fractus SA's answer to second amended counterclaims of defendant LG Electronics to Fractus's second amended complaint,Mar. 15, 2011.
Document 0695—Plaintiff Fractus SA's answer to second amended counterclaims of defendant Samsung to Fractus's second amended complaint,Mar. 15, 2011.
Document 0696—Plaintiff Fractus SA's answer to amended counterclaims of defendant Pantech Wireless Inc to Fractus's second amended complaint,Mar. 15, 2011.
Document 0715—Letter to John D. Love—Permission to file a summary judgment motion of no indefiniteness on the issues wher the Court's Report and Recommendation already has held that the claim term is not indefinite,Mar. 18, 2011.
Document 0716—Letter to John D. Love—Permission to file a partial summary judgement motion on infringement.,Mar. 18, 2011.
Document 0721—Letter to John D. Love—Permission to file a motion for summary judgment of invalidity of the following 7 asserted claims from the MLV patent family,Mar. 18, 2011.
Document 0768—Fractus, S.A.'s objections to the Court's Mar. 9, 2011, Order,Mar. 25, 2011.
Document 0780—Defendants' opposition to Fractus SA objections to the Court's Mar. 9, 2011 Order,Mar. 31, 2011.
Document 0783—Order,Apr. 1, 2011.
Document 0841—Stipulation of Dismissal of all Claims and Counterclaims re '850 and '822,Apr. 15, 2011.
Document 0843—Joint Motion to Dismiss Claims and Counterclaims re '850 and '822,Apr. 15, 2011.
Document 0854—Defendants' Motion to Clarify Claim Construction,Apr. 18, 2011.
Document 0868—Order,Apr. 19, 2011.
Document 0876—Fractus's surreply to defendants' Motion for Summary Judgment re publication dates of three references,Apr. 20, 2011.
Document 0887—Fractus's Response to Defendants' Motion to Clarify Claim Construction,Apr. 25, 2011.
Document 0889—Reply in support of defendants' motion to clarify claim construction,Apr. 27, 2011.
Document 0893—Fractus SA's surreply to defendant's motion to clarify claim construction,Apr. 29, 2011.
Document 0900—Order,Apr. 29, 2011.
Document 0901—Report and recommendation of United States Magistrate Judge,May 2, 2011.

(56) References Cited

OTHER PUBLICATIONS

Document 0902—Fractus SA's objections to defendants' prior art notice,May 2, 2011.
Document 0915—Defendants' response to plaintiff's objections to defendants notice of prior art,May 5, 2011.
Document 0933—Defendants' motion for reconsideration of, and objections to, the May 2, 2011 report and recommendation clarifying claim construction,May 9, 2011.
Document 0939—Fractus's response to defendants' motion for reconsideration of and objections to the May 2, 2011, report and recommendations clarifying claim construction,May 10, 2011.
Document 0968—Order,May 13, 2011.
Document 0971—Order,May 13, 2011.
Document 1082—Joint motion to dismiss HTC,Sep. 13, 2011.
Document 1083—Order—Final consent judgement HTC,Sep. 15, 2011.
Document 1088—Samsung's motion to determine intervening rights in view of new Federal Circuit case law or, in the alternative, to stay the case pending the outcome of reexamination,Oct. 19, 2011.
Document 1091—Fractus's response to Samsung's motion to determine intervening rights or to stay the case pending the outcome of reexamination,Nov. 2, 2011.
Document 1092—Samsung's reply in support of its motion to determine intervening rights in view of new Federal Circuit case law or, in the alternative, to stay the case pending the outcome of reexamination,Nov. 14, 2011.
Expert report of Dr. Warren L. Stutzman (redacted)—expert witness retained by Fractus,Feb. 23, 2011.
Expert report of Dwight L. Jaggard (redacted)—expert witness retained by Fractus,Feb. 23, 2011.
Expert report of Dwight L. Jaggard (redacted)—expert witness retained by Fractus,Feb. 23, 2011 pp. ii-vi, 12-24.
Expert report of Stuart Long (redacted)—expert witness retained by Fractus,Feb. 23, 2011.
Fractus' Claim Construction Presentation—Markman Hearing,Sep. 2, 2010.
Infringement Chart—Blackberry 8100. Patent: 7148850,Nov. 5, 2009.
Infringement Chart—Blackberry 8100. Patent: 7202822,Nov. 5, 2009.
Infringement Chart—Blackberry 8110. Patent: 7148850,Nov. 5, 2009.
Infringement Chart—Blackberry 8110. Patent: 7202822,Nov. 5, 2009.
Infringement Chart—Blackberry 8120. Patent: 7148850,Nov. 5, 2009.
Infringement Chart—Blackberry 8120. Patent: 7202822,Nov. 5, 2009.
Infringement Chart—Blackberry 8130. Patent: 7148850,Nov. 5, 2009.
Infringement Chart—Blackberry 8130. Patent: 7202822,Nov. 5, 2009.
Infringement Chart—Blackberry 8220. Patent: 7148850,Nov. 5, 2009.
Infringement Chart—Blackberry 8220. Patent: 7202822,Nov. 5, 2009.
Infringement Chart—Blackberry 8310. Patent: 7148850,Nov. 5, 2009.
Infringement Chart—Blackberry 8310. Patent:7202822,Nov. 5, 2009.
Infringement Chart—Blackberry 8320. Patent: 7148850,Nov. 5, 2009.
Infringement Chart—Blackberry 8320. Patent: 7202822,Nov. 5, 2009.
Infringement Chart—Blackberry 8330. Patent: 7148850,Nov. 5, 2009.
Infringement Chart—Blackberry 8330. Patent: 7202822,Nov. 5, 2009.
Infringement Chart—Blackberry 8820. Patent: 7148850,Nov. 5, 2009.
Infringement Chart—Blackberry 8820. Patent: 7202822,Nov. 5, 2009.
Infringement Chart—Blackberry 8830. Patent: 7148850,Nov. 5, 2009.
Infringement Chart—Blackberry 8830. Patent: 7202822,Nov. 5, 2009.
Infringement Chart—Blackberry 8900. Patent: 7148850,Nov. 5, 2009.
Infringement Chart—Blackberry 8900. Patent: 7202822,Nov. 5, 2009.
Infringement Chart—Blackberry 9630. Patent: 7148850,Nov. 5, 2009.
Infringement Chart—Blackberry 9630. Patent: 7202822,Nov. 5, 2009.
Infringement Chart—Blackberry Bold 9000. Patent: 7148850,Nov. 5, 2009.
Infringement Chart—Blackberry Bold 9000. Patent: 7202822,Nov. 5, 2009.
Infringement Chart—Blackberry Storm 9530. Patent: 7148850,Nov. 5, 2009.
Infringement Chart—Blackberry Storm 9530. Patent: 7202822,Nov. 5, 2009.
Infringement Chart—HTC Dash,Nov. 5, 2009.
Infringement Chart—HTC Dash. Patent: 7148850,Nov. 5, 2009.
Infringement Chart—HTC Dash. Patent: 7202822,Nov. 5, 2009.
Infringement Chart—HTC Diamond,Nov. 5, 2009.
Infringement Chart—HTC Diamond. Patent: 7148850,Nov. 5, 2009.
Infringement Chart—HTC Diamond. Patent: 7202822,Nov. 5, 2009.
Infringement Chart—HTC G1 Google.,Nov. 5, 2009.
Infringement Chart—HTC G1 Google. Patent: 7148850,Nov. 5, 2009.
Infringement Chart—HTC G1 Google. Patent: 7202822,Nov. 5, 2009.
Infringement Chart—HTC My Touch.,Nov. 5, 2009.
Infringement Chart—HTC My Touch. Patent: 7148850,Nov. 5, 2009.
Infringement Chart—HTC My Touch. Patent: 7202822,Nov. 5, 2009.
Infringement Chart—HTC Ozone,Nov. 5, 2009.
Infringement Chart—HTC Ozone. Patent: 7148850,Nov. 5, 2009.
Infringement Chart—HTC Ozone. Patent: 7202822,Nov. 5, 2009.
Infringement Chart—HTC Pure,Nov. 5, 2009.
Infringement Chart—HTC Pure. Patent: 7148850,Nov. 5, 2009.
Infringement Chart—HTC Pure. Patent: 7202822,Nov. 5, 2009.
Infringement Chart—HTC Snap,Nov. 5, 2009.
Infringement Chart—HTC Snap. Patent: 7148850,Nov. 5, 2009.
Infringement Chart—HTC Snap. Patent: 7202822,Nov. 5, 2009.
Infringement Chart—HTC TILT 8925.,Nov. 5, 2009.
Infringement Chart—HTC TILT 8925. Patent: 7148850,Nov. 5, 2009.
Infringement Chart—HTC TILT 8925. Patent: 7202822,Nov. 5, 2009.
Infringement Chart—HTC Touch Pro 2,Nov. 5, 2009.
Infringement Chart—HTC Touch Pro 2 CDMA. Patent: 7148850,Nov. 5, 2009.
Infringement Chart—HTC Touch Pro 2. Patent: 7202822,Nov. 5, 2009.
Infringement Chart—HTC Touch Pro Fuze,Nov. 5, 2009.
Infringement Chart—HTC Touch Pro Fuze. Patent: 7148850,Nov. 5, 2009.
Infringement Chart—HTC Touch Pro Fuze. Patent: 7202822,Nov. 5, 2009.
Infringement Chart—HTC Touch Pro.,Nov. 5, 2009.
Infringement Chart—HTC Touch Pro. Patent: 7148850,Nov. 5, 2009.
Infringement Chart—LG Dare VX9700. Patent: 7148850,Nov. 5, 2009.
Infringement Chart—LG Dare VX9700. Patent: 7202822,Nov. 5, 2009.
Infringement Chart—LG enV Touch VX1100.,Nov. 5, 2009.
Infringement Chart—LG enV Touch VX1100. Patent: 7148850,Nov. 5, 2009.

(56) References Cited

OTHER PUBLICATIONS

Infringement Chart—LG enV Touch VX1100. Patent: 7202822,Nov. 5, 2009.
Infringement Chart—LG enV VX-9900,Nov. 5, 2009.
Infringement Chart—LG enV VX-9900. Patent: 7148850,Nov. 5, 2009.
Infringement Chart—LG enV VX-9900. Patent: 7202822,Nov. 5, 2009.
Infringement Chart—LG EnV2 VX9100,Nov. 5, 2009.
Infringement Chart—LG EnV2 VX9100. Patent: 7148850,Nov. 5, 2009.
Infringement Chart—LG EnV2 VX9100. Patent: 7202822,Nov. 5, 2009.
Infringement Chart—LG EnV3 VX9200.,Nov. 5, 2009.
Infringement Chart—LG EnV3 VX9200. Patent: 7148850,Nov. 5, 2009.
Infringement Chart—LG EnV3 VX9200. Patent: 7202822,Nov. 5, 2009.
Infringement Chart—LG Flare LX165,Nov. 5, 2009.
Infringement Chart—LG Flare LX165. Patent: 7148850,Nov. 5, 2009.
Infringement Chart—LG Flare LX165. Patent: 7202822,Nov. 5, 2009.
Infringement Chart—LG GT365 NEON.,Nov. 5, 2009.
Infringement Chart—LG GT365 NEON. Patent: 7148850,Nov. 5, 2009.
Infringement Chart—LG GT365 NEON. Patent: 7202822,Nov. 5, 2009.
Infringement Chart—LG Lotus,Nov. 5, 2009.
Infringement Chart—LG Lotus. Patent: 7148850,Nov. 5, 2009.
Infringement Chart—LG Lotus. Patent: 7202822,Nov. 5, 2009.
Infringement Chart—LG Muziq LX570,Nov. 5, 2009.
Infringement Chart—LG Muziq LX570. Patent: 7148850,Nov. 5, 2009.
Infringement Chart—LG Muziq LX570. Patent: 7202822,Nov. 5, 2009.
Infringement Chart—LG Rumor,Nov. 5, 2009.
Infringement Chart—LG Rumor 2.,Nov. 5, 2009.
Infringement Chart—LG Rumor 2. Patent: 7148850,Nov. 5, 2009.
Infringement Chart—LG Rumor 2. Patent: 7202822,Nov. 5, 2009.
Infringement Chart—LG Rumor. Patent: 7148850,Nov. 5, 2009.
Infringement Chart—LG Rumor. Patent: 7202822,Nov. 5, 2009.
Infringement Chart—LG Shine CU720,Nov. 5, 2009.
Infringement Chart—LG Shine CU720. Patent: 7148850,Nov. 5, 2009.
Infringement Chart—LG Shine CU720. Patent: 7202822,Nov. 5, 2009.
Infringement Chart—LG UX280,Nov. 5, 2009.
Infringement Chart—LG UX280. Patent: 7148850,Nov. 5, 2009.
Infringement Chart—UX280. Patent: 7202822,Nov. 5, 2009.
Infringement Chart—LG Versa VX9600,Nov. 5, 2009.
Infringement Chart—LG Versa VX9600. Patent: 7148850,Nov. 5, 2009.
Infringement Chart—LG Versa VX9600. Patent: 7202822,Nov. 5, 2009.
Infringement Chart—LG Voyager VX10000,Nov. 5, 2009.
Infringement Chart—LG Voyager VX10000. Patent: 7148850,Nov. 5, 2009.
Infringement Chart—LG Voyager VX10000. Patent: 7202822,Nov. 5, 2009.
Infringement Chart—LG VU CU920,Nov. 5, 2009.
Infringement Chart—LG Vu CU920. Patent: 7148850,Nov. 5, 2009.
Infringement Chart—LG Vu CU920. Patent: 7202822,Nov. 5, 2009.
Infringement Chart—LG VX5400,Nov. 5, 2009.
Infringement Chart—LG VX5400. Patent: 7148850,Nov. 5, 2009.
Infringement Chart—LG VX5400. Patent: 7202822,Nov. 5, 2009.
Infringement Chart—HTC Touch Pro. Patent: 7202822,Nov. 5, 2009.
Infringement Chart—HTC Wing,Nov. 5, 2009.
Infringement Chart—HTC Wing. Patent: 7148850,Nov. 5, 2009.
Infringement Chart—HTC Wing. Patent: 7202822,Nov. 5, 2009.
Infringement Chart—Kyocera Jax,Nov. 5, 2009.
Infringement Chart—Kyocera Jax. Patent: 7148850,Nov. 5, 2009.
Infringement Chart—Kyocera Jax. Patent: 7202822,Nov. 5, 2009.
Infringement Chart—Kyocera MARBL,Nov. 5, 2009.
Infringement Chart—Kyocera MARBL. Patent: 7148850,Nov. 5, 2009.
Infringement Chart—Kyocera MARBL. Patent: 7202822,Nov. 5, 2009.
Infringement Chart—Kyocera NEO E1100,Nov. 5, 2009.
Infringement Chart—Kyocera NEO E1100. Patent: 7148850,Nov. 5, 2009.
Infringement Chart—Kyocera NEO E1100. Patent: 7202822,Nov. 5, 2009.
Infringement Chart—Kyocera S2400,Nov. 5, 2009.
Infringement Chart—Kyocera S2400. Patent: 7148850,Nov. 5, 2009.
Infringement Chart—Kyocera S2400. Patent: 7202822,Nov. 5, 2009.
Infringement Chart—Kyocera Wildcard M1000,Nov. 5, 2009.
Infringement Chart—Kyocera Wildcard M1000. Patent: 7148850,Nov. 5, 2009.
Infringement Chart—Kyocera Wildcard M1000. Patent: 7202822,Nov. 5, 2009.
Infringement Chart—LG 300G.,Nov. 5, 2009.
Infringement Chart—300G. Patent: 7148850,Nov. 5, 2009.
Infringement Chart—LG 300G. Patent: 7202822,Nov. 5, 2009.
Infringement Chart—LG Aloha LX140.,Nov. 5, 2009.
Infringement Chart—LG Aloha LX140. Patent: 7148850,Nov. 5, 2009.
Infringement Chart—LG Aloha LX140. Patent: 7202822,Nov. 5, 2009.
Infringement Chart—LG AX155.,Nov. 5, 2009.
Infringement Chart—LG AX155. Patent: 7148850,Nov. 5, 2009.
Infringement Chart—LG AX155. Patent: 7202822,Nov. 5, 2009.
Infringement Chart—LG AX300,Nov. 5, 2009.
Infringement Chart—LG AX300. Patent: 7148850,Nov. 5, 2009.
Infringement Chart—LG AX300. Patent: 7202822,Nov. 5, 2009.
Infringement Chart—LG AX380,Nov. 5, 2009.
Infringement Chart—LG AX380. Patent: 7148850,Nov. 5, 2009.
Infringement Chart—LG AX380. Patent: 7202822,Nov. 5, 2009.
Infringement Chart—LG AX585.,Nov. 5, 2009.
Infringement Chart—LG AX585. Patent: 7148850,Nov. 5, 2009.
Infringement Chart—LG AX585. Patent: 7202822,Nov. 5, 2009.
Infringement Chart—LG AX8600,Nov. 5, 2009.
Infringement Chart—LG AX8600. Patent: 7148850,Nov. 5, 2009.
Infringement Chart—LG AX8600. Patent: 7202822,Nov. 5, 2009.
Infringement Chart—LG CF360.,Nov. 5, 2009.
Infringement Chart—LG CF360. Patent: 7148850,Nov. 5, 2009.
Infringement Chart—LG CF360. Patent: 7202822,Nov. 5, 2009.
Infringement Chart—LG Chocolate VX8550,Nov. 5, 2009.
Infringement Chart—LG Chocolate VX8550. Patent: 7148850,Nov. 5, 2009.
Infringement Chart—LG Chocolate VX8550. Patent: 7202822,Nov. 5, 2009.
Infringement Chart—CU515,Nov. 5, 2009.
Infringement Chart—LG CU515. Patent: 7148850,Nov. 5, 2009.
Infringement Chart—LG CU515. Patent: 7202822,Nov. 5, 2009.
Infringement Chart—LG Dare VX9700 . Patent 7528782,Nov. 5, 2009.
Infringement Chart—LG VX5500,Nov. 5, 2009.
Infringement Chart—LG VX5500. Patent: 7148850,Nov. 5, 2009.
Infringement Chart—LG VX5500. Patent: 7202822,Nov. 5, 2009.
Infringement Chart—LG VX8350,Nov. 5, 2009.
Infringement Chart—LG VX8350. Patent: 7148850,Nov. 5, 2009.
Infringement Chart—LG VX8350. Patent: 7202822,Nov. 5, 2009.
Infringement Chart—LG VX8360.,Nov. 5, 2009.
Infringement Chart—LG VX8360. Patent: 7148850,Nov. 5, 2009.
Infringement Chart—LG VX8360. Patent: 7202822,Nov. 2009.
Infringement Chart—LG VX8500,Nov. 5, 2009.
Infringement Chart—LG VX8500. Patent: 7148850,Nov. 5, 2009.
Infringement Chart—LG VX8500. Patent: 7202822,Nov. 5, 2009.
Infringement Chart—LG VX8560 Chocolate 3,Nov. 5, 2009.
Infringement Chart—LG VX8560 Chocolate 3. Patent: 7148850,Nov. 5, 2009.

(56) References Cited

OTHER PUBLICATIONS

Infringement Chart—LG VX8560 Chocolate 3. Patent: 7202822,Nov. 5, 2009.
Infringement Chart—LG VX8610,Nov. 5, 2009.
Infringement Chart—LG VX8610. Patent: 7148850,Nov. 5, 2009.
Infringement Chart—LG VX8610. Patent: 7202822,Nov. 5, 2009.
Infringement Chart—LG VX8800,Nov. 5, 2009.
Infringement Chart—LG VX8800. Patent: 7148850,Nov. 5, 2009.
Infringement Chart—LG VX8800. Patent: 7202822,Nov. 5, 2009.
Infringement Chart—LG VX9400,Nov. 5, 2009.
Infringement Chart—LG Xenon GR500.,Nov. 5, 2009.
Infringement Chart—LG Xenon GR500. Patent: 7148850,Nov. 5, 2009.
Infringement Chart—LG Xenon GR500. Patent: 7202822,Nov. 5, 2009.
Infringement Chart—Palm Centro 685,Nov. 5, 2009.
Infringement Chart—Palm Centro 685. Patent: 7148850,Nov. 5, 2009.
Infringement Chart—Palm Centro 685. Patent: 7202822,Nov. 5, 2009.
Infringement Chart—Palm Centro 690,Nov. 5, 2009.
Infringement Chart—Palm Centro 690. Patent: 7148850,Nov. 5, 2009.
Infringement Chart—Palm Centro 690. Patent: 7202822,Nov. 5, 2009.
Infringement Chart—Palm Pre,Nov. 5, 2009.
Infringement Chart—Palm Pre. Patent: 7148850,Nov. 5, 2009.
Infringement Chart—Palm Pre. Patent: 7202822,Nov. 5, 2009.
Infringement Chart—Pantech Breeze C520.,Nov. 5, 2009.
Infringement Chart—Pantech Breeze C520. Patent: 7148850,Nov. 5, 2009.
Infringement Chart—Pantech Breeze C520. Patent: 7202822,Nov. 5, 2009.
Infringement Chart—Pantech C610,Nov. 5, 2009.
Infringement Chart—Pantech C610. Patent: 7148850,Nov. 5, 2009.
Infringement Chart—Pantech C610. Patent: 7202822,Nov. 5, 2009.
Infringement Chart—Pantech C740,Nov. 5, 2009.
Infringement Chart—Pantech C740. Patent: 7148850,Nov. 5, 2009.
Infringement Chart—Pantech C740. Patent: 7202822,Nov. 5, 2009.
Infringement Chart—Pantech DUO C810.,Nov. 5, 2009.
Infringement Chart—Pantech DUO C810. Patent: 7148850,Nov. 5, 2009.
Infringement Chart—Pantech DUO C810. Patent: 7202822,Nov. 5, 2009.
Infringement Chart—Pantech Slate C530,Nov. 5, 2009.
Infringement Chart—Phone: LG Dare VX9700,Nov. 5, 2009.
Infringement Chart—RIM Blackberry 8110,Nov. 5, 2009.
Infringement Chart—RIM Blackberry 8120,Nov. 5, 2009.
Infringement Chart—Rim Blackberry 8130,Nov. 5, 2009.
Infringement Chart—RIM Blackberry 8220,Nov. 5, 2009.
Infringement Chart—RIM Blackberry 8310,Nov. 5, 2009.
Infringement Chart—RIM Blackberry 8320,Nov. 5, 2009.
Infringement Chart—RIM Blackberry 8330,Nov. 5, 2009.
Infringement Chart—RIM Blackberry 8820,Nov. 5, 2009.
Infringement Chart—RIM Blackberry 8830,Nov. 5, 2009.
Infringement Chart—RIM Blackberry 8900,Nov. 5, 2009.
Infringement Chart—RIM Blackberry 9630,Nov. 5, 2009.
Infringement Chart—RIM Blackberry Bold 9000.,Nov. 5, 2009.
Infringement Chart—RIM Blackberry Pearl 8100,Nov. 5, 2009.
Infringement Chart—RIM Blackberry Storm 9530.,Nov. 5, 2009.
Infringement Chart—Samsung Blackjack II SCH-I617. Patent: 7148850,Nov. 5, 2009.
Infringement Chart—Samsung Blackjack II SCH-I617. Patent: 7202822,Nov. 5, 2009.
Infringement Chart—Samsung Blackjack II SGH-i617.,Nov. 5, 2009.
Infringement Chart—Samsung Blast SGH T729,Nov. 5, 2009.
Infringement Chart—Samsung Blast SGH-T729. Patent: 7148850,Nov. 5, 2009.
Infringement Chart—Samsung Blast SGH-T729. Patent: 7202822,Nov. 5, 2009.
Infringement Chart—Samsung EPIX SGH-1907,Nov. 5, 2009.
Infringement Chart—Samsung FlipShot SCH-U900,Nov. 5, 2009.
Infringement Chart—Samsung FlipShot SCH-U900. Patent: 7148850,Nov. 5, 2009.
Infringement Chart—Samsung FlipShot SCH-U900. Patent: 7202822,Nov. 5, 2009.
Infringement Chart—Samsung Instinct M800,Nov. 5, 2009.
Infringement Chart—Samsung Instinct M800. Patent: 7148850,Nov. 5, 2009.
Infringement Chart—Samsung Instinct M800. Patent: 7202822,Nov. 5, 2009.
Infringement Chart—Samsung M320,Nov. 5, 2009.
Infringement Chart—Samsung M320. Patent: 7148850,Nov. 5, 2009.
Infringement Chart—Samsung M320. Patent: 7202822,Nov. 5, 2009.
Infringement Chart—Samsung Messager,Nov. 5, 2009.
Infringement Chart—Samsung Messager. Patent: 7148850,Nov. 5, 2009.
Infringement Chart—Samsung Messager. Patent: 7202822,Nov. 5, 2009.
Infringement Chart—Samsung Omnia SGH-I900,Nov. 5, 2009.
Infringement Chart—Samsung Omnia SGH-I900. Patent: 7148850,Nov. 5, 2009.
Infringement Chart—Samsung Omnia SGH-I900. Patent: 7202822,Nov. 5, 2009.
Infringement Chart—Samsung SCH A127,Nov. 5, 2009.
Infringement Chart—Samsung SCH U340.,Nov. 5, 2009.
Infringement Chart—Samsung SCH U340. Patent: 7148850,Nov. 5, 2009.
Infringement Chart—Samsung SCH U340. Patent: 7202822,Nov. 5, 2009.
Infringement Chart—Samsung SCH U410.,Nov. 5, 2009.
Infringement Chart—Samsung SCH U410. Patent: 7148850,Nov. 5, 2009.
Infringement Chart—Samsung SCH U410. Patent: 7202822,Nov. 5, 2009.
Infringement Chart—Samsung SCH U700,Nov. 5, 2009.
Infringement Chart—Samsung SCH U700. Patent: 7148850,Nov. 5, 2009.
Infringement Chart—Samsung SCH U700. Patent: 7202822,Nov. 5, 2009.
Infringement Chart—Samsung SCH-A630,Nov. 5, 2009.
Infringement Chart—Samsung SCH-A630. Patent: 7148850,Nov. 5, 2009.
Infringement Chart—Samsung SCH-A630. Patent: 7202822,Nov. 5, 2009.
Infringement Chart—Samsung SCH-A645,Nov. 5, 2009.
Infringement Chart—Samsung SCH-A645. Patent: 7148850,Nov. 5, 2009.
Infringement Chart—Samsung SCH-A645. Patent: 7202822,Nov. 5, 2009.
Infringement Chart—Samsung SGH A867,Nov. 5, 2009.
Infringement Chart—Samsung SGH A867. Patent: 7148850,Nov. 5, 2009.
Infringement Chart—Samsung SGH A867. Patent: 7202822,Nov. 5, 2009.
Infringement Chart—Samsung SGH T229,Nov. 5, 2009.
Infringement Chart—Samsung SGH T229. Patent: 7148850,Nov. 5, 2009.
Infringement Chart—Samsung SGH T229. Patent: 7202822,Nov. 5, 2009.
Infringement Chart—Samsung SGH T439,Nov. 5, 2009.
Infringement Chart—Samsung SGH T439. Patent: 7148850,Nov. 5, 2009.
Infringement Chart—Samsung SGH T439. Patent: 7202822,Nov. 5, 2009.
Infringement Chart—Samsung SGH T459,Nov. 5, 2009.
Infringement Chart—Samsung SGH T459. Patent: 7148850,Nov. 5, 2009.
Infringement Chart—Samsung SGH T459. Patent: 7202822,Nov. 5, 2009.
Infringement Chart—Samsung SGH T919,Nov. 5, 2009.

(56) References Cited

OTHER PUBLICATIONS

Infringement Chart—Samsung SGH T919. Patent: 7148850,Nov. 5, 2009.
Infringement Chart—Samsung SGH T919. Patent: 7202822,Nov. 5, 2009.
Infringement Chart—Samsung SGH-A237,Nov. 5, 2009.
Infringement Chart—Samsung SGH-A237. Patent: 7148850,Nov. 5, 2009.
Infringement Chart—Samsung SGH-A237. Patent: 7202822,Nov. 5, 2009.
Infringement Chart—Samsung SGH-A257,Nov. 5, 2009.
Infringement Chart—Samsung SGH-A257 Magnet. Patent: 7148850,Nov. 5, 2009.
Infringement Chart—Samsung SGH-A257 Magnet. Patent: 7202822,Nov. 5, 2009.
Infringement Chart—Samsung SGH-A837,Nov. 5, 2009.
Infringement Chart—Samsung SGH-A837. Patent: 7148850,Nov. 5, 2009.
Infringement Chart—Samsung SGH-A837. Patent: 7202822,Nov. 5, 2009.
Infringement Chart—Samsung SGH-A887,Nov. 5, 2009.
Infringement Chart—Samsung SGH-I907. Patent: 7148850,Nov. 5, 2009.
Infringement Chart—Samsung SGH-I907. Patent: 7202822,Nov. 5, 2009.
Infringement Chart—Samsung SGH-T219.,Nov. 5, 2009.
Infringement Chart—Samsung SGH-T219. Patent: 7148850,Nov. 5, 2009.
Infringement Chart—Samsung SGH-T219. Patent: 7202822,Nov. 5, 2009.
Infringement Chart—Samsung SGH-T239,Nov. 5, 2009.
Infringement Chart—Samsung SGH-T239. Patent: 7148850,Nov. 5, 2009.
Infringement Chart—Samsung SGH-T239. Patent: 7202822,Nov. 5, 2009.
Infringement Chart—Samsung SGH-T559,Nov. 5, 2009.
Infringement Chart—Samsung SGH-T559 Comeback. Patent: 7148850,Nov. 5, 2009.
Infringement Chart—Samsung SGH-T559 Comeback. Patent: 7202822,Nov. 5, 2009.
Infringement Chart—Samsung SGH-T639,Nov. 5, 2009.
Infringement Chart—Samsung SGH-T639. Patent: 7148850,Nov. 5, 2009.
Infringement Chart—Samsung SGH-T639. Patent: 7202822,Nov. 5, 2009.
Infringement Chart—Samsung SGH-T739,Nov. 5, 2009.
Infringement Chart—Samsung SGH-T739. Patent: 7148850,Nov. 5, 2009.
Infringement Chart—Samsung SGH-T739. Patent: 7202822,Nov. 5, 2009.
Infringement Chart—Samsung SGH-T819,Nov. 5, 2009.
Infringement Chart—Samsung SGH-T819. Patent: 7148850,Nov. 5, 2009.
Infringement Chart—Samsung SGH-T819. Patent: 7202822,Nov. 5, 2009.
Infringement Chart—Samsung SGH-T929,Nov. 5, 2009.
Infringement Chart—Samsung SGH-T929. Patent: 7148850,Nov. 5, 2009.
Infringement Chart—Samsung SGH-T929. Patent: 7202822,Nov. 5, 2009.
Infringement Chart—Samsung Spex R210a,Nov. 5, 2009.
Infringement Chart—Samsung Spex R210a. Patent: 7148850,Nov. 5, 2009.
Infringement Chart—Samsung SCH-A870,Nov. 5, 2009.
Infringement Chart—Samsung SCH-A887 Solstice. Patent: 7148850,Nov. 5, 2009.
Infringement Chart—Samsung SCH-A887 Solstice. Patent: 7202822,Nov. 5, 2009.
Infringement Chart—Samsung SCH-I910,Nov. 5, 2009.
Infringement Chart—Samsung SCH-I910. Patent: 7148850,Nov. 5, 2009.
Infringement Chart—Samsung SCH-I910. Patent: 7202822,Nov. 5, 2009.
Infringement Chart—Samsung SCH-R430,Nov. 5, 2009.
Infringement Chart—Samsung SCH-R430. Patent: 7148850,Nov. 5, 2009.
Infringement Chart—Samsung SCH-R430. Patent: 7202822,Nov. 5, 2009.
Infringement Chart—Samsung SCH-R500.,Nov. 5, 2009.
Infringement Chart—Samsung SCH-R500. Patent: 7148850,Nov. 5, 2009.
Infringement Chart—Samsung SCH-R500. Patent: 7202822,Nov. 5, 2009.
Infringement Chart—Samsung SCH-R600,Nov. 5, 2009.
Infringement Chart—Samsung SCH-R600. Patent: 7148850,Nov. 5, 2009.
Infringement Chart—Samsung SCH-R600. Patent: 7202822,Nov. 5, 2009.
Infringement Chart—Samsung SCH-R800,Nov. 5, 2009.
Infringement Chart—Samsung SCH-R800. Patent: 7148850,Nov. 5, 2009.
Infringement Chart—Samsung SCH-R800. Patent: 7202822,Nov. 5, 2009.
Infringement Chart—Samsung SCH-U310,Nov. 5, 2009.
Infringement Chart—Samsung SCH-U310. Patent: 7148850,Nov. 5, 2009.
Infringement Chart—Samsung SCH-U310. Patent: 7202822,Nov. 5, 2009.
Infringement Chart—Samsung SCH-U430,Nov. 5, 2009.
Infringement Chart—Samsung SCH-U430. Patent: 7148850,Nov. 5, 2009.
Infringement Chart—Samsung SCH-U430. Patent: 7202822,Nov. 5, 2009.
Infringement Chart—Samsung SCH-U470,Nov. 5, 2009.
Infringement Chart—Samsung SCH-U470. Patent: 7148850,Nov. 5, 2009.
Infringement Chart—Samsung SCH-U470. Patent: 7202822,Nov. 5, 2009.
Infringement Chart—Samsung SCH-U520,Nov. 5, 2009.
Infringement Chart—Samsung SCH-U520. Patent: 7148850,Nov. 5, 2009.
Infringement Chart—Samsung SCH-U520. Patent: 7202822,Nov. 5, 2009.
Infringement Chart—Samsung SCH-U740,Nov. 5, 2009.
Infringement Chart—Samsung SCH-U740. Patent: 7148850,Nov. 5, 2009.
Infringement Chart—Samsung SCH-U740. Patent: 7202822,Nov. 5, 2009.
Infringement Chart—Samsung SCH-U750,Nov. 5, 2009.
Infringement Chart—Samsung SCH-U750. Patent: 7148850,Nov. 5, 2009.
Infringement Chart—Samsung SCH-U750. Patent: 7202822,Nov. 5, 2009.
Infringement Chart—Samsung SCH-U940,Nov. 5, 2009.
Infringement Chart—Samsung SCH-U940. Patent. 7202822,Nov. 5, 2009.
Infringement Chart—Samsung SCH-U940. Patent: 7148850,Nov. 5, 2009.
Infringement Chart—Samsung SGH A117,Nov. 5, 2009.
Infringement Chart—Samsung SGH A117. Patent: 7148850,Nov. 5, 2009.
Infringement Chart—Samsung SGH A117. Patent: 7202822,Nov. 5, 2009.
Infringement Chart—Samsung SGH A127. Patent: 7148850,Nov. 5, 2009.
Infringement Chart—Samsung SGH A127. Patent: 7202822,Nov. 5, 2009.
Infringement Chart—Samsung SGH A437,Nov. 5, 2009.
Infringement Chart—Samsung SGH A437. Patent: 7148850,Nov. 5, 2009.
Infringement Chart—Samsung SGH A437. Patent: 7202822,Nov. 5, 2009.

(56) References Cited

OTHER PUBLICATIONS

Infringement Chart—Samsung SGH A737,Nov. 5, 2009.
Infringement Chart—Samsung SGH A737. Patent: 7148850,Nov. 5, 2009.
Infringement Chart—Samsung SGH A737. Patent: 7202822,Nov. 5, 2009.
Infringement Chart—Samsung Spex R210a. Patent: 7202822,Nov. 5, 2009.
Infringement Chart—Samsung SPH M520,Nov. 5, 2009.
Infringement Chart—Samsung SPH M520. Patent: 7148850,Nov. 5, 2009.
Infringement Chart—Samsung SPH M520. Patent: 7202822,Nov. 5, 2009.
Infringement Chart—Samsung SPH M540.,Nov. 5, 2009.
Infringement Chart—Samsung SPH M540. Patent: 7148850,Nov. 5, 2009.
Infringement Chart—Samsung SPH M540. Patent: 7202822,Nov. 5, 2009.
Infringement Chart—Samsung SPH-A523,Nov. 5, 2009.
Infringement Chart—Samsung SPH-A523. Patent: 7148850,Nov. 5, 2009.
Infringement Chart—Samsung SPH-A523. Patent: 7202822,Nov. 5, 2009.
Infringement Chart—Samsung SPH-M550,Nov. 5, 2009.
Infringement Chart—Samsung SPH-M550. Patent: 7148850,Nov. 5, 2009.
Infringement Chart—Samsung SPH-M550. Patent: 7202822,Nov. 5, 2009.
Infringement Chart—Samsung Sway SCH-U650,Nov. 5, 2009.
Infringement Chart—Samsung Sway SCH-U650. Patent: 7148850,Nov. 5, 2009.
Infringement Chart—Samsung Sway SCH-U650. Patent: 7202822,Nov. 5, 2009.
Infringement Chart—Sanyo Katana II.,Nov. 5, 2009.
Infringement Chart—Sanyo Katana II. Patent: 7148850,Nov. 5, 2009.
Infringement Chart—Sanyo Katana II. Patent: 7202822,Nov. 5, 2009.
Infringement Chart—Sanyo Katana LX,Nov. 5, 2009.
Infringement Chart—Sanyo Katana LX. Patent: 7148850,Nov. 5, 2009.
Infringement Chart—Sanyo Katana LX. Patent: 7202822,Nov. 5, 2009.
Infringement Chart—Sanyo S1,Nov. 5, 2009.
Infringement Chart—Sanyo S1. Patent: 7148850,Nov. 5, 2009.
Infringement Chart—Sanyo S1. Patent: 7202822,Nov. 5, 2009.
Infringement Chart—Sanyo SCP 2700.,Nov. 5, 2009.
Infringement Chart—Sanyo SCP 2700. Patent: 7148850,Nov. 5, 2009.
Infringement Chart—Sanyo SCP 2700. Patent: 7202822,Nov. 5, 2009.
Infringement Chart—Sharp Sidekick 2008.,Nov. 5, 2009.
Infringement Chart—Sharp Sidekick 2008. Patent: 7148850,Nov. 5, 2009.
Infringement Chart—Sharp Sidekick 2008. Patent: 7202822,Nov. 5, 2009.
Infringement Chart—Sharp Sidekick 3,Nov. 5, 2009.
Infringement Chart—Sharp Sidekick 3. Patent: 7148850,Nov. 5, 2009.
Infringement Chart—Sharp Sidekick 3. Patent: 7202822,Nov. 5, 2009.
Infringement Chart—Sharp Sidekick LX 2009.,Nov. 5, 2009.
Infringement Chart—Sharp Sidekick LX 2009. Patent: 7148850,Nov. 5, 2009.
Infringement Chart—Sharp Sidekick LX 2009. Patent: 7202822,Nov. 5, 2009.
Infringement Chart—Sharp Sidekick LX. Patent: 7148850,Nov. 5, 2009.
Infringement Chart—Sharp Sidekick LX. Patent: 7202822,Nov. 5, 2009.
Infringement Chart—UTStarcom CDM7126.,Nov. 5, 2009.
Infringement Chart—UTStarcom CDM7126. Patent: 7148850,Nov. 5, 2009.
Infringement Chart—UTStarcom CDM7126. Patent: 7202822,Nov. 5, 2009.
Infringement Chart—UTStarcom Quicktire GTX75.,Nov. 5, 2009.
Infringement Chart—UTStarcom Quicktire GTX75. Patent: 7148850,Nov. 5, 2009.
Infringement Chart—UTStarcom Quicktire GTX75. Patent: 7202822,Nov. 5, 2009.
Letter from Baker Botts to Howison & Arnott LLP including exhibits,Aug. 5, 2010.
Letter from Baker Botts to Kenyon & Kenyon LLP, Winstead PC and Howison & Arnott LLP including exhibits.,Oct. 28, 2009.
Oral and videotaped deposition of Dr. Stuart Long—vol. 1,Mar. 11, 2011.
Oral and videotaped deposition of Dr. Stuart Long—vol. 2,Mar. 13, 2011.
Oral and videotaped deposition of Dr. Stuart Long—vol. 3,Mar. 14, 2011.
Oral and videotaped deposition of Dr. Warren L. Stutzman—vol. 1,Mar. 3, 2011.
Oral and videotaped deposition of Dr. Warren L. Stutzman—vol. 2,Mar. 4, 2011.
Rebuttal expert report of Dr. Dwight L. Jaggard (redacted version),Feb. 16, 2011.
Rebuttal expert report of Dr. Stuart A. Long (redacted version),Feb. 16, 2011.
Rebuttal expert report of Dr. Warren L. Stutzman (redacted version),Feb. 16, 2011.
The oral and videotaped deposition of Dwight Jaggard. vol. 1,Mar. 8, 2011.
The oral and videotaped deposition of Dwight Jaggard. vol. 2,Mar. 9, 2011.
The oral and videotaped deposition of Dwight Jaggard. vol. 3,Mar. 10, 2011.
Transcript of jury trial before the Honorable Leonard Davis—May 18, 2011—1:00 PM,May 18, 2011.
Transcript of jury trial before the Honorable Leonard Davis—May 18, 2011—8:45 AM,May 18, 2011.
Transcript of jury trial before the Honorable Leonard Davis—May 19, 2011—1:00 PM,May 19, 2011.
Transcript of jury trial before the Honorable Leonard Davis—May 19, 2011—8:45 AM,May 19, 2011.
Transcript of jury trial before the Honorable Leonard Davis—May 20, 2011—12:30 PM,May 20, 2011.
Transcript of jury trial before the Honorable Leonard Davis—May 20, 2011—8:30 AM,May 20, 2011.
Transcript of jury trial before the Honorable Leonard Davis—May 23, 2011—8:55 AM,May 23, 2011.
Transcript of jury trial before the Honorable Leonard Davis US District Judge—May 17, 2011—8:00 AM,May 17, 2011.
Transcript of jury trial before the Honorable Leonard Davis, US District Judge—May 17, 2011—1:10 PM,May 17, 2011.
Transcript of pretrial hearing before the Honorable Leonard Davis, US District Judge—May 16, 2011—2:00 PM,May 16, 2011.
CN00818542—Response to Office Action dated Nov. 5, 2004,Herrero & Asociados,Mar. 31, 2005.
CN01823716—Office action dated Feb. 16, 2007,CN-PTO,Feb. 16, 2007.
CN01823716—Response to the office action dated Feb. 16, 2007,CN-PTO,Aug. 21, 2007.
CN01823716—Response to the office action dated Sep. 21, 2007,CN-PTO,Dec. 3, 2007.
EP00909089—Claims,Herrero & Asociados,Jan. 28, 2005.
EP00909089—Minutes from Oral Proceedings,EPO,Jan. 28, 2005.
EP00909089—Office Action dated Feb. 7, 2003,EPO,Feb. 7, 2003.
EP00909089—Response to Office Action dated Feb. 7, 2003,Herrero & Asociados,Aug. 14, 2003.
EP00909089—Summons to attend oral proceedings,EPO,Oct. 28, 2004.
EP00909089—Written submissions,Herrero & Asociados,Dec. 15, 2004.

(56) References Cited

OTHER PUBLICATIONS

EP05012854—Communication of the board of appeal,EPO,Dec. 30, 2010.
EP05012854—Decision of the Technical Board of Appeal of the European Patent Office dated Apr. 20, 2012, EPO,Apr. 20, 2012.
PCT/EP00/00411—International preliminary examination report dated Aug. 29, 2002—Notification concerning documents transmitted,EPO,Aug. 29, 2002.
PCT/EP00/00411—Invitation to restrict or to pay additional fees dated Mar. 5, 2002,EPO,Mar. 5, 2002.
PCT/ES99/00296—Reply to the Written Opinion dated Nov. 15, 2001—,Herrero & Asociados,Nov. 15, 2001.
U.S. Appl. No. 10/102,568—Amendment and response to the Office Action dated Jan. 23, 2004,Jones Day,May 26, 2004.
U.S. Appl. No. 10/102,568—Office Action dated Jan. 23, 2004,USPTO,Jan. 23, 2004.
U.S. Appl. No. 10/102,568—Preliminary Amendment—Exhibit CCCC,Rosenman & Colin LLP,Mar. 18, 2002.
U.S. Appl. No. 10/181,790—Office action dated Aug. 27, 2004,USPTO,Aug. 27, 2004.
U.S. Appl. No. 10/181,790—Office action dated Aug. 4, 2005,USPTO,Aug. 4, 2005.
U.S. Appl. No. 10/181,790—Office action dated Jun. 2, 2005,USPTO,Jun. 2, 2005.
U.S. Appl. No. 10/181,790—Office action dated Mar. 2, 2005,USPTO,Mar. 2, 2005.
U.S. Appl. No. 10/181,790—Response to office action dated Aug. 27, 2004,Jones Day,Dec. 8, 2004.
U.S. Appl. No. 10/181,790—Response to the office action dated Jun. 2, 2005,Jones Day,Jul. 20, 2005.
U.S. Appl. No. 10/181,790—Response to the office action dated Mar. 2, 2005,Jones Day,Mar. 14, 2005.
U.S. Appl. No. 10/182,635—Amendment and response to office action dated Dec. 13, 2004,Jones Day,Mar. 17, 2005.
U.S. Appl. No. 10/182,635—Amendment and response to office action dated Oct. 4, 2004,Jones Day,Nov. 12, 2004.
U.S. Appl. No. 10/182,635—Notice of Allowance dated Apr. 11, 2005,USPTO,Apr. 11, 2005.
U.S. Appl. No. 10/182,635—Office Action dated Dec. 13, 2004, USPTO,Dec. 13, 2004.
U.S. Appl. No. 10/182,635—Office action dated Oct. 4, 2004,USPTO,Oct. 4, 2004.
U.S. Appl. No. 10/371,676—Amendment and response to final rejection dated Oct. 6, 2001,Kyocera,Dec. 3, 2004.
U.S. Appl. No. 10/422,578—Advisory Action before the filing of an Appeal Brief,USPTO,dated Jun. 23, 2005.
U.S. Appl. No. 12/498,090—Notice of Allowance dated Mar. 10, 2011,USPTO,Mar. 10, 2011.
U.S. Appl. No. 12/498,090—Office Action dated Aug. 18, 2010,USPTO,Aug. 18, 2010.
U.S. Appl. No. 12/498,090—Office action dated Dec. 30, 2011,USPTO,Dec. 30, 2011.
U.S. Appl. No. 12/498,090—Response to office action dated Aug. 18, 2010,Howison & Arnott,Jan. 17, 2011.
U.S. Appl. No. 13/020,034—Amendment and response to office action dated Nov. 8, 2011,Howison & Arnott,Apr. 3, 2012.
U.S. Appl. No. 13/020,034—Communication to examiner and preliminary amendment,Howison & Arnott,Jul. 24, 2012.
U.S. Appl. No. 13/020,034—Notice of allowance dated Apr. 23, 2012, USPTO,Apr. 23, 2012.
U.S. Appl. No. 13/020,034—Notice of allowance dated Jan. 15, 2013,USPTO,Jan. 15, 2013.
U.S. Appl. No. 13/020,034—Notice of allowance dated Apr. 3, 2013,USPTO,Apr. 3, 2013.
U.S. Appl. No. 13/020,034—Office Action dated Nov. 8, 2011,USPTO,Nov. 8, 2011.
U.S. Appl. No. 13/038,883—Amendment and response to office action dated Dec. 1, 2011,Howison & Arnott,Apr. 3, 2012.
U.S. Appl. No. 13/038,883—Amendment and response to office action dated Jul. 2, 2013,Howison and Arnott,Jul. 25, 2013.
U.S. Appl. No. 13/038,883—Amendment to the claims and RCE,Howison & Arnott,Jun. 7, 2013.
U.S. Appl. No. 13/038,883—Communication to examiner and preliminary amendment,Howison & Arnott,Aug. 10, 2012.
U.S. Appl. No. 13/038,883—Notice of allowance dated Apr. 30, 2012,USPTO,Apr. 30, 2012.
U.S. Appl. No. 13/038,883—Notice of allowance dated Aug. 6, 2013,USPTO,Aug. 6, 2013.
U.S. Appl. No. 13/038,883—Notice of Allowance dated Apr. 2, 2013,USPTO,Apr. 2, 2013.
U.S. Appl. No. 13/038,883—Office action dated Dec. 1, 2011,USPTO,Dec. 1, 2011.
U.S. Appl. No. 13/038,883—Office action dated Jul. 2, 2013,USPTO,Jul. 2, 2013.
U.S. Appl. No. 13/044,207—Amendment and response to office action dated Dec. 5, 2011,Howison & Arnott,Apr. 3, 2012.
U.S. Appl. No. 13/044,207—Amendment and response to office action dated Jul. 2, 2013,Howison and Arnott,Jul. 25, 2013.
U.S. Appl. No. 13/044,207—Amendment to the claims and RCE,Howison & Arnott,Jun. 7, 2013.
U.S. Appl. No. 13/044,207—Communication to examiner and preliminary amendment,Howison & Arnott,Aug. 14, 2012.
U.S. Appl. No. 13/044,207—Notice of allowance dated Aug. 5, 2013,USPTO,Aug. 5, 2013.
U.S. Appl. No. 13/044,207—Notice of allowance dated May 1, 2012,USPTO,May 1, 2012.
U.S. Appl. No. 13/044,207—Notice of Allowance dated Apr. 2, 2013,USPTO,Apr. 2, 2013.
U.S. Appl. No. 13/044,207—Office action dated Dec. 5, 2011,USPTO,Dec. 5, 2011.
U.S. Appl. No. 13/044,207—Office action dated Jul. 2, 2013,USPTO,Jul. 2, 2013.
U.S. Appl. No. 95/000,592—Request for inter partes reexamination for U.S. Pat. No. 7,202,822 including exhibits from CC1 to CC6, Kyocera,Nov. 16, 2010.
U.S. Appl. No. 95/000,593—Request for inter partes reexamination for U.S. Pat. No. 7,202,822 including exhibits from CC1 to CC7, Kyocera,Nov. 16, 2010.
U.S. Appl. No. 95/000,598—Request for inter partes reexamination for U.S. Pat. No. 7,202,822 including exhibits from C1 to F3, HTC,Dec. 3, 2010.
U.S. Appl. No. 95/000,610—Request for inter partes reexamination for U.S. Pat. No. 7,202,822 including exhibits from C1-I5, HTC,Dec. 14, 2010.
U.S. Appl. No. 95/001,389—Office Action for the U.S. Pat. No. 7,123,208 dated Aug. 12, 2010,USPTO,Aug. 12, 2010.
U.S. Appl. No. 95/001,390—Office Action for the U.S. Pat. No. 7,015,868 dated Aug. 19, 2010,USPTO,Aug. 19, 2010.
U.S. Appl. No. 95/001,390—Response to the Office Action for the U.S. Pat. No. 7,015,868 dated Aug. 19, 2010,Sterne Kessler Goldstein Fox,Nov. 19, 2010.
U.S. Appl. No. 95/001,413—Request for inter partes reexamination for U.S. Pat. No. 7,148,850 including claim charts from CC-A to CC-F,Samsung,Aug. 4, 2010.
U.S. Appl. No. 95/001,413—Request for inter partes reexamination for U.S. Pat. No. 7,148,850. CC-F: Claim Chart Comparing Claims 1, 4, 6, 16, 17, 19, 21, 22, 24-26, 29, 35, 38, 40, 45-48, 51, 53, 57, 58, 61, 65, 66, 69, and 70 to U.S. Pat. No. 5,363,114 Shoemaker,Samsung,Aug. 1, 2010.
U.S. Appl. No. 95/001,413—Request for inter partes reexamination for U.S. Pat. No. 7,148,850. CC-A: Claim Chart Comparing claims 1, 4, 6, 17, 19, 21, 22, 24-26, 29, 35, 38, 40, 45-48, 51, 53, 58, 61, 65, 66, 69, and 70 to U.S. Pat. No. 6,140,975 Cohen,Samsung,Aug. 1, 2010.
U.S. Appl. No. 95/001,413—Request for inter partes reexamination for U.S. Pat. No. 7,148,850. CC-B: Claim Chart Comparing claims 1, 4, 6, 16, 17, 19, 21, 22, 24-26, 29, 35, 38, 40, 45-48, 51, 53, 57, 58, 61, 65, 66, 69 and 70 to U.S. Pat. No. 6,140,975 Cohen,Samsung,Aug. 1, 2010.
U.S. Appl. No. 95/001,413—Request for inter partes reexamination for U.S. Pat. No. 7,148,850. CC-C: Claim Chart Comparing Claims

(56) References Cited

OTHER PUBLICATIONS 1, 4, 6, 17, 19, 21, 22, 24-26, 29, 35, 38, 40, 45-48, 53, 58, 61, 65, 66, and 69 to U.S. Pat. No. 6,140,975 Cohen, Samsung,Aug. 1, 2010.
U.S. Appl. No. 95/001,413—Request for inter partes reexamination for U.S. Pat. No. 7,148,850. CC-D: Claim Chart Comparing claims 1, 4, 6, 16, 17, 19, 21, 22, 24-26, 29, 35, 38, 40, 45-48, 51, 53, 57, 58, 61, 65, 66, and 69 to U.S. Pat. No. 5,140,975 Cohen,Samsung,Aug. 1, 2010.
U.S. Appl. No. 95/001,413—Request for inter partes reexamination for U.S. Pat. No. 7,148,850. CC-E: Claim Chart Comparing claims 1, 4, 6, 16-17, 19, 21, 22, 24-26, 29, 35, 38, 40, 45-48, 51, 53, 57, 58, 61, 65, 66, 69 and 70 to patent EP0590671B1 Sekine,Samsung,Aug. 1, 2010.
U.S. Appl. No. 95/001,413—U.S. Appl. No. 95/000,593—Action Closing Prosecution dated Apr. 20, 2012 for U.S. Pat. No. 7,148,850, USPTO,Apr. 20, 2012.
U.S. Appl. No. 95/001,413—U.S. Appl. No. 95/000,593—Action closing prosecution dated Jul. 27, 2012 for U.S. Pat. No. 7,148,850, USPTO,Jul. 27, 2012.
U.S. Appl. No. 95/001,413—U.S. Appl. No. 95/000,593—Inter partes reexamination certificate for U.S. Pat. No. 7,148,850,USPTO,Jun. 6, 2013.
U.S. Appl. No. 95/001,413—U.S. Appl. No. 95/000,593—Patent owner amendment in response to the Right of Appeal Notice mailed Dec. 13, 2012 for U.S. Pat. No. 7,148,850,Edell , Shapiro & Finnan, LLC,Mar. 13, 2013.
U.S. Appl. No. 95/001,413—U.S. Appl. No. 95/000,593—Right of appeal notice for the U.S. Pat. No. 7,148,850,USPTO,Dec. 13, 2012.
U.S. Appl. No. 95/001,413—U.S. Appl. No. 95/000,593—Third party requester's comments to patent owner's response of Oct. 31, 2011 for U.S. Pat. No. 7,148,850,Samsung—Kyocera,Mar. 23, 2012.
U.S. Appl. No. 95/001,413—U.S. Appl. No. 95/000,593—U.S. Appl. No. 95/000,598—Corrected Patent Owner's Response to First Office Action dated Oct. 8, 2010 of U.S. Pat. No. 7,148,850,Sterne Kessler Goldstein Fox,Apr. 11, 2011.
U.S. Appl. No. 95/001,413—U.S. Appl. No. 95/000,593—U.S. Appl. No. 95/000,598—Corrected Patent Owner's Response to First Office Action dated Oct. 8, 2010 of U.S. Pat. No. 7,148,850—Exhibit 1,Sterne Kessler Goldstein Fox,Apr. 11, 2011.
U.S. Appl. No. 95/001,413—U.S. Appl. No. 95/000,593—U.S. Appl. No. 95/000,598—Decision Sua Sponte to merge reexamination proceedings of U.S. Pat. No. 7,148,850,USPTO,Jun. 8, 2011.
U.S. Appl. No. 95/001,413—U.S. Appl. No. 95/000,593—U.S. Appl. No. 95/000,598—Office action for the U.S. Pat. No. 7,148,850 dated Oct. 8, 2010, USPTO,Oct. 8, 2010.
U.S. Appl. No. 95/001,413—U.S. Appl. No. 95/000,593—U.S. Appl. No. 95/000,598—Office Action of U.S. Pat. No. 7,148,850 dated Jul. 29, 2011, USPTO,Jul. 29, 2011.
U.S. Appl. No. 95/001,413—U.S. Appl. No. 95/000,593—U.S. Appl. No. 95/000,598—Patent owner's response to first office action for U.S. Pat. No. 7,148,850 dated Jul. 29, 2011,Sterne Kessler Goldstein Fox,Nov. 31, 2011.
U.S. Appl. No. 95/001,413—U.S. Appl. No. 95/000,593—U.S. Appl. No. 95/000,598—Third party requester's comments to patent owner's reply dated on Apr. 11, 2011 for U.S. Pat. No. 7,148,850,Samsung—Kyocera—HTC,May 2, 2011.
U.S. Appl. No. 95/001,413—U.S. Appl. No. 95/000,593—U.S. Appl. No. 95/000,598—Third party requester's comments to patent owner's reply dated on Jan. 10, 2011 for U.S. Pat. No. 7,148,850,Samsung—Kyocera—HTC,Feb. 9, 2011.
U.S. Appl. No. 95/001,414—Corrected Patent Owner's Response to Office Action dated Oct. 8, 2010 of U.S. Pat. No. 7,202,822, Sterne Kessler Goldstein Fox,Apr. 11, 2011.
U.S. Appl. No. 95/001,414—Office action for the U.S. Pat. No. 7,202,822 dated Oct. 8, 2010,USPTO,Oct. 8, 2010.
U.S. Appl. No. 95/001,414—Request for inter partes reexamination for U.S. Pat. No. 7,202,822 including claim charts from CC-A-1 to CCD,Samsung,Aug. 4, 2010.
U.S. Appl. No. 95/001,414—Request for inter partes reexamination for U.S. Pat. No. 7,202,822—CC-A-1—Claim chart comparing claims 1, 4-5, 7-9, 20-21, 25 and 31 of U.S. Pat. No. 7,202,822 to U.S. Pat. No. 6,140,975,Samsung,Aug. 9, 2010.
U.S. Appl. No. 95/001,414—Request for inter partes reexamination for U.S. Pat. No. 7,202,822—CC-D—Claim Chart Comparing claims 1, 4-5, 7-9, 12, 13, 15, 18, 21, 25, 29-31, 35, 44, 46, 48 and 52 of U.S. Pat. No. 7,202,822 to U.S. Pat. No. 5,363,114 to Shoemaker,Samsung,Aug. 4, 2010.
U.S. Appl. No. 95/001,414—Request for inter partes reexamination for U.S. Pat. No. 7,202,822 issued Apr. 10, 2007—CC-C—Claim Chart Comparing claims 1, 4, 5, 7-9, 12, 13, 15, 18, 21, 25, 29-31, 35, 44, 46, 48 and 52 of U.S. Pat. No. 7,202,822 to Sanad., Samsung,Aug. 4, 2010.
U.S. Appl. No. 95/001,414—Request for inter partes reexamination for U.S. Pat. No. 7,202,822. Exhibit CC-A-2. Claim chart comparing claims 1, 4-5, 7-9, 12-13, 15, 18, 20-22, and 31 of U.S. Pat. No. 7,202,822 to U.S. Pat. No. 6,140,975, Samsung,Aug. 9, 2010.
U.S. Appl. No. 95/001,414—Request for inter partes reexamination for U.S. Pat. No. 7,202,822. Exhibit CC-A-3. Claim Chart Comparing claims 1, 4, 5, 7-9, 12, 13, 15, 18, 20-25, 29-31, 35, 44, 46, 48, 52 and 53 of U.S. Pat. No. 7,202,822 to U.S. Pat. No. 6,140,975,Samsung,Aug. 9, 2010.
U.S. Appl. No. 95/001,414—Request for inter partes reexamination for U.S. Pat. No. 7,202,822. Exhibit CC-A-4 Claim Chart Comparing claims 1, 4, 5, 7-9, 12, 13, 15, 18, 20-25, 29-31, 35, 44, 46, 48, 52 and 53 of U.S. Pat. No. 7,202,822 to U.S. Pat. No. 6,140,975,Samsung,Aug. 9, 2010.
U.S. Appl. No. 95/001,414—Request for inter partes reexamination for U.S. Pat. No. 7,202,822. Exhibit CC-B Claim Chart Comparing claims 1, 4, 5, 7-9, 13, 15, 18, 20-25, 29-31, 35, 44, 46, 48, 52, and 53 of U.S. Pat. No. 7,202,822 to Sekine, Samsung,Aug. 9, 2010.
U.S. Appl. No. 95/001,414—Request for inter partes reexamination of U.S. Pat. No. 7,202,822 issued Apr. 10, 2007—OTH-B—Samsung SCH U340,Samsung,Aug. 10, 2010.
U.S. Appl. No. 95/001,414—Request for inter partes reexamination of U.S. Pat. No. 7,202,822 issued Apr. 10, 2007—OTH-C—Samsung SCH-R500,Samsung,Aug. 10, 2010.
U.S. Appl. No. 95/001,414—Request for inter partes reexamination of U.S. Pat. No. 7,202,822 issued Apr. 10, 2007—OTH-D—Civil Action No. 6:09-cv-00203,Samsung,May 28, 2010.
U.S. Appl. No. 95/001,414—Third party requester's comments to patent owner's reply dated on Jan. 10, 2011 for U.S. Pat. No. 7,202,822,Samsung,Feb. 9, 2011.
U.S. Appl. No. 95/001,414—U.S. Appl. No. 95/000,592—Action closing prosecution dated Aug. 9, 2012 for U.S. Pat. No. 7,202,822, USPTO,Aug. 9, 2012.
U.S. Appl. No. 95/001,414—U.S. Appl. No. 95/000,592—Action Closing Prosecution dated on Apr. 20, 2012 for U.S. Pat. No. 7,202,822, USPTO,Apr. 20, 2012.
U.S. Appl. No. 95/001,414—U.S. Appl. No. 95/000,592—Patent owner amendment in response to Right of Appeal Notice mailed on Dec. 13, 2012 for U.S. Pat. No. 7,202,822,Edell , Shapiro & Finnan , LLC,Mar. 13, 2013.
U.S. Appl. No. 95/001,414—U.S. Appl. No. 95/000,592—Right of appeal notice for the U.S. Pat. No. 7,202,822,USPTO,Dec. 17, 2012.
U.S. Appl. No. 95/001,414—U.S. Appl. No. 95/000,592—U.S. Appl. No. 95/000,610—Decision Sua Sponte to merge reexamination proceedings of U.S. Pat. No. 7,202,822,USPTO,Jun. 7, 2011.
U.S. Appl. No. 95/001,414—U.S. Appl. No. 95/000,592—U.S. Appl. No. 95/000,610—Office Action of U.S. Pat. No. 7,202,822 dated Jul. 29, 2011, USPTO,Jul. 29, 2011.
U.S. Appl. No. 95/001,414—U.S. Appl. No. 95/000,592—U.S. Appl. No. 95/000,610—Patent owner's response to first office action dated Jul. 29, 2011 of U.S. Pat. No. 7,202,822,Steme Kessler Goldstein Fox,Oct. 31, 2011.
U.S. Appl. No. 95/001,414—U.S. Appl. No. 95/000,592—U.S. Appl. No. 95/000,610—Third party requester's comments to patent

(56) References Cited

OTHER PUBLICATIONS owner's response of Oct. 31, 2011 for U.S. Pat. No. 7,202,822,Samsung—Kyocera—HTC,Mar. 23, 2012.
U.S. Appl. No. 10/422,578—Office Action dated Apr. 7, 2005,USPTO,Apr. 7, 2005.
U.S. Appl. No. 10/422,578—Office Action dated Aug. 23, 2007,USPTO,Aug. 23, 2007.
U.S. Appl. No. 10/422,578—Office Action dated Aug. 24, 2005,USPTO,Aug. 24, 2005.
U.S. Appl. No. 10/422,578—Office Action dated dated Jan. 26, 2006,USPTO,Jan. 26, 2006.
U.S. Appl. No. 10/422,578—Office Action dated Mar. 12, 2007,USPTO,Mar. 12, 2007.
U.S. Appl. No. 10/422,578—Office action dated Mar. 26, 2008,USPTO,Mar. 26, 2008.
U.S. Appl. No. 10/422,578—Office Action dated Oct. 4, 2004,USPTO,Oct. 4, 2004.
U.S. Appl. No. 10/422,578—Request for Continued Examination with response to the office action dated Apr. 7, 2005 and the advisory action dated Jun. 23, 2005,Jones Day,Aug. 8, 2005.
U.S. Appl. No. 10/422,578—Response to the Office Action dated Apr. 7, 2005,Jones Day,May 31, 2005.
U.S. Appl. No. 10/422,578—Response to the Office Action dated Oct. 4, 2004,Jones Day,Jan. 6, 2005.
U.S. Appl. No. 10/422,578—Response to the Office Action dated Jan. 26, 2006 and Advisory Action dated Mar. 29, 2006,Jones Day,May 1, 2006.
U.S. Appl. No. 10/797,732—Office action dated Aug. 9, 2007,USPTO,Aug. 9, 2007.
U.S. Appl. No. 10/797,732—Response to Office Action dated Aug. 9, 2007,Winstead,Nov. 8, 2007.
U.S. Appl. No. 10/822,933—Notice of allowance dated Oct. 18, 2007,USPTO,Oct. 18, 2007.
U.S. Appl. No. 10/822,933—Office Action dated Oct. 5, 2006,USPTO,Oct. 5, 2006.
U.S. Appl. No. 10/822,933—Response to Office Action dated Oct. 5, 2006,Jenkens & Gilchrist,Jan. 4, 2007.
U.S. Appl. No. 10/963,080—Notice of allowance dated Sep. 1, 2005.,USPTO,Sep. 1, 2005.
U.S. Appl. No. 10/963,080—Preliminary amendment—Declaration of J. Baxter—Exhibit W,Jones Day,dated Dec. 10, 2004.
U.S. Appl. No. 11/021,597—Office action dated Oct. 30, 2007,USPTO,Oct. 30, 2007.
U.S. Appl. No. 11/021,597—Office Action dated Mar. 12, 2007,USPTO,Mar. 12, 2007.
U.S. Appl. No. 11/021,597—Response to the Office Action dated Mar. 12, 2007,Winstead,Aug. 9, 2007.
U.S. Appl. No. 11/021,597—Response to the office action dated Oct. 30, 2007,Winstead,Dec. 28, 2007.
U.S. Appl. No. 11/033,788—Response to Office Action dated Feb. 7, 2006,Jenkens & Gilchrist,Jun. 1, 2006.
U.S. Appl. No. 11/102,390—Notice of allowance dated Jul. 6, 2006,USPTO,Jun. 25, 2006.
U.S. Appl. No. 11/110,052—Notice of Allowance dated Mar. 29, 2006,USPTO,Mar. 31, 2006.
U.S. Appl. No. 11/110,052—Notice of Allowance dated May 30, 2006,USPTO,May 30, 2006.
U.S. Appl. No. 11/110,052—Preliminary amendment dated Apr. 18, 2005,Howison & Arnott,Apr. 18, 2005.
U.S. Appl. No. 11/124,768—Amendment in response to non-final office action dated Aug. 23, 2006,Jenkens & Gilchrist,Nov. 13, 2006.
U.S. Appl. No. 11/154,843—Amendment and response to office action dated Aug. 2, 2006,Howison & Arnott,Aug. 11, 2006.
U.S. Appl. No. 11/154,843—Notice of Allowance dated Oct. 24, 2006,USPTO,Oct. 24, 2006.
U.S. Appl. No. 11/154,843—Office Action dated Aug. 2, 2006,USPTO,Aug. 2, 2006.
U.S. Appl. No. 11/154,843—Office action dated May 9, 2006,USPTO,May 9, 2006.
U.S. Appl. No. 11/179,250—Notice of Allowance dated Jan. 20, 2007,USPTO,Jan. 26, 2007.
U.S. Appl. No. 11/179,250—Response office action,Howison & Arnott,dated Jul. 12, 2005.
U.S. Appl. No. 11/179,257—Notice of allowance dated Oct. 19, 2006,USPTO,Oct. 19, 2006.
U.S. Appl. No. 11/550,256—Office Action dated Jan. 15, 2008,USPTO,Nov. 15, 2008.
U.S. Appl. No. 11/686,804—Amendment and response to office action dated Apr. 15, 2008,Howison & Arnott,Jul. 9, 2008.
U.S. Appl. No. 11/686,804—Notice of Allowance dated Sep. 9, 2008,USPTO,Sep. 9, 2008.
U.S. Appl. No. 11/686,804—Office action dated Apr. 15, 2008.,USPTO,Apr. 15, 2008.
U.S. Appl. No. 11/780,932—Preliminary amendment dated Jul. 20, 2007,Howison & Arnott,Jul. 20, 2007.
U.S. Appl. No. 12/347,462—Amendment and response to office action dated Oct. 28, 2009,Howison & Arnott,Mar. 15, 2010.
U.S. Appl. No. 12/347,462—Amendment and response to office action dated Dec. 7, 2011,Howison & Arnott,Apr. 3, 2012.
U.S. Appl. No. 12/347,462—Notice of allowance dated Apr. 13, 2012,USPTO,Apr. 13, 2012.
U.S. Appl. No. 12/347,462—Notice of Allowance dated Apr. 19, 2010,USPTO,Apr. 19, 2010.
U.S. Appl. No. 12/347,462—Notice of Allowance dated Jun. 29, 2010,USPTO,Jun. 29, 2010.
U.S. Appl. No. 12/347,462—Notice of Allowance dated May 18, 2009,USPTO,May 18, 2009.
U.S. Appl. No. 12/347,462—Office Action dated Dec. 7, 2011,USPTO,Dec. 7, 2011.
U.S. Appl. No. 12/347,462—Office Action dated Oct. 28, 2009,USPTO,Oct. 28, 2009.
U.S. Appl. No. 12/498,090—Amendment and response to office action dated Dec. 30, 2011,Howison & Arnott,Apr. 3, 2012.
U.S. Appl. No. 12/498,090—Notice of allowance dated Apr. 13, 2012,USPTO,Apr. 13, 2012.
Adcock , M. D,New type feed for high speed conical scanning,USAF Antenna Research and Development Program, 2th , 1952. Symposium on the,Aug. 11, 1952.
Addison , P. S.,Fractals and Chaos—An illustrated course—Full,Institute of Physics Publising Bristol and Philadelphia,Jan. 1, 1997.
Addison , P. S.,Fractals and chaos. An illustrated course,Institute of Physics Publishing,Jan. 1, 1997, pp. 14-15.
Addison , P. S.,Fractals and chaos—An illustrated course,Institute of Physics Publishing,Jan. 1, 1997,pp. 1-3 , 30-36.
Addison , P. S.,Fractals and chaos,Institute of Physics Publishing,Jan. 1, 1997, p. 256.
Ali , M. ; Hayes , G. J. et al,A triple band internal antenna for mobile handheld terminals,Antennas and Propagation Society (APS), 2002. IEEE International Symposium,Jun. 16, 2002.
Ancona , C., On small antenna impedance in weakly dissipative media,Antennas and Propagation, IEEE Transactions on,Mar. 1, 1978.
Andersen , J. B.,The handbook of antenna design—Low- and medium-gain microwave antennas,Rudge , A. W. et al—IEE Eletromagnetic Waves Series; Peter Peregrinus Ltd. (2nd ed.),Jan. 1, 1986,vols. 1 and 2, pp. 526-543.
Anguera , J. ; Puente , C. ; Borja , C.,A procedure to design wide-band electromagnetically-coupled stacked microstrip antennas based on a simple network model,Antennas and Propagation Society (APS), 1999. IEEE International Symposium,Jul. 11, 1999.
Anguera , J. ; Puente , C. ; Borja , C.,A procedure to design stacked microstrip patch antennas on a simple network model,Microwave and Optical Technology Letters,Aug. 1, 2001.
Anguera , J. ; Puente , C. ; Borja , C. ; Romeu , J.,Miniature wideband stacked microstrip patch antenna based on the sierpinski fractal geometry,Antennas and Propagation Society (APS), 2000. IEEE International Symposium,Jul. 1, 2000, vol. 3, pp. 1700-1703.
Anguera , J. ; Puente , C. ; Borja , C. ; Romeu , J. ; Aznar , M.,Antenas microstrip apiladas con geometria de anillo—Stacked

(56) References Cited

OTHER PUBLICATIONS microstrip patch antennas,Unión Cientifica Internacional de la Radio (URSI), 15th , Zaragoza, 2000. Simposium Nacional de la,Sep. 1, 2000.
Arutaki , A. ; Chiba , J.,Communication in a three-layered conducting media with a vertical magnetic dipole,Antennas and Propagation, IEEE Transactions on,Jul. 1, 1980, vol. 28, No. 4.
Bach Andersen , J. et al.On closely coupled dipoles in a random field,Antennas and Wireless Propagation Letters, IEEE,Dec. 1, 2006, vol. 5.
Balanis , C. A.,Antenna theory—Analysis and Design—Chapter 9 / Chapter 14—Broadband dipoles and matching techniques / Microstrip antennas,Hamilton Printing,Jan. 1, 1982, pp. 465-484 and 722-767.
Balanis , C. A.,Antenna Theory—Analysis and design—Chapter 10—Travelling wave and broadband antennas, Hamilton Printing,Jan. 1, 1982, pp. 498-502.
Balanis , C. A.,Antenna theory—Analysis and design—Chapter 2—Fundamental parameters of antennas,John Wiley & Sons,Jan. 1, 1982, pp. 28-100.
Barnsley , M.,Fractals Everywhere,Academic Press Professional,Jan. 1, 1993,2nd Edition.
Barrick , W.,A helical resonator antenna diplexer,USAF Antenna Research and Development Program, 10th , 1960. Symposium on the,Oct. 3, 1960.
Batson , D. D. et al,VHF unfurlable turnstile antennas,USAF Antenna Research and Development Program, 19th , 1969. Symposium on the,Oct. 14, 1969.
Berizzi , F.,Fractal analysis of the signal scattered from the sea surface,Antennas and Propagation, IEEE Transactions on,Feb. 1, 1999,vol. 47, No. 2.
Besthom,1.0 to 21.0 GHz Log-periodic dipole antenna,USAF Antenna Research and Development Program, 18th , 1968. Symposium on the,Oct. 15, 1968.
Blackband , W. T.,The handbook of antenna design—Chapter 18—Coaxial transmisison lines and components,Rudge , A. W. et al.Peter Peregrinus,Jan. 1, 19861,vol. 1 and vol. 2, pp. 1612-1623.
Blackband , W. T.,The handbook of antenna design—Chapter 18—Coaxial transmission lines and components,Rudge , A. W. et al—IEE Eletromagnetic Waves Series; Peter Peregrinus Ltd.,Jan. 1, 1986,2nd ed., pp. 1612-1616.
Bokhari , S. A. ; Zürcher , J. F. ; Mosig , J. R. et al,A small microstrip patch antenna with a convenient tuning option, Antennas and Propagation, IEEE Transactions on,Nov. 1, 1996.
Borja , C.,Fractal microstrip antennas : Antenas fractales microstrip,Universitat Politecnica de Catalunya (UPC),Jul. 1, 1997.
Borja , C.,Panel 01,Fractus—Telefonica,Jan. 1, 1998.
Borja , C.,MSPK product,Fractus—Telefonica,Jan. 1, 1998.
Borja , C.,High directivity fractal boundary microstrip patch antenna,Electronics Letters,Apr. 27, 2000, vol. 36, No. 9.
Borja , C. ; Puente , C.,Iterative network models to predict the performance of Sierpinski fractal antennas and networks,Antennas and Propagation Society (APS), 1999. IEEE International Symposium,Jul. 11, 1999.
Borowski , E. J.,Dictionary of Mathematics,Collins—Case 6:09-cv-00203-LED-JDL,Jan. 1, 1989, pp. 456-457.
Boshoff , H.,A fast box counting algorithm for determining the fractal dimension of sampled continuous functions, IEEE,Jan. 1, 1992.
Braun , C. ; Engblom , G. ; Beckman , C.,Antenna diversity for mobile telephones,Antennas and Propagation Society (APS), 1998. IEEE International Symposium,Jun. 1, 1998.
Breden , R. et al.,Printed fractal antennas,Antennas and Propagation, 1999. IEE National Conference on,Apr. 1, 1999.
Breden , R. et al.,Multiband printed antenna for vehicles,University of Kent,Jan. 3, 2000.
Brown, A.,A high-performance integrated K-band diplexer,Microwave Theory and Techniques, IEEE Transactions on,Aug. 8, 1999, vol. 47.
Buczkowski , S. ; Hildgen , P. ; Cartillier, L.,Measurements of fractal dimension by box-counting: a critical analysis of data scatter,Physica A,Apr. 1, 1998, vol. 252.
Buczkowski , S. ; Kyriacos , S. ; Nekka , F. ; Cartilier , L.,The modified box-countig method: analysis of some characteristic parameters,Pattern Recognition,Apr. 20, 1998, vol. 31, pp. 411-418(8).
Burnett , G. F.,Antenna installations on super constellation airbone early warning and control aircraft,USAF Antenna Research and Development Program, 4th , 1954. Symposium on the,Oct. 17, 1954.
Bushman , F. W.,The boeing B-52 all flush antenna system,USAF Antenna Research and Development Program, 5th , 1955. Symposium on the,Oct. 16, 1955.
Campi , M.,Design of microstrip linear array antennas,Antenna Applications, 1981. Symposium,Aug. 8, 1981.
Campos , O.,Multiband and miniature fractal antennas study : Estudi d'antenes fractal multibanda i en miniatura, Universitat Politecnica de Catalunya (UPC),Jan. 1, 1998.
Carver , K. R. et al.,Microstrip antenna technology,Antennas and Propagation, IEEE Transactions on,Jan. 1, 1981,AP29, No. 1.
Carver , K. R. et al.,Microstrip antenna technology,in "Microstrip antennas" to D.M. Pozar; IEEE Antennas and Propagation Society,Jan. 1, 1995, pp. 3-26.
Caswell , W. E.,Invisible errors in dimensions calculations: geometric and systematic effects,Dimensions and Entropies in Chaotic Systems,Jan. 1, 1986, pp. 123-136.
Chang , J. et al,Hybrid fractal cross antenna,Microwave and Optical Technology Letters,Jun. 20, 2000.
Chen , H.,On the circular polarization operation of annular-ring microstrip antennas,Antennas and Propagation, IEEE Transactions on,Aug. 1, 1999.
Chen , H.,Dual frequency microstrip antenna with embedded reactive loading,Microwave and Optical Technology Letters,Nov. 5, 1999, vol. 23, No. 3.
Chen , M.H.,A compact EHF/SHF dual frequency antenna,Antennas and Propagation Society (APS), 1990. IEEE International Symposium,May 7, 1990, vol. 4.
Chen , S. et al.,On the calculation of Fractal features from images,Pattern Analysis and Machine Intelligence, IEEE Transactions on,Oct. 1, 1993, vol. 15, No. 10.

* cited by examiner

SPACE-FILLING MINIATURE ANTENNAS

CROSS REFERENCE TO RELATED APPLICATIONS

This application is a Continuation of U.S. patent application Ser. No. 14/045,241, filed Oct. 3, 2013, entitled SPACE-FILLING MINIATURE ANTENNAS, which is a Continuation of U.S. patent application Ser. No. 13/044,207, filed Mar. 9, 2011, entitled SPACE-FILLING MINIATURE ANTENNAS, now U.S. Pat. No. 8,558,741, issued Oct. 15, 2013, which is a Continuation of U.S. patent application Ser. No. 12/498,090, filed Jul. 6, 2009, entitled SPACE-FILLING MINIATURE ANTENNAS, now U.S. Pat. No. 8,207,893, issued Jun. 26, 2012, which is a Continuation of U.S. patent application Ser. No. 12/347,462, filed Dec. 31, 2008, entitled SPACE-FILLING MINIATURE ANTENNAS, now U.S. Pat. No. 8,212,726, issued Jul. 3, 2012, which is a Continuation of U.S. patent application Ser. No. 11/686,804, filed Mar. 15, 2007, entitled SPACE-FILLING MINIATURE ANTENNAS, now U.S. Pat. No. 7,554,490, issued Jun. 30, 2009, which is a Division of U.S. patent application Ser. No. 11/179,250, filed Jul. 12, 2005, entitled SPACE-FILLING MINIATURE ANTENNAS, now U.S. Pat. No. 7,202,822, issued Apr. 10, 2007, which is a Continuation of U.S. patent application Ser. No. 11/110,052, filed Apr. 20, 2005, entitled SPACE-FILLING MINIATURE ANTENNAS, now U.S. Pat. No. 7,148,850, issued on Dec. 12, 2006, which is a Continuation of U.S. patent application Ser. No. 10/182,635, filed Nov. 1, 2002, entitled SPACE-FILLING MINIATURE ANTENNAS, now abandoned, which is a National Stage Entry of Patent Cooperation Treaty Application No. PCT/EP00/00411, filed on Jan. 19, 2000, entitled SPACE-FILLING MINIATURE ANTENNAS, the entire contents of which are hereby incorporated by reference.

FIELD OF THE INVENTION

The present invention generally refers to a new family of antennas of reduced size based on an innovative geometry, the geometry of the curves named as Space-Filling Curves (SFC). An antenna is said to be a small antenna (a miniature antenna) when it can be fitted in a small space compared to the operating wavelength. More precisely, the radian sphere is taken as the reference for classifying an antenna as being small. The radian sphere is an imaginary sphere of radius equal to the operating wavelength divided by two times .pi.; an antenna is said to be small in terms of the wavelength when it can be fitted inside said radian sphere.

A novel geometry, the geometry of Space-Filling Curves (SFC) is defined in the present invention and it is used to shape a part of an antenna. By means of this novel technique, the size of the antenna can be reduced with respect to prior art, or alternatively, given a fixed size the antenna can operate at a lower frequency with respect to a conventional antenna of the same size.

The invention is applicable to the field of the telecommunications and more concretely to the design of antennas with reduced size.

BACKGROUND

The fundamental limits on small antennas where theoretically established by H-Wheeler and L. J. Chu in the middle 1940's. They basically stated that a small antenna has a high quality factor (Q) because of the large reactive energy stored in the antenna vicinity compared to the radiated power. Such a high quality factor yields a narrow bandwidth; in fact, the fundamental derived in such theory imposes a maximum bandwidth given a specific size of an small antenna.

Related to this phenomenon, it is also known that a small antenna features a large input reactance (either-capacitive or inductive) that usually has to be compensated with an external matching/loading circuit or structure. It also means that is difficult to pack a resonant antenna into a space which is small in terms of the wavelength at resonance. Other characteristics of a small antenna are its small radiating resistance and its low efficiency.

Searching for structures that can efficiently radiate from a small space has an enormous commercial interest, especially in the environment of mobile communication devices (cellular telephony, cellular pagers, portable computers and data handlers, to name a few examples), where the size and weight of the portable equipment need to be small. According to R. C. Hansen (R. C. Hansen, "Fundamental Limitations on Antennas," Proc. IEEE, vol. 69, no. 2, February 1981), the performance of a small antenna depends on its ability to efficiently use the small available space inside the imaginary radian sphere surrounding the antenna.

SUMMARY

In the present invention, a novel set of geometries named Space-Filling Curves (hereafter SFC) are introduced for the design and construction of small antennas that improve the performance of other classical antennas described in the prior art (such as linear monopoles, dipoles and circular or rectangular loops).

Some of the geometries described in the present invention are inspired in the geometries studied already in the XIX century by several mathematicians such as Giusepe Peano and David Hilbert. In all said cases the curves were studied from the mathematical point of view but were never used for any practical-engineering application.

The dimension (D) is often used to characterize highly complex geometrical curves and structures such those described in the present invention. There exists many different mathematical definitions of dimension but in the present document the box-counting dimension (which is well-known to those skilled in mathematics theory) is used to characterize a family of designs. Those skilled in mathematics theory will notice that optionally, an Iterated Function System (IFS), a Multireduction Copy Machine (MRCM) or a Networked Multireduction Copy Machine (MRCM) algorithm can be used to construct some space-filling curves as those described in the present invention.

The key point of the present invention is shaping part of the antenna (for example at least a part of the arms of a dipole, at least a part of the arm of a monopole, the perimeter of the patch of a patch antenna, the slot in a slot antenna, the loop perimeter in a loop antenna, the horn cross-section in a horn antenna, or the reflector perimeter in a reflector antenna) as a space-filling curve, that is, a curve that is large in terms of physical length but small in terms of the area in which the curve can be included. More precisely, the following definition is taken in this document for a space-filling curve: a curve composed by at least ten segments which are connected in such a way that each segment forms an angle with their neighbors, that is, no pair of adjacent segments define a larger straight segment, and wherein the curve can be optionally periodic along a fixed straight direction of space if and only if the period is defined by a non-periodic curve composed by at least ten connected segments and no pair of said adjacent and connected segments define a straight longer segment. Also, whatever the design of such SFC is, it can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be fitted in the same area (surface) as said space-filling curve. Additionally, to properly shape the structure of a miniature antenna according to the present invention, the segments of the SFC curves must be shorter than a tenth of the free-space operating wavelength.

Depending on the shaping procedure and curve geometry, some infinite length SFC can be theoretically designed to feature a Haussdorf dimension larger than their topological-dimension. That is, in terms of the classical Euclidean geometry, It is usually understood that a curve is always a one-dimension object; however when the curve is highly convoluted and its physical length is very large, the curve tends to fill parts of the surface which supports it; in that case the Haussdorf dimension can be computed over the curve (or at least an approximation of it by means of the box-counting algorithm) resulting in a number larger than unity. Such theoretical infinite curves cannot be physically constructed, but they can be approached with SFC designs. The curves 8 and 17 described in and FIG. 2 and FIG. 5 are some examples of such SFC, that approach an ideal infinite curve featuring a dimension D=2.

The advantage of using SFC curves in the physical shaping of the antenna is two-fold: a) Given a particular operating frequency or wavelength said SFC antenna can be reduced in size with respect to prior art. (b) Given the physical size of the SFC antenna, said SFC antenna can be operated at a lower frequency (a longer wavelength) than prior art.

BRIEF DESCRIPTION OF THE DRAWINGS

For a more complete understanding, reference is now made to the following description taken in conjunction with the accompanying Drawings in which.

DETAILED DESCRIPTION

Figure 1:
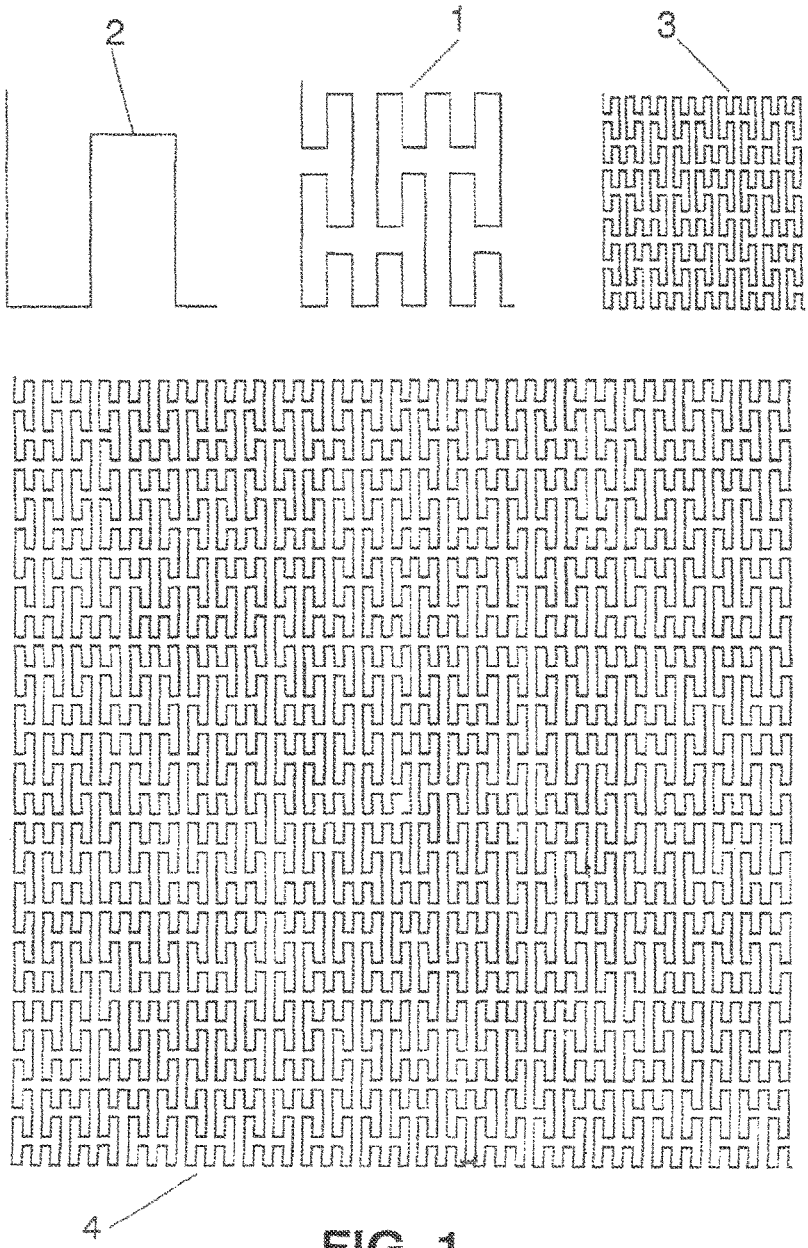
FIG. 1 shows some particular cases of SFC curves. From an initial curve (2), other curves (1), (3) and (4) with more than 10 connected segments are formed. This particular family of curves are named hereafter SZ curves.
Figure 2:
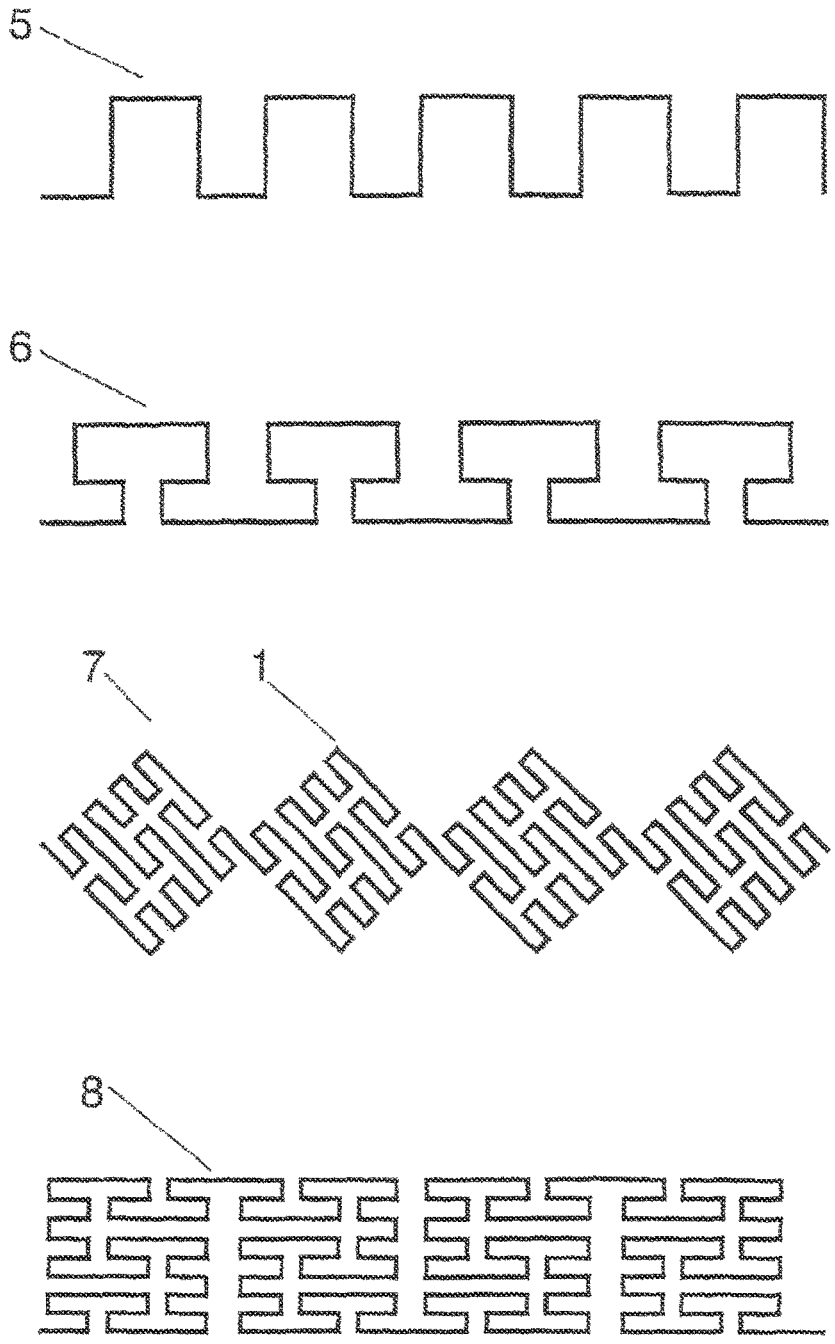
FIG. 2 shows a comparison between two prior art meandering lines and two SFC periodic curves, constructed from the SZ curve of drawing 1.

FIG. 1 and FIG. 2 show some examples of SFC curves. Drawings (1), (3) and (4) in FIG. 1 show three examples of SFC curves named SZ curves. A curve that is not an SFC since it is only composed of 6 segments is shown in drawing (2) for comparison. The drawings (7) and (8) in FIG. 2 show another two particular examples of SFC curves, formed from the periodic repetition of a motive including the SFC curve (1). It is important noticing the substantial difference between these examples of SFC curves and some examples of periodic, meandering and not SFC curves such as those in drawings (5) and (6) in FIG. 2. Although curves (5) and (6) are composed by more than 10 segments, they can be substantially considered periodic along a straight direction (horizontal direction) and the motive that defines a period or repetition cell is constructed with less than 10 segments (the period in drawing (5) includes only four segments, while the period of the curve (6) comprises nine segments) which contradicts the definition of SFC curve introduced in the present invention. SFC curves are substantially more complex and pack a longer length in a smaller space; this fact in conjunction with the fact that each segment composing and SFC curve is electrically short (shorter than a tenth of the free-space operating wavelength as claimed in this invention) play a key role in reducing the antenna size. Also, the class of folding mechanisms used to obtain the particular SFC curves described in the present invention are important in the design of miniature antennas.

Figure 3:
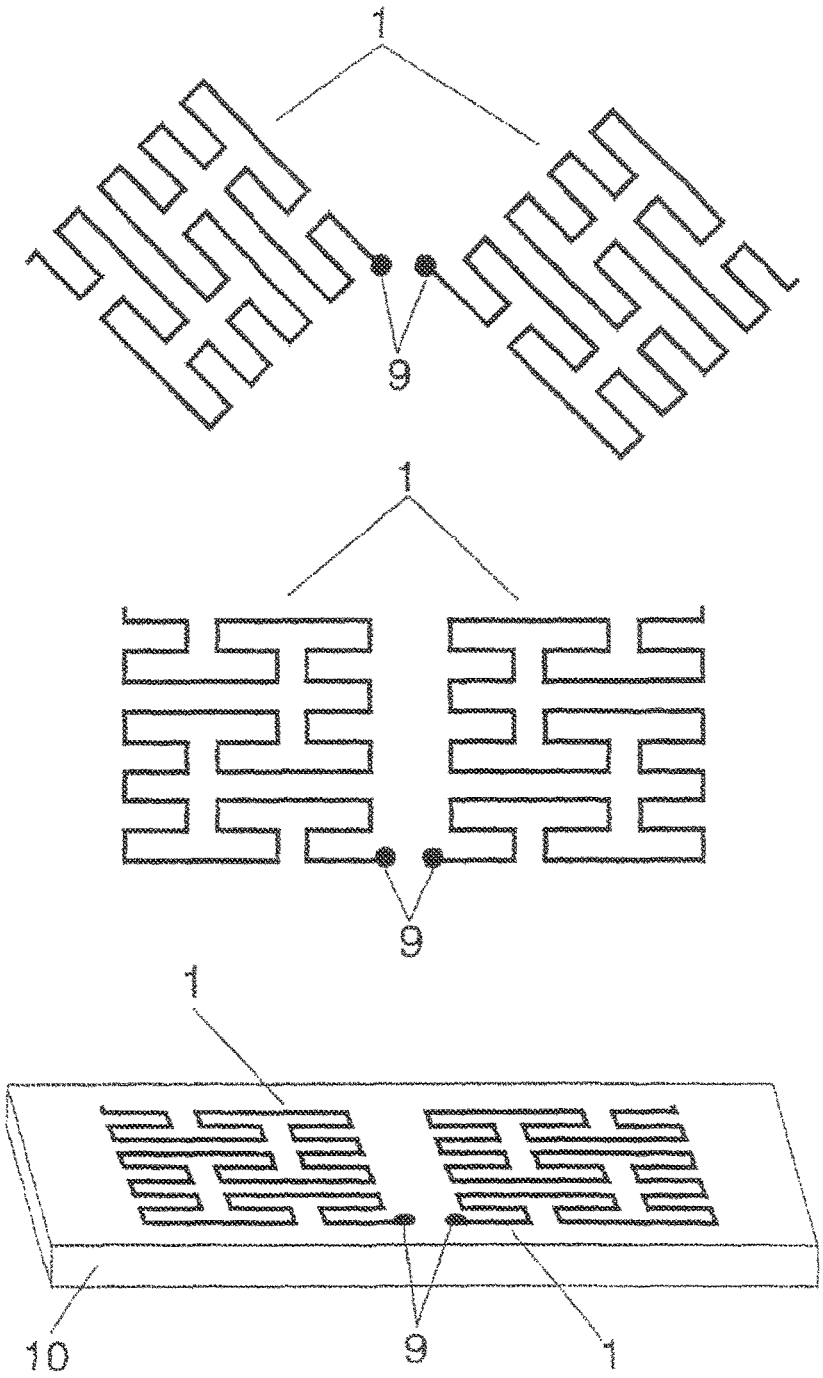
FIG. 3 shows a particular configuration of an SFC antenna. It consists on tree different configurations of a dipole wherein each of the two arms is fully shaped as an SFC curve (1)

FIG. 3 describes a preferred embodiment of an SFC antenna. The three drawings display different configurations of the same basic dipole. A two-arm antenna dipole is constructed comprising two conducting or superconducting parts, each part shaped as an SFC curve. For the sake of clarity but without loss of generality, a particular case of SFC curve (the SZ curve (1) of FIG. 1) has been chosen here; other SFC curves as for instance, those described in FIG. 1, 2, 6, 8, 14, 19, 20, 21, 22, 23, 24 or 25 could be used instead. The two closest tips of the two arms form the input terminals (9) of the dipole. The terminals (9) have been drawn as conducting or superconducting circles, but as it is clear to those skilled in the art, such terminals could be shaped following any other pattern as long as they are kept small in terms of the operating wavelength. Also, the arms of the dipoles can be rotated and folded in different ways to finely modify the input impedance or the radiation properties of the antenna such as, for instance, polarization. Another preferred embodiment of an SFC dipole is also shown in FIG. 3, where the conducting or superconducting SFC arms are printed over a dielectric substrate (10); this method is particularly convenient in terms of cost and mechanical robustness when the SFC curve is long. Any of the well-known printed circuit fabrication techniques can be applied to pattern the SFC curve over the dielectric substrate. Said dielectric substrate can be for instance a glass-fibre board, a teflon based substrate (such as Cuclad®) or other standard radiofrequency and microwave substrates (as for instance Rogers 4003® or Kapton®). The dielectric substrate can even be a portion of a window glass if the antenna is to be mounted in a motor vehicle such as a car, a train or an air-plane, to transmit or receive radio, TV, cellular telephone (GSM 900, GSM 1800, UMTS) or other communication services electromagnetic waves. Of course, a balun network can be connected or integrated at the input terminals of the dipole to balance the current distribution among the two dipole arms.

Figure 4:
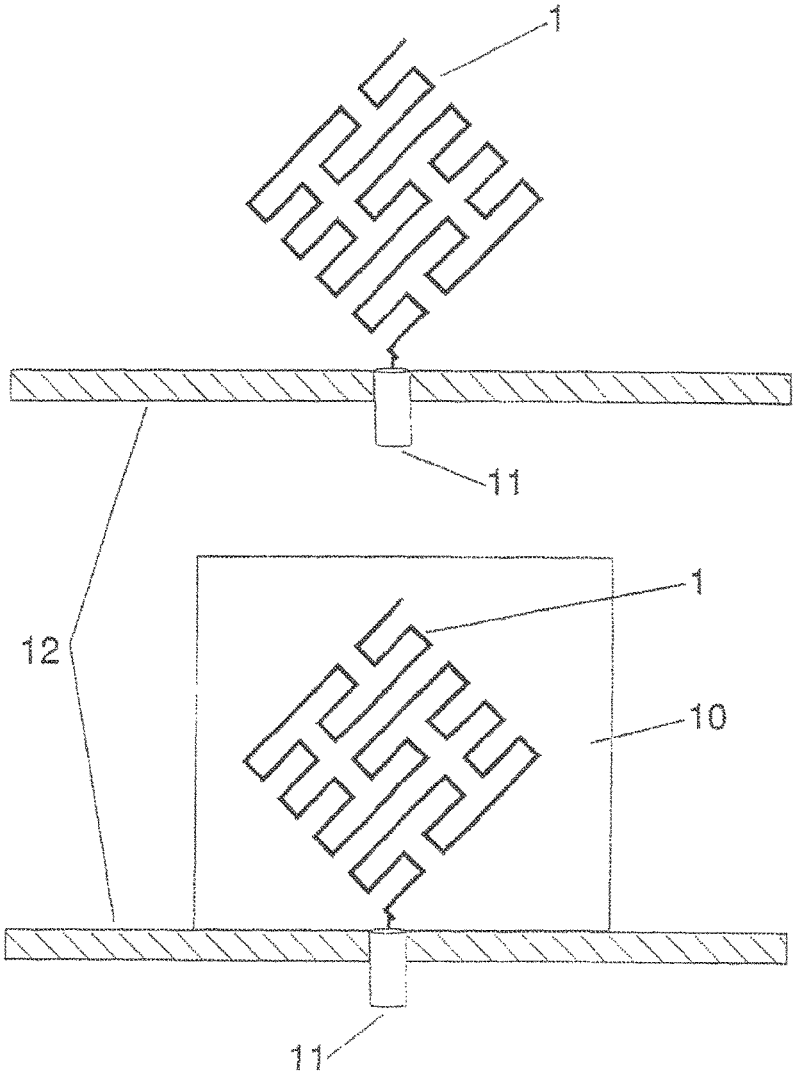
FIG. 4 shows other particular cases of SFC antennas. They consist on monopole antennas.

Another preferred embodiment of an SFC antenna is a monopole configuration as shown in FIG. 4. In this case one of the dipole arms is substituted by a conducting or superconducting counterpoise or ground plane (12). A handheld telephone case, or even a part of the metallic structure of a car, train or can act as such a ground counterpoise. The ground and the monopole arm (here the arm is represented with SFC curve (1), but any other SFC curve could be taken instead) are excited as usual in prior art monopoles by means of, for instance, a transmission line (11). Said transmission line is formed by two conductors, one of the conductors is connected to the ground counterpoise while the other is connected to a point of the SFC conducting or superconducting structure. In the drawings of FIG. 4, a coaxial cable (11) has been taken as a particular case of transmission line, but it is clear to any skilled in the art that other transmission lines (such as for instance a microstrip arm) could be used to excite the monopole. Optionally, and following the scheme described in FIG. 3, the SFC curve can be printed over a dielectric substrate (10).

Figure 5:
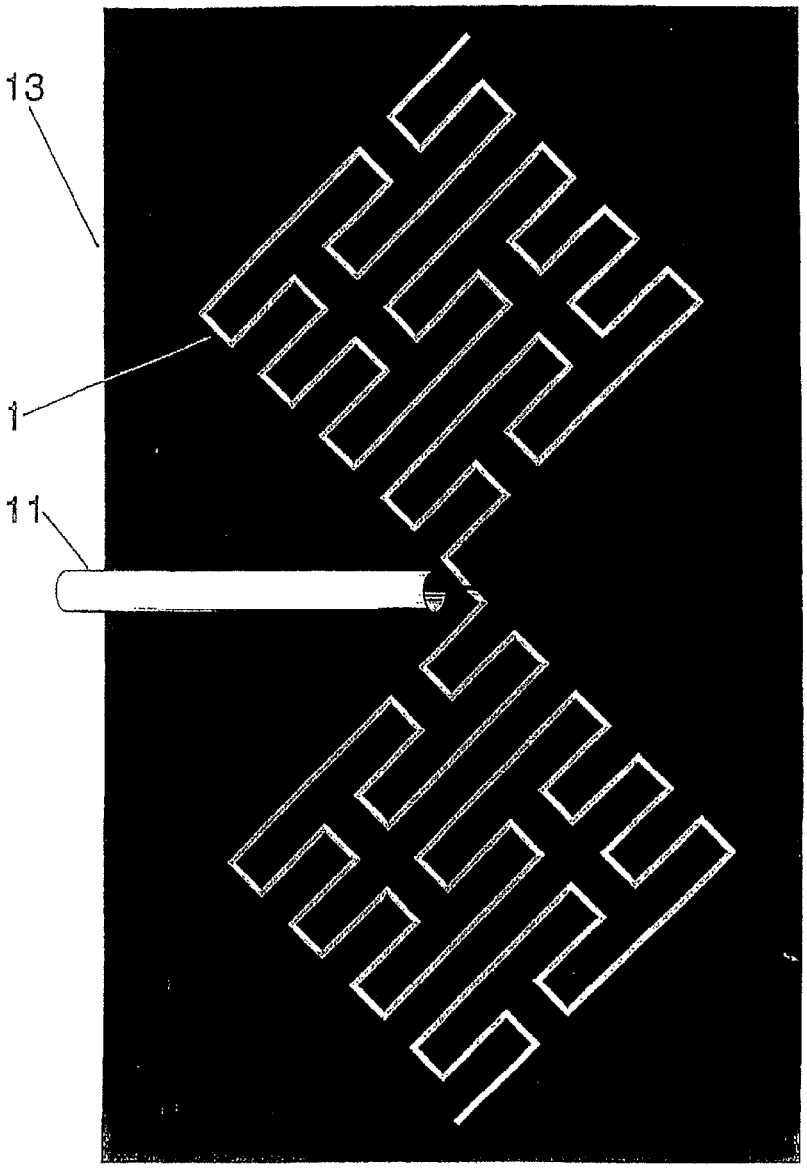
FIG. 5 shows an example of an SFC slot antenna where the slot is shaped as the SFC in drawing 1.
Figure 6:
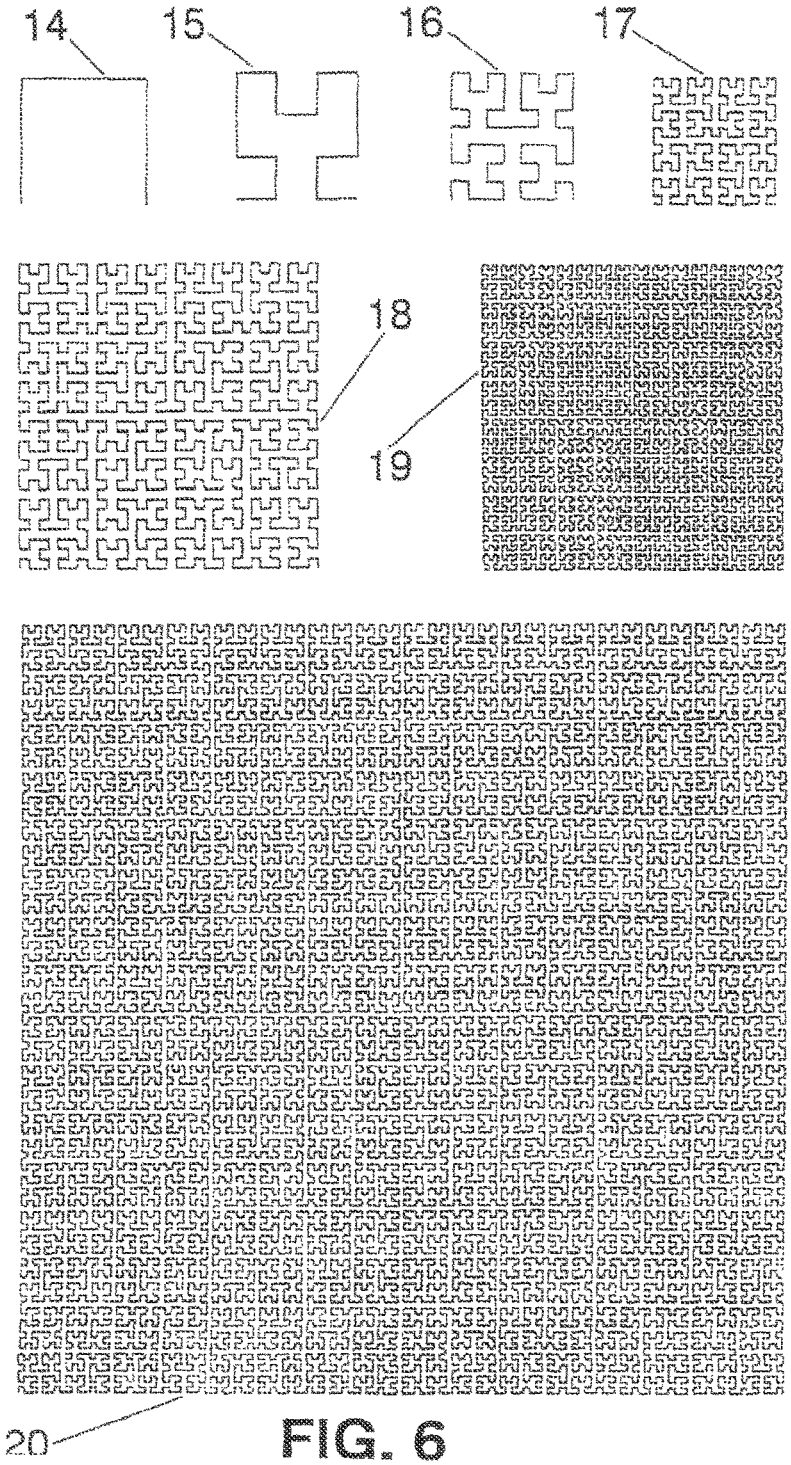
FIG. 6 shows another set of SFC curves (15-20) inspired on the Hilbert curve and hereafter named as Hilbert curves. A standard, non-SFC curve is shown in (14) for comparison.
Figure 7:
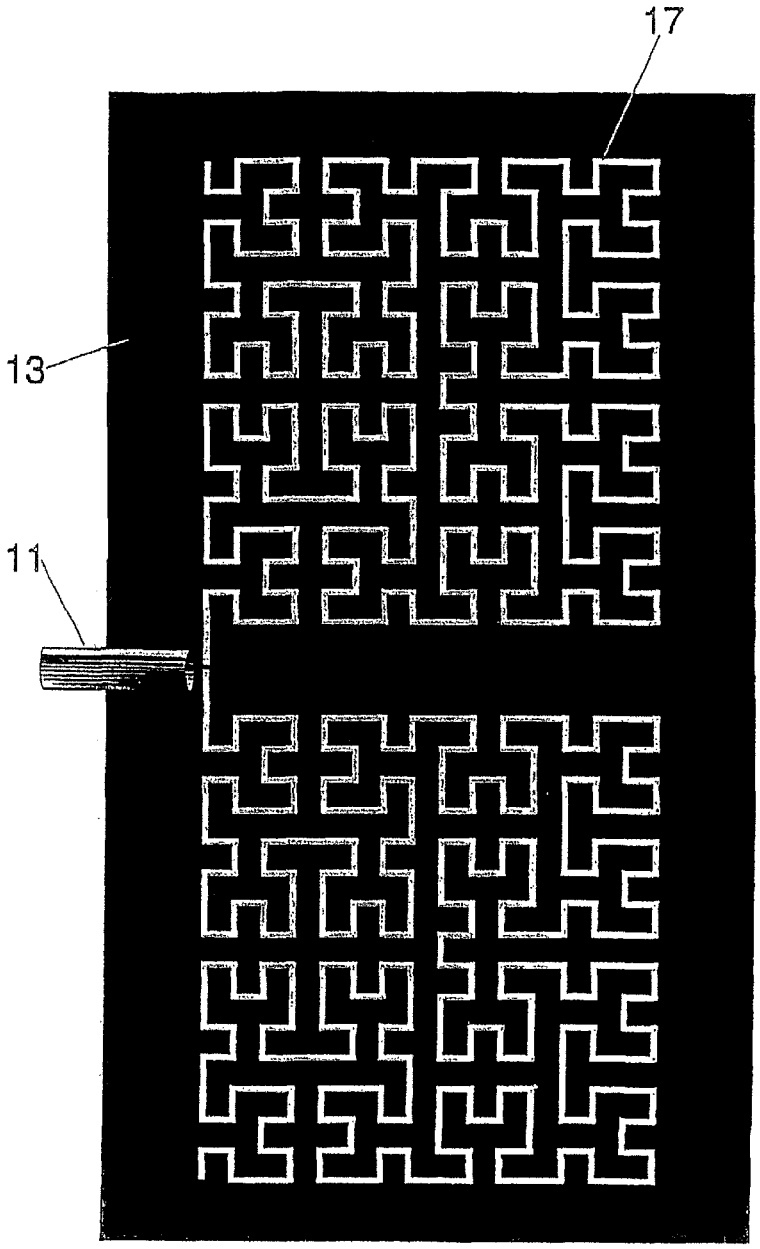
FIG. 7 shows another example of an SFC slot antenna based on the SFC curve (17) in drawing 6.
Figure 8:
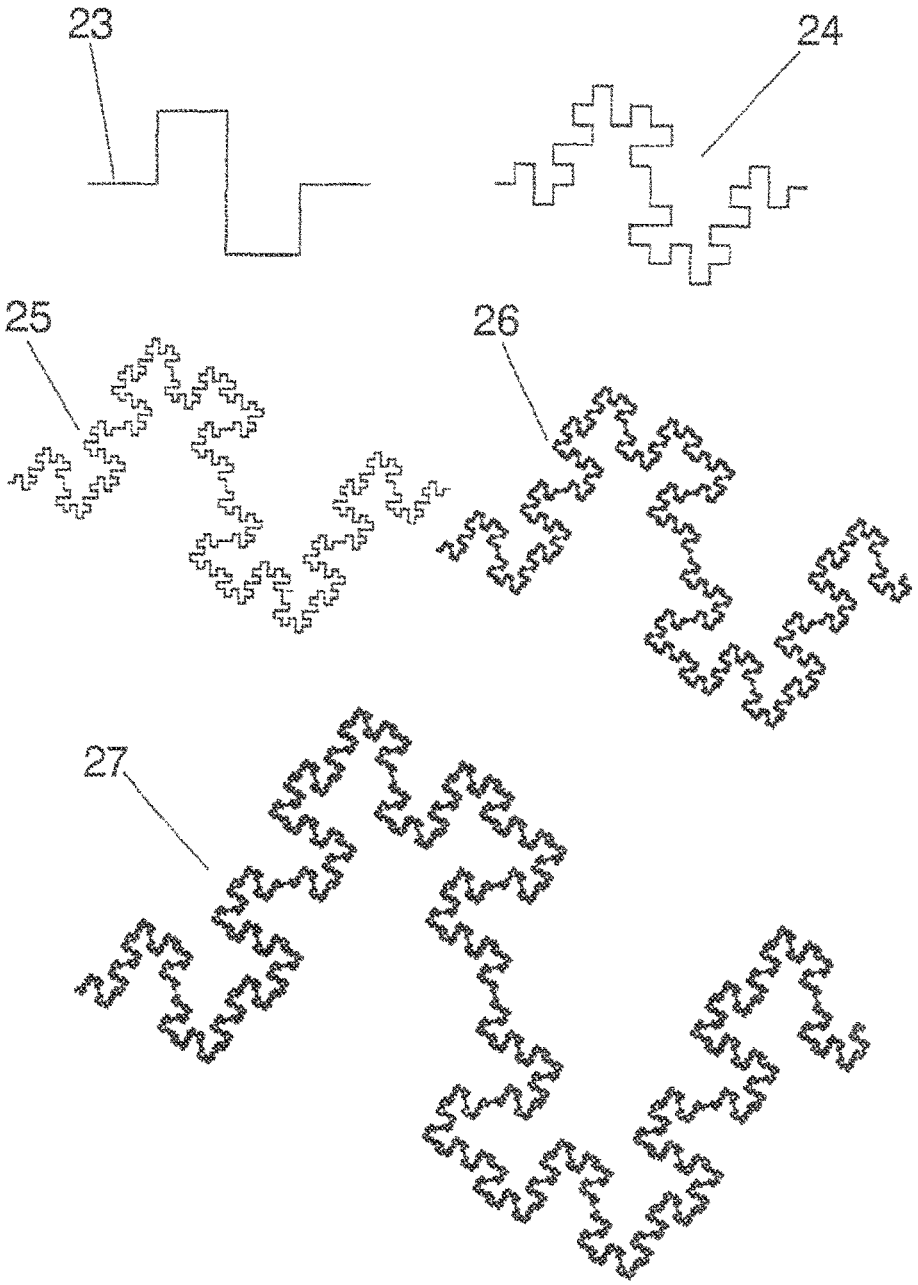
FIG. 8 shows another set of SFC curves (24, 25, 26, 27) hereafter known as ZZ curves. A conventional squared zigzag curve (23) is shown for comparison.
Figure 10:
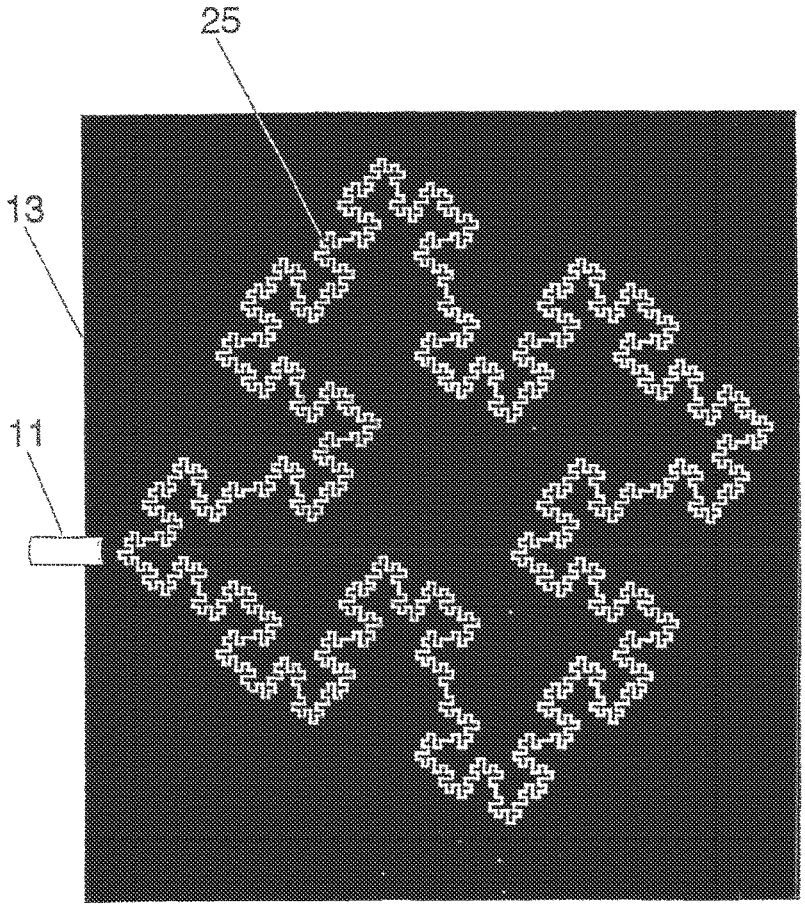
FIG. 10 shows a slot loop antenna based on the SFC (25) in drawing 8.

Another preferred embodiment of an SFC antenna is a slot antenna as shown, for instance in FIGS. 5, 7 and 10. In FIG. 5, two connected SFC curves (following the pattern (1) of FIG. 1) form a slot or gap impressed over a conducting or superconducting sheet (13). Such sheet can be, for instance, a sheet over a dielectric substrate in a printed circuit board configuration, a transparent conductive film such as those deposited over a glass window to protect the interior of a car from heating infrared radiation, or can even be part of the metallic structure of a handheld telephone, a car, train, boat or airplane. The exciting scheme can be any of the well-known in conventional slot antennas and it does not become an essential part of the present invention. In all said three figures, a coaxial cable (11) has been used to excite the antenna, with one of the conductors connected to one side of the conducting sheet and the other one connected at the other side of the sheet across the slot. A microstrip transmission line could be used, for instance, instead of the coaxial cable.

To illustrate that several modifications of the antenna that can be done based on the same principle and spirit of the present invention, a similar example is shown in FIG. 7, where another curve (the curve (17) from the Hilbert family) is taken instead. Notice that neither in FIG. 5, nor in FIG. 7 the slot reaches the borders of the conducting sheet, but in another embodiment the slot can be also designed to reach the boundary of said sheet, breaking said sheet in two separate conducting sheets.

FIG. 10 describes another possible embodiment of a slot SFC antenna. It is also a slot antenna in a closed loop configuration. The loop is constructed for instance by connecting four SFC gaps following the pattern of SFC (25) in FIG. 8 (it is clear that other SFC curves could be used instead according to the spirit and scope of the present invention). The resulting closed loop determines the boundary of a conducting or superconducting island surrounded by a conducting or superconducting sheet. The slot can be excited by means of any of the well-known conventional techniques; for instance a coaxial cable (11) can be used, connecting one of the outside conductor to the conducting outer sheet and the inner conductor to the inside conducting island surrounded by the SFC gap. Again, such sheet can be, for example, a sheet over a dielectric substrate in a printed circuit board configuration, a transparent conductive film such as those deposited over a glass window to protect the interior of a car from heating infrared radiation, or can even be part of the metallic structure of a handheld telephone, a car, train, boat or air-plane. The slot can be even formed by the gap between two close but not co-planar conducting island and conducting sheet; this can be physically implemented for instance by mounting the inner conducting island over a surface of the optional dielectric substrate, and the surrounding conductor over the opposite surface of said substrate.

Figure 9:
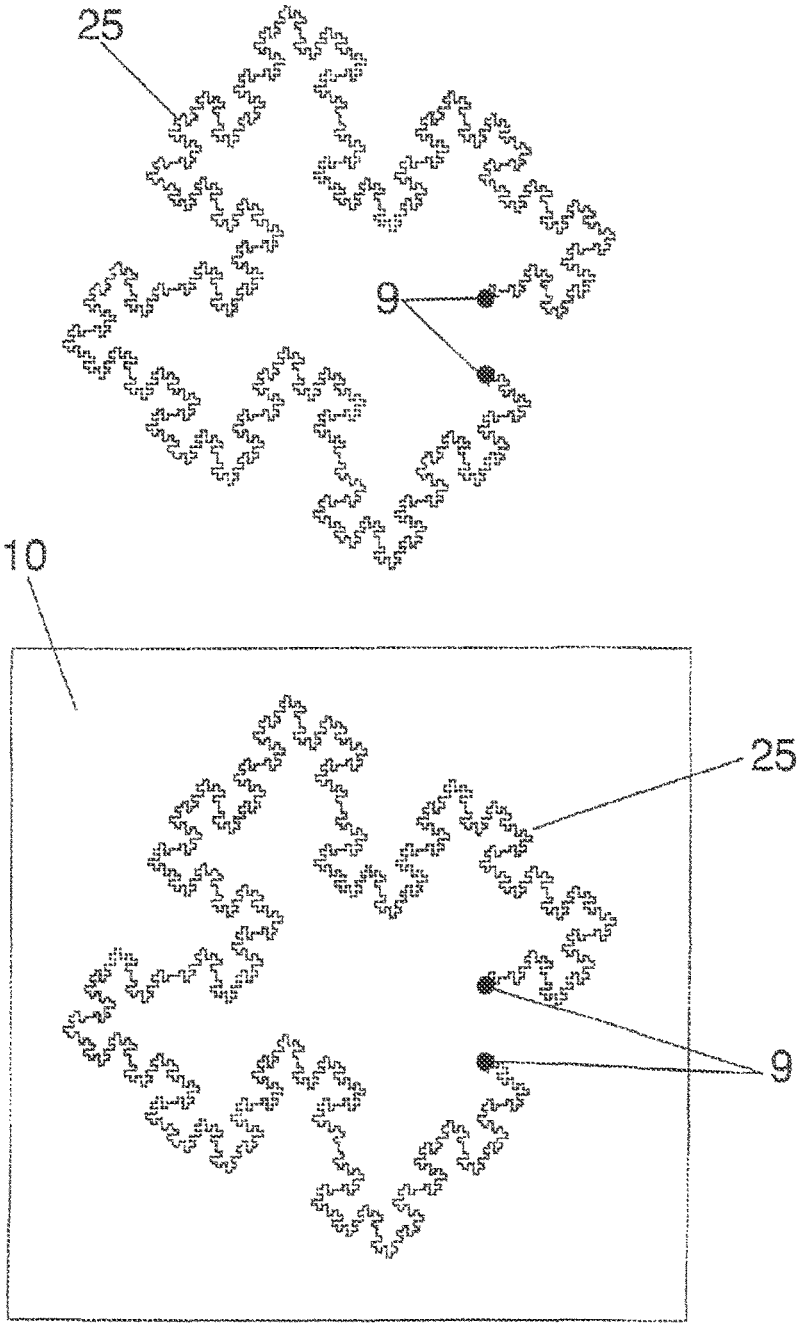
FIG. 9 shows a loop antenna based on curve (25) in a wire configuration (top). Below, the loop antenna 29 is printed over a dielectric substrate (10)

The slot configuration is not, of course, the only way of implementing an SFC loop antenna. A closed SFC curve made of a superconducting or conducting material can be used to implement a wire SFC loop antenna as shown in another preferred embodiment as that of FIG. 9. In this case, a portion of the curve is broken such as the two resulting ends of the curve form the input terminals (9) of the loop. Optionally, the loop can be printed also over a dielectric substrate (10). In case a dielectric substrate is used, a dielectric antenna can be also constructed by etching a dielectric SFC pattern over said substrate, being the dielectric permittivity of said dielectric pattern higher than that of said substrate.

Figure 11:
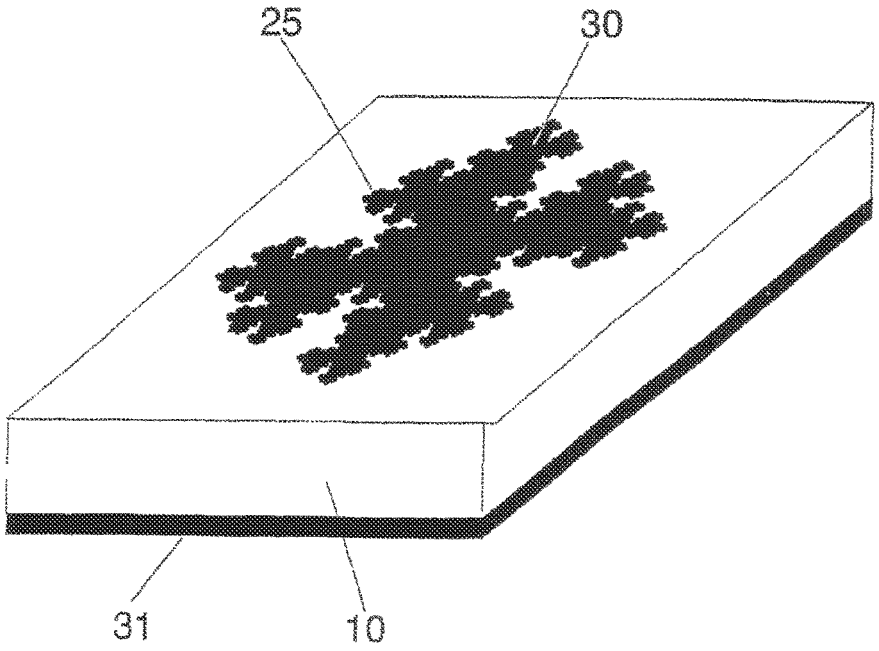
FIG. 11 shows a patch antenna wherein the patch perimeter is shaped according to SFC (25)

Another preferred embodiment is described in FIG. 11. It consists on a patch antenna, with the conducting or superconducting patch (30) featuring an SFC perimeter (the particular case of SFC (25) has been used here but it is clear that other SFC curves could be used instead). The perimeter of the patch is the essential part of the invention here, being the rest of the antenna conformed, for example, as other conventional patch antennas: the patch antenna comprises a conducting or superconducting ground-plane (31) or ground counterpoise, and the conducting or superconducting patch which is parallel to said ground-plane or ground-counterpoise. The spacing between the patch and the ground is typically below (but not restricted to) a quarter wavelength. Optionally, a low-loss dielectric substrate (10) (such as glass-fibre, a teflon substrate such as Cuclad® or other commercial materials such as Rogers® 4003) can be place between said patch and ground counterpoise. The antenna feeding scheme can be taken to be any of the well-known schemes used in prior art patch antennas, for instance: a coaxial cable with the outer conductor connected to the ground-plane and the inner conductor connected to the patch at the desired input resistance point (of course the typical modifications including a capacitive gap on the patch around the coaxial connecting point or a capacitive plate connected to the inner conductor of the coaxial placed at a distance parallel to the patch, and so on can be used as well); a microstrip transmission line sharing the same ground-plane as the antenna with the strip capacitively coupled to the patch and located at a distance below the patch, or in another embodiment with the strip placed below the ground-plane and coupled to the patch through an slot, and even a microstrip transmission line with the strip co-planar to the patch. All these mechanisms are well known from prior art and do not constitute an essential part of the present invention. The essential part of the present invention is the shape of the antenna (in this case the SFC perimeter of the patch) which contributes to reducing the antenna size with respect to prior art configurations.

Figure 13:
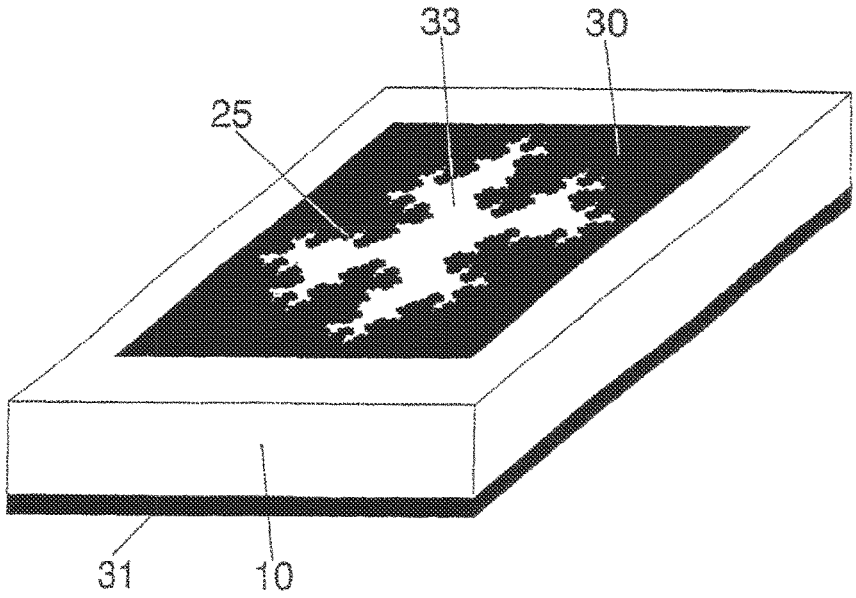
FIG. 13 shows a patch antenna with an aperture on the patch based on SFC (25)
Figure 14:
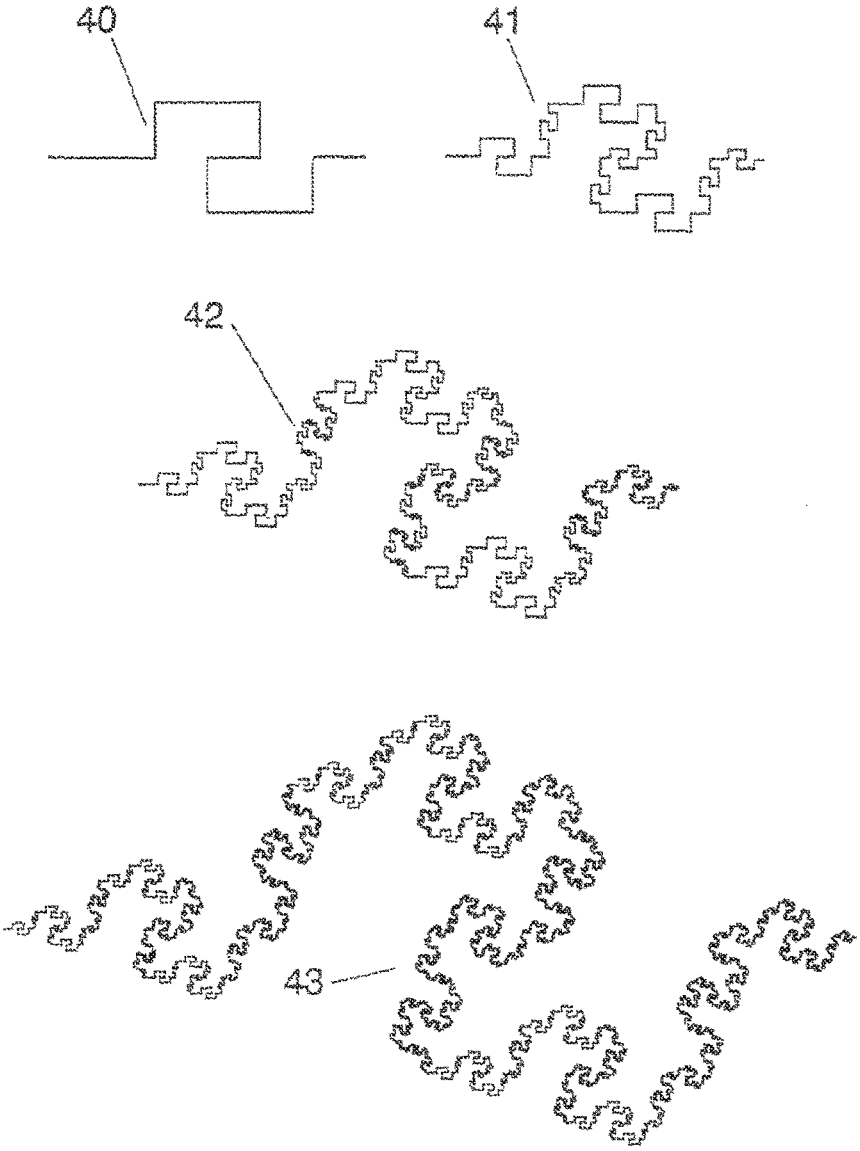
FIG. 14 shows another particular example of a family of SFC curves (41, 42, 43) based on the Giusepe Peano curve. A non-SFC curve formed with only 9 segments is shown for comparison.
Figure 15:
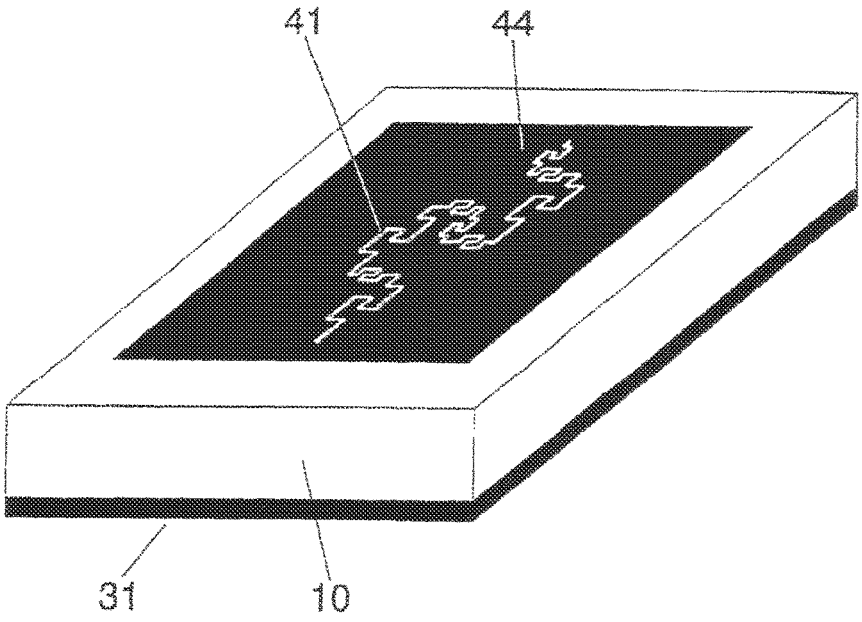
FIG. 15 shows a patch antenna with an SFC slot based on SFC (41)

Other preferred embodiments of SFC antennas based also on the patch configuration are disclosed in FIG. 13 and FIG. 15. They consist on a conventional patch antenna with a polygonal patch (30) (squared, triangular, pentagonal, hexagonal, rectangular, or even circular, to name just a few examples), with an SFC curve shaping a gap on the patch. Such an SFC line can form an slot or spur-line (44) over the patch (as seen in FIG. 15) contributing this way in reducing the antenna size and introducing new resonant frequencies for a multiband operation, or in another preferred embodiment the SFC curve (such as (25) defines the perimeter of an aperture (33) on the patch (30) (FIG. 13). Such an aperture contributes significantly to reduce the first resonant frequency of the patch with respect to the solid patch case, which significantly contributes to reducing the antenna size. Said two configurations, the SFC slot and the SFC aperture cases can of course be use also with SFC perimeter patch antennas as for instance the one (30) described in FIG. 11.

At this point it becomes clear to those skilled in the art what is the scope and spirit of the present invention and that the same SFC geometric principle can be applied in an innovative way to all the well-known, prior art configurations. More examples are given in FIGS. 12, 16, 17 and 18.

Figure 12:
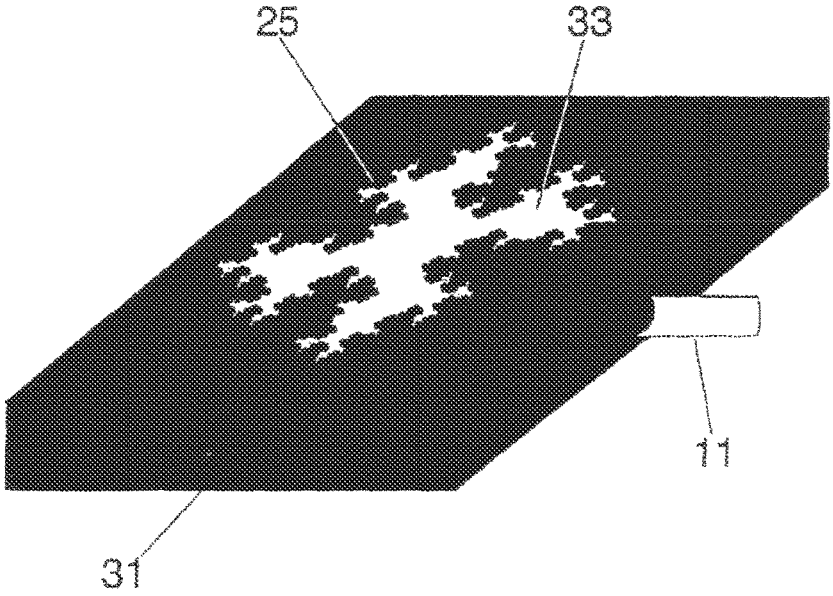
FIG. 12 shows an aperture antenna wherein the aperture (33) is practiced on a conducting or superconducting structure (31), said aperture being shaped with SFC (25)

FIG. 12 describes another preferred embodiment of an SFC antenna. It consists on an aperture antenna, said aperture being characterized by its SFC perimeter, said aperture being impressed over a conducting ground-plane or ground-counterpoise (34), said ground-plane of ground-counterpoise consisting, for example, on a wall of a waveguide or cavity resonator or a part of the structure of a motor vehicle (such as a car, a lorry, an airplane or a tank). The aperture can be fed by any of the conventional techniques such as a coaxial cable (11), or a planar microstrip or strip-line transmission line, to name a few.

Figure 16:
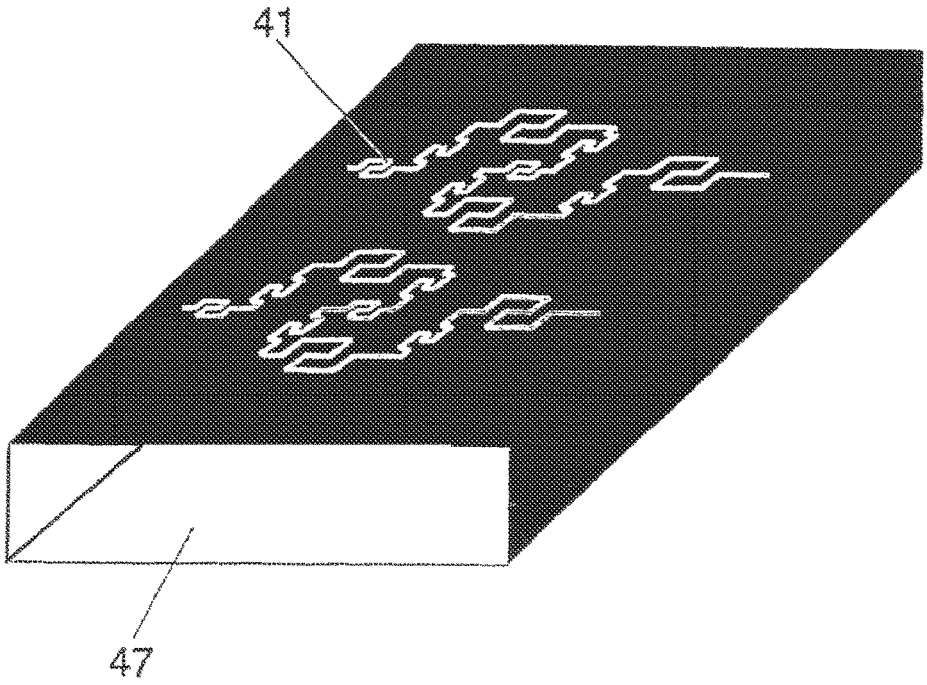
FIG. 16 shows a wave-guide slot antenna wherein a rectangular waveguide (47) has one of its walls slotted with SFC curve (41)

FIG. 16 shows another preferred embodiment where the SFC curves (41) are slotted over a wall of a waveguide (47) of arbitrary cross-section. This way and slotted waveguide array can be formed, with the advantage of the size compressing properties of the SFC curves.

Figure 17:
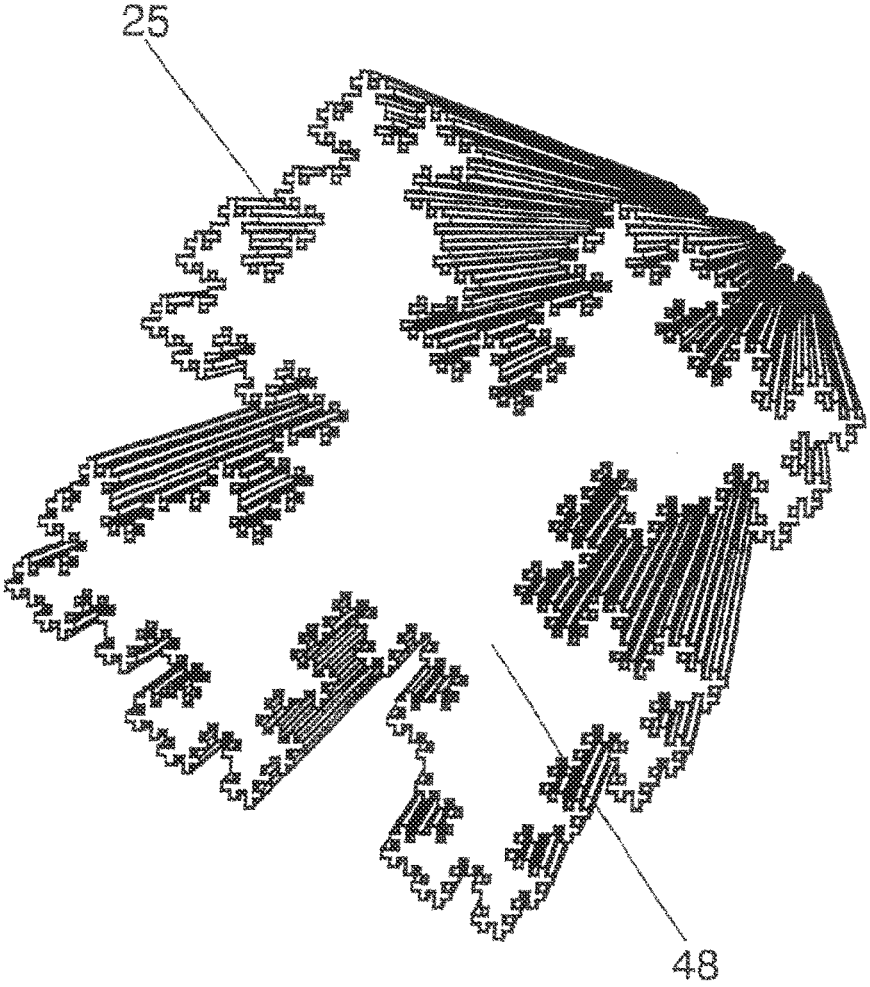
FIG. 17 shows a horn antenna, wherein the aperture and cross-section of the horn is shaped after SFC (25)

FIG. 17 depicts another preferred embodiment, in this case a horn antenna (48) where the cross-section of the antenna is an SFC curve (25). In this case, the benefit comes not only from the size reduction property of SFC Geometries, but also from the broadband behavior that can be achieved by shaping the horn cross-section. Primitive versions of these techniques have been already developed in the form of Ridge horn antennas. In said prior art cases, a single squared tooth introduced in at least two opposite walls of the horn is used to increase the bandwidth of the antenna. The richer scale structure of an SFC curve further contributes to a bandwidth enhancement with respect to prior art.

Figure 18:
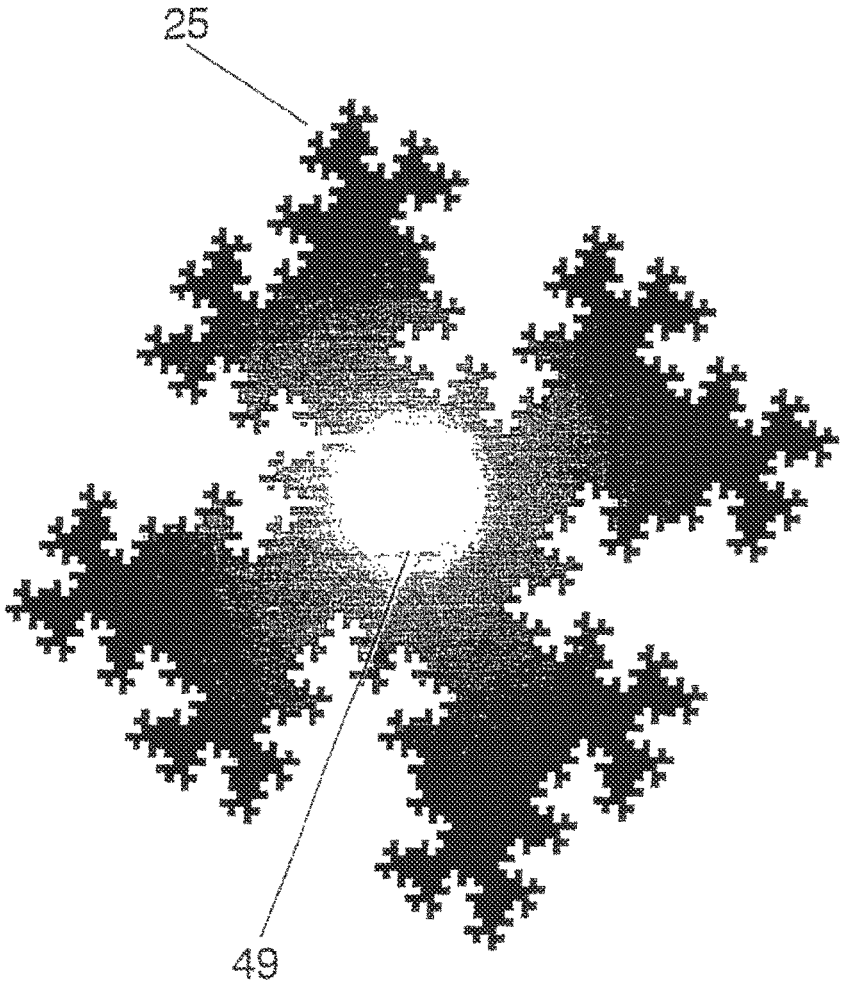
FIG. 18 shows a reflector of a reflector antenna wherein the perimeter of said reflector is shaped as SFC (25)
Figure 19:
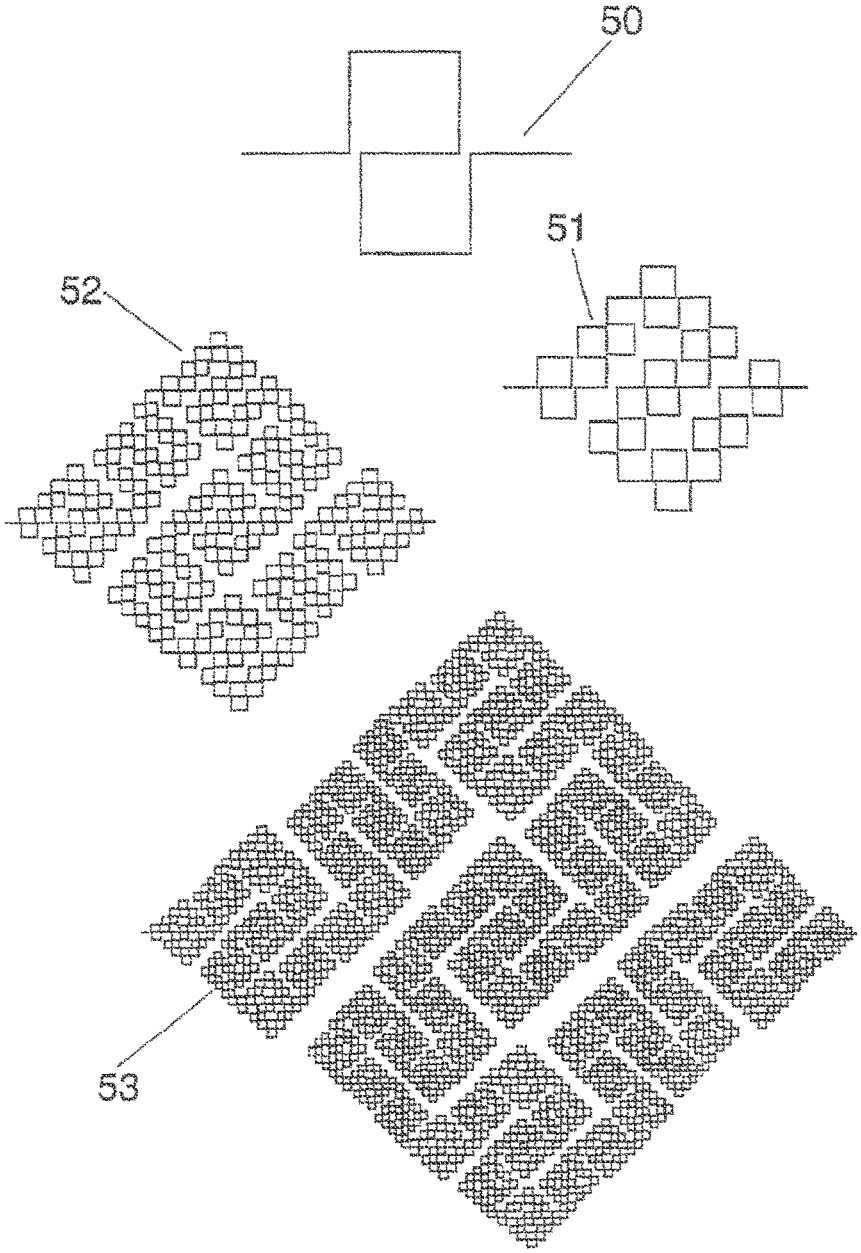
FIG. 19 shows a family of SFC curves (51, 52, 53) based on the Giusepe Peano curve. A non-SFC curve formed with only nine segments is shown for comparison (50)
Figure 20:
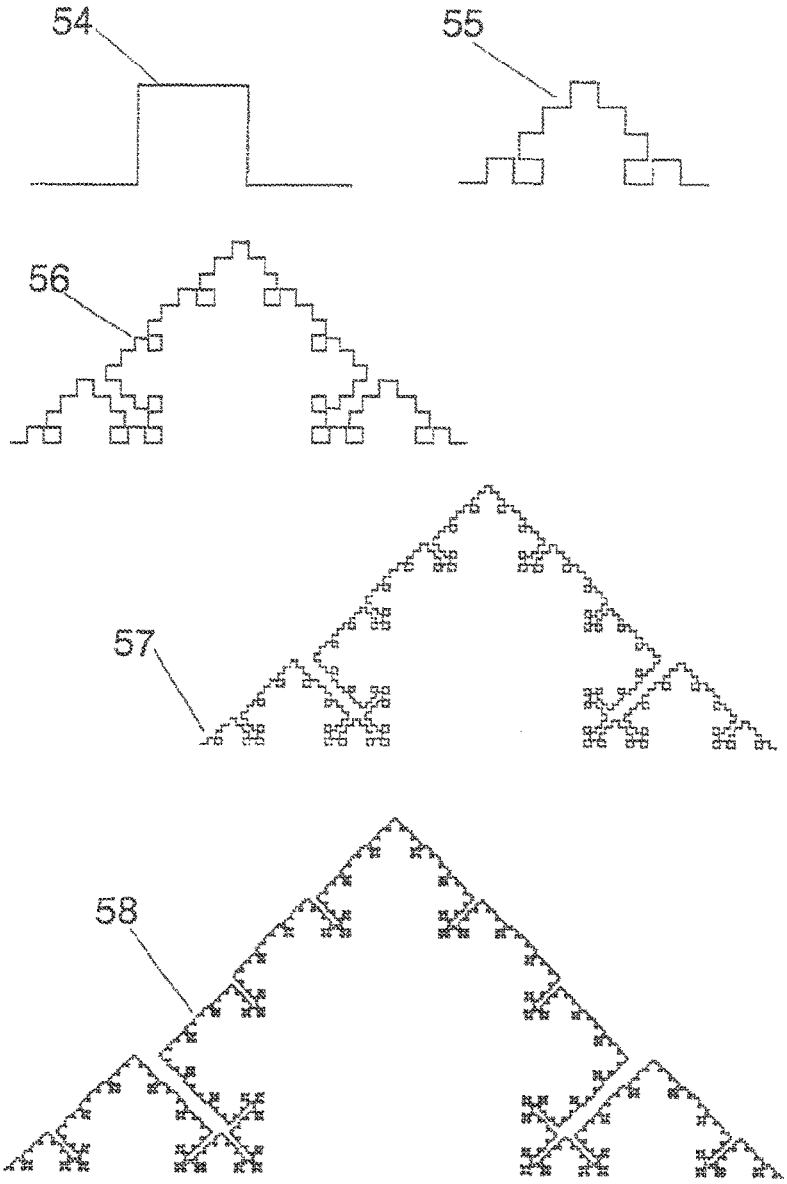
FIG. 20 shows another family of SFC curves (55, 56, 57, 58). A non-SFC curve (54) constructed with only five segments is shown for comparison.
Figure 21:
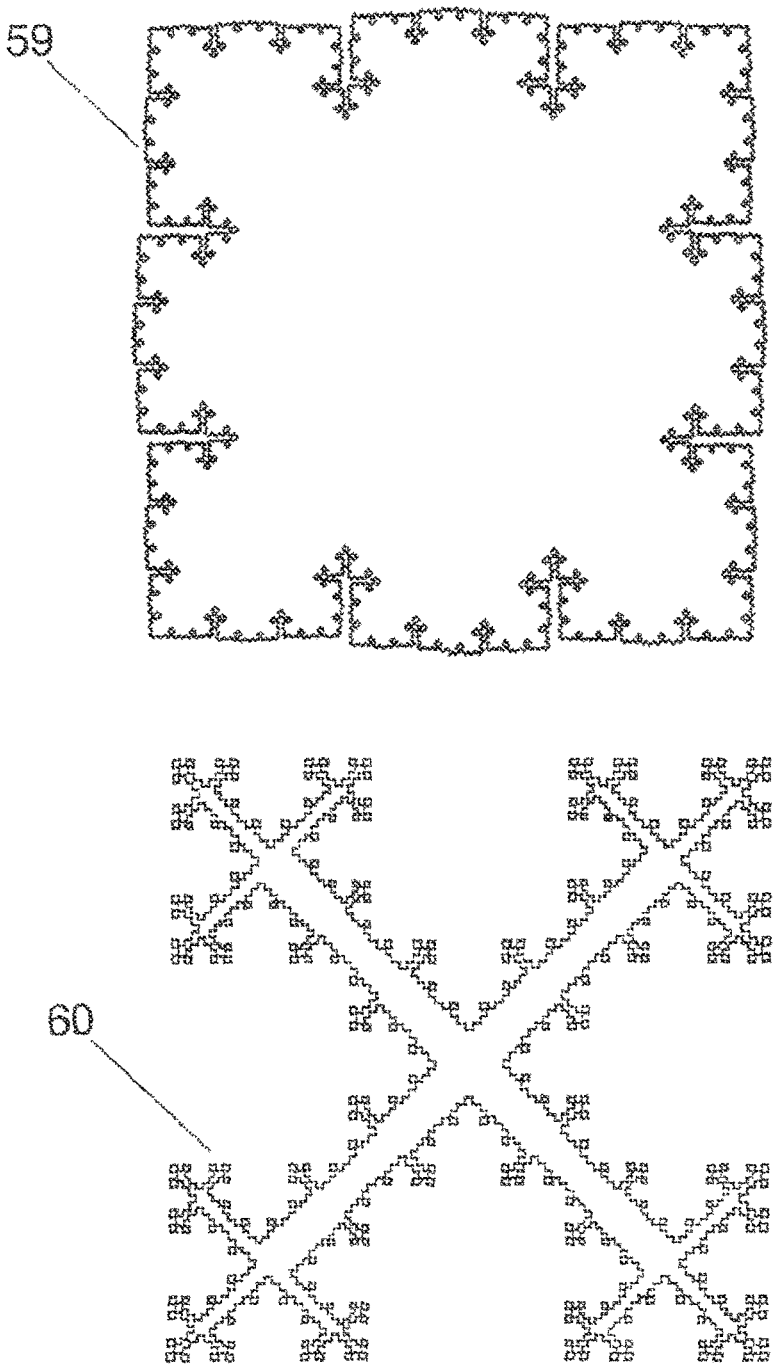
FIG. 21 shows two examples of SFC loops (59, 60) constructed with SFC (57)
Figure 22:
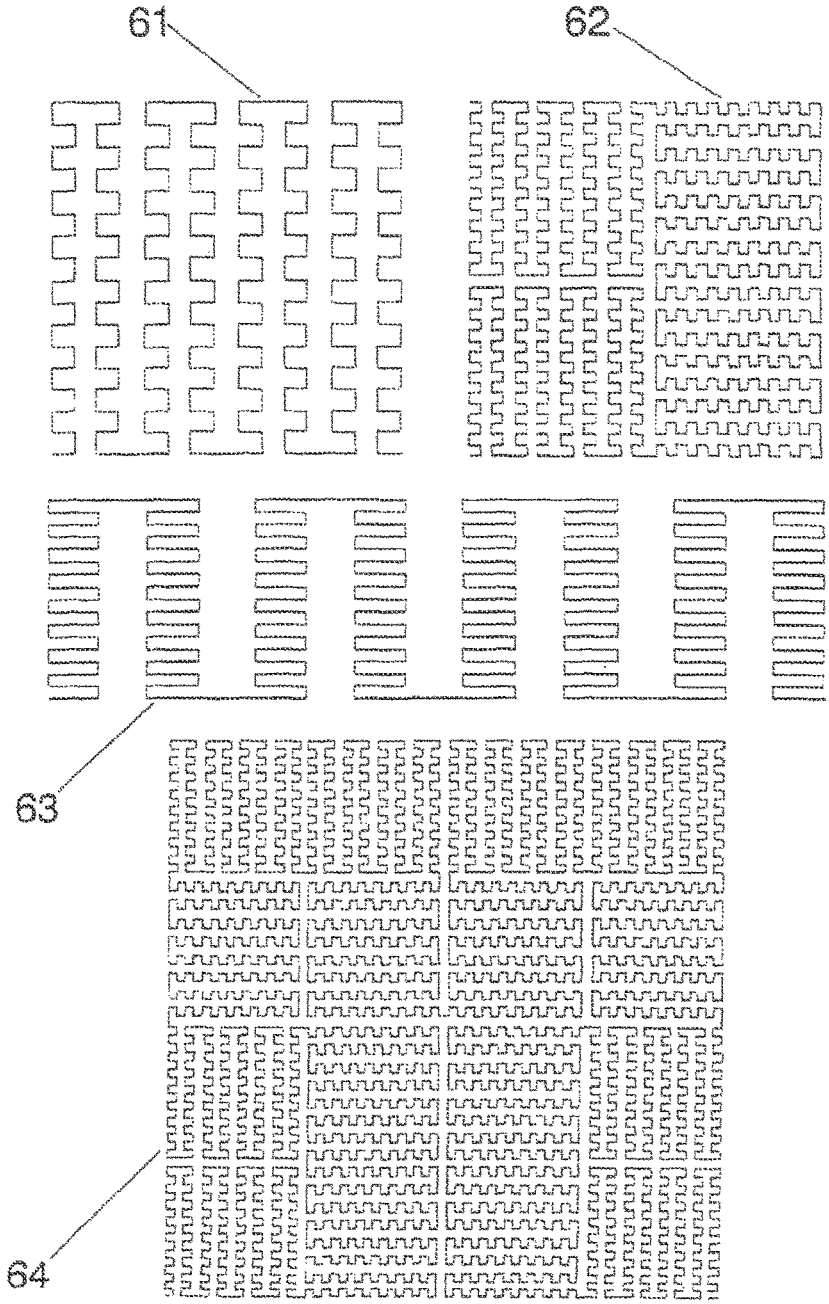
FIG. 22 shows a family of SFC curves (61, 62, 63, 64) named here as HilbertZZ curves.
Figure 23:
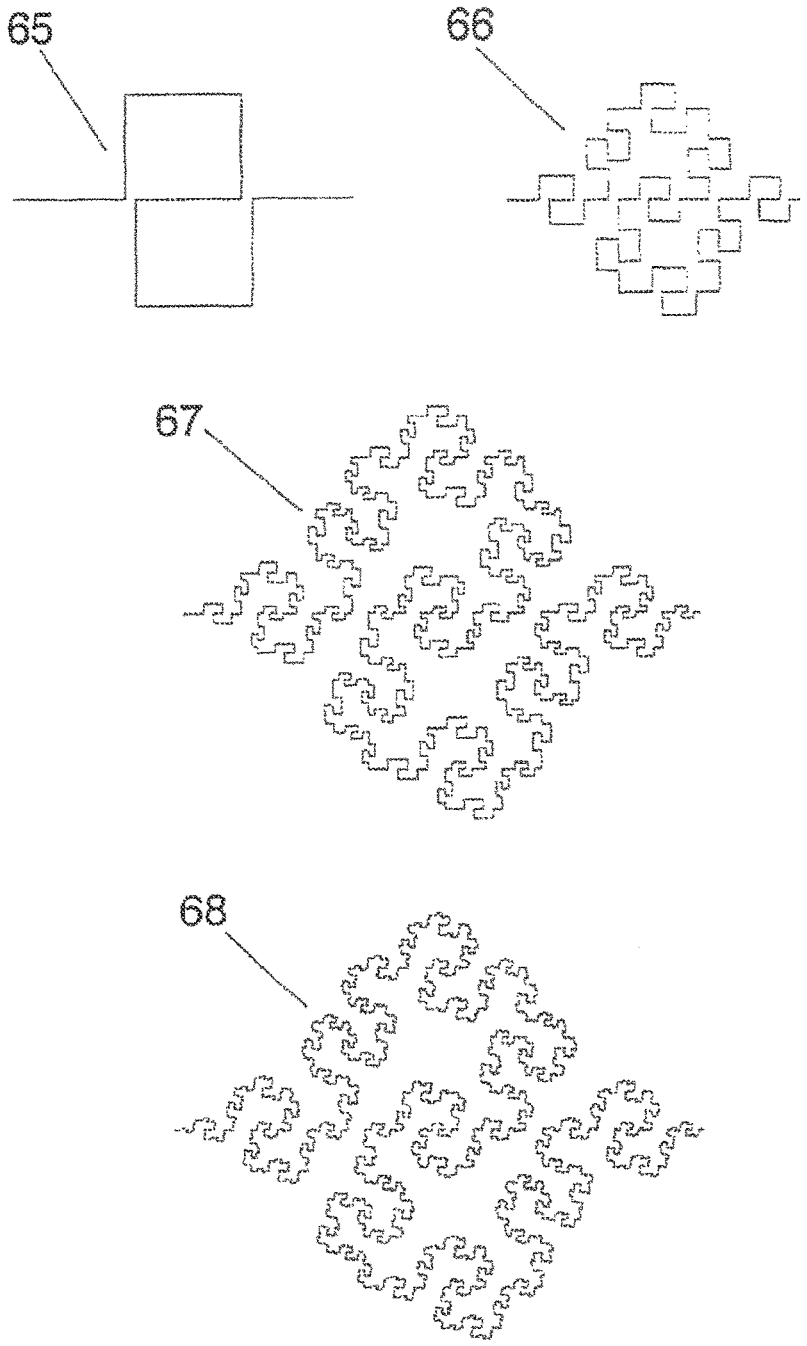
FIG. 23 shows a family of SFC curves (66, 67, 68) named here as Peanodec curves. A non-SFC curve (65) constructed with only nine segments is shown for comparison.
Figure 24:
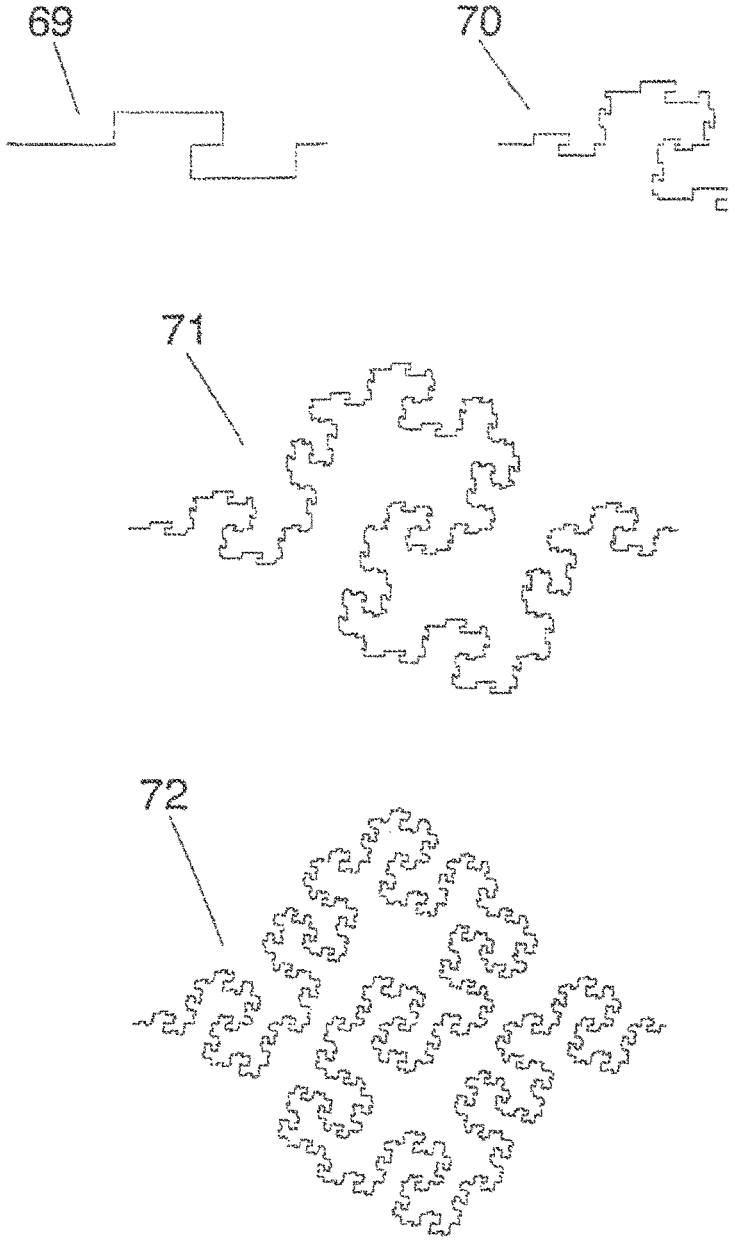
FIG. 24 shows a family of SFC curves (70, 71, 72) named here as Peanoinc curves. A non-SFC curve (69) constructed with only nine segments is shown for comparison.
Figure 25:
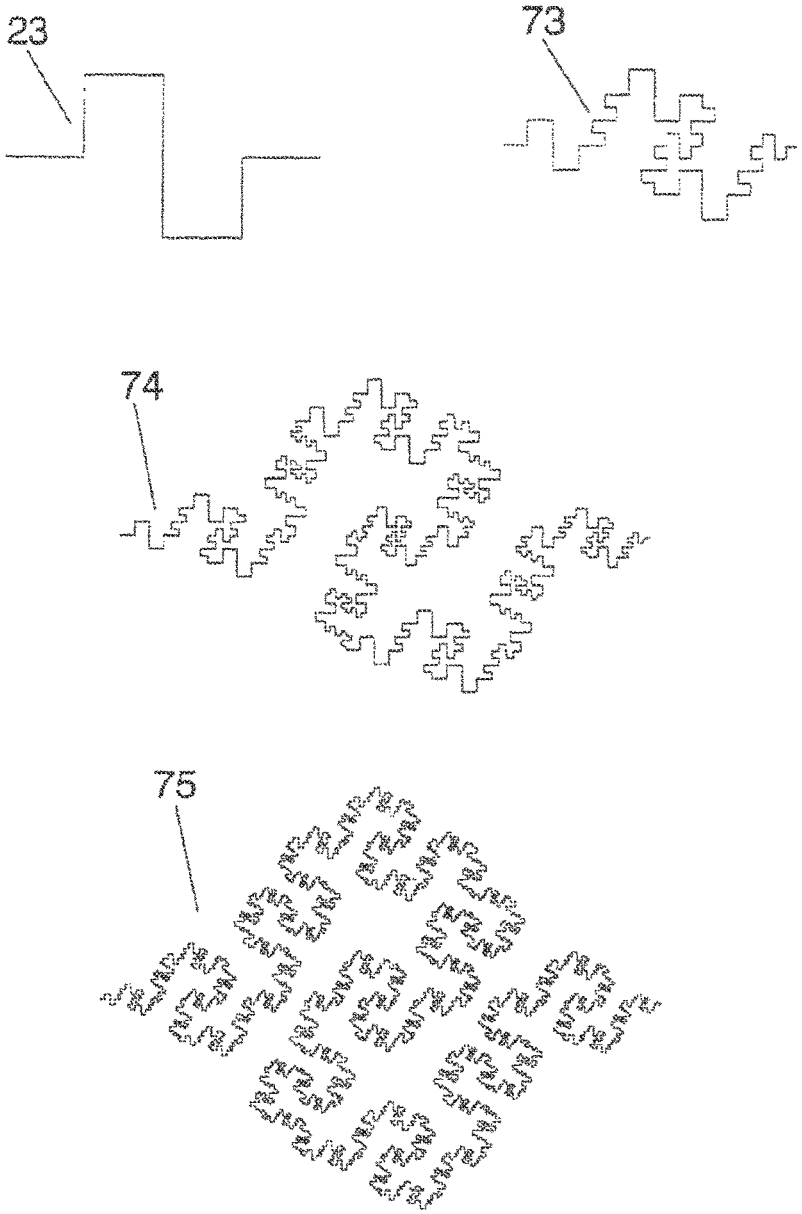
FIG. 25 shows a family of SFC curves (73, 74, 75) named here as PeanoZZ curves. A non-SFC curve (23) constructed with only nine segments is shown for comparison.

FIG. 18 describes another typical configuration of antenna, a reflector antenna (49), with the newly disclosed approach of shaping the reflector perimeter with an SFC curve. The reflector can be either flat or curve, depending on the application or feeding scheme (in for instance a reflect array configuration the SFC reflectors will preferably be flat, while in focus fed dish reflectors the surface bounded by the SFC curve will preferably be curved approaching a parabolic surface). Also, within the spirit of SFC reflecting surfaces, Frequency Selective Surfaces (FSS) can be also constructed by means of SFC curves; in this case the SFC are used to shape the repetitive pattern over the FSS. In said FSS configuration, the SFC elements are used in an advantageous way with respect to prior art because the reduced size of the SFC patterns allows a closer spacing between said elements. A similar advantage is obtained when the SFC elements are used in an antenna array in an antenna reflect array.

Having illustrated and described the principles of our invention in several preferred embodiments thereof, it should be readily apparent to those skilled in the art that the invention can be modified in arrangement and detail without departing from such principles. We claim all modifications coming within the spirit and scope of the accompanying claims.

What is claimed is:

1. A device comprising:

a monopole antenna entirely included within the device and comprising an antenna element and a ground plane, the antenna element having an entire perimeter shaped as a space-filling curve, wherein:

the space-filling curve comprises at least ten connected segments;

each segment is shorter than one tenth of at least one operating free-space wavelength of the monopole antenna;

the segments are spatially arranged such that no two adjacent and connected segments form another longer segment;

each pair of adjacent segments forms a corner;

none of the segments intersect with another segment other than to form a closed loop; and the space-filling curve is shaped so that an arrangement of the segments does not include a subset of segments that is repeated through the space-filling curve, and the arrangement of the segments is not self-similar with respect to the entire space-filling curve.

2. The device of claim 1, wherein the monopole antenna is configured to simultaneously operate in at least first and second non-overlapping frequency bands.

3. The device of claim 2, wherein the first frequency band comprises 1,800 MHz and the second frequency band comprises 2,100 MHz.

4. The device of claim 2, wherein the first frequency band comprises 850 MHz and the second frequency band comprises 2,100 MHz.

5. The device of claim 1 wherein the antenna element extends out of the ground plane from a connection point near a surface of the ground plane.

6. The device of claim 5, wherein the at least ten connected segments comprising the space-filling curve are straight segments.

7. A device comprising:

an antenna entirely included within the device and comprising an antenna element and a ground plane, the antenna element having an entire perimeter shaped as a space-filling curve, wherein:

the space-filling curve comprises at least ten connected segments;

each segment is shorter than one tenth of at least one operating free-space wavelength of the antenna;

the segments are spatially arranged such that no two adjacent and connected segments form another longer segment;

each pair of adjacent segments forms a corner;

none of the segments intersect with another segment other than to form a closed loop;

the space-filling curve is shaped so that an arrangement of the segments does not include a continued repetition of some parts of itself, and the arrangement of the segments is not self-similar with respect to the entire space-filling curve; and the space-filling curve has a box-counting dimension greater than one, with the box-counting dimension computed as the slope of a substantially straight portion of a line in a log-log graph over at least an octave of scales on the horizontal axis of the log-log graph.

8. The device of claim 7, wherein the space-filling curve has a box-counting dimension greater than 1.2.

9. The device of claim 8, wherein the space-filling curve has a box-counting dimension greater than 1.3.

10. The device of claim 9, wherein the space-filling curve has a box-counting dimension greater than 1.4.

11. The device of claim 10, wherein the space-filling curve has a box-counting dimension greater than 1.5.

12. The device of claim 8, wherein the antenna is configured to simultaneously operate in at least first and second non-overlapping frequency bands.

13. The device of claim 12, wherein the first frequency band comprises 1,800 MHz and the second frequency band comprises 2,100 MHz.

14. The device of claim 8, wherein the corners are curved.

15. A device comprising:

an antenna entirely included within the device and comprising an antenna element and a ground plane, the antenna element having an entire perimeter shaped as a space-filling curve, wherein:

the space-filling curve comprises at least ten connected segments;

each segment is shorter than one tenth of at least one operating free-space wavelength of the antenna;

the segments are spatially arranged such that no two adjacent and connected segments form another longer segment;

each pair of adjacent segments forms a corner;

none of the segments intersect with another segment other than to form a closed loop;

the space-filling curve is shaped so that an arrangement of the segments does not include a continued repetition of some parts of itself, and the arrangement of the segments is not self-similar with respect to the entire space-filling curve;

the space-filling curve has a box-counting dimension greater than one, with the box-counting dimension computed as the slope of a substantially straight portion of a line in a log-log graph over at least an octave of scales on the horizontal axis of the log-log graph; and the antenna is configured to simultaneously operate in at least first and second non-overlapping frequency bands.

16. The device of claim 15, wherein the first frequency band comprises 1,800 MHz and the second frequency band comprises 2,100 MHz.

17. The device of claim 15, wherein the space-filling curve has a box-counting dimension greater than 1.3.

18. The device of claim 15, wherein the at least ten connected segments comprising the space-filling curve are straight segments.

19. The device of claim 15, wherein the corners are curved.

20. The device of claim 15, wherein the antenna element extends out of the ground plane from a connection point near a surface of the ground plane.

* * * * *